US006752544B2

(12) United States Patent
Sanada et al.

(10) Patent No.: US 6,752,544 B2
(45) Date of Patent: Jun. 22, 2004

(54) DEVELOPING APPARATUS AND DEVELOPING METHOD

(75) Inventors: Masakazu Sanada, Kyoto (JP); Masahiko Harumoto, Kyoto (JP); Hiroshi Kobayashi, Kyoto (JP); Minobu Matsunaga, Kyoto (JP)

(73) Assignee: Dainippon Screen Mfg. Co., Ltd. (JP)

( * ) Notice: Subject to any disclaimer, the term of this patent is extended or adjusted under 35 U.S.C. 154(b) by 0 days.

(21) Appl. No.: 10/305,911

(22) Filed: Nov. 26, 2002

(65) Prior Publication Data

US 2003/0185560 A1 Oct. 2, 2003

(30) Foreign Application Priority Data

Mar. 28, 2002 (JP) ..... P2002-091346
Oct. 17, 2002 (JP) ..... P2002-303322

(51) Int. Cl.[7] ..... G03D 5/00

(52) U.S. Cl. ..... 396/604; 396/611; 396/627; 118/52; 118/319; 134/902; 427/240

(58) Field of Search ..... 396/604, 611, 396/627; 134/902; 427/240; 118/52, 696, 319–321

(56) References Cited

U.S. PATENT DOCUMENTS 5,672,205 A * 9/1997 Fujimoto et al. ..... 118/319
6,051,101 A 4/2000 Ohtani et al. ..... 156/345
6,092,937 A 7/2000 Snodgrass et al. ..... 396/611
6,183,810 B1 2/2001 Ota ..... 427/240
6,444,029 B1 * 9/2002 Kimura et al. ..... 118/52

FOREIGN PATENT DOCUMENTS

JP 10-020508 1/1998
JP 10-340836 12/1998
JP 11-267573 10/1999
JP 3352417 9/2002

* cited by examiner

*Primary Examiner*—D. Rutledge
(74) *Attorney, Agent, or Firm*—Ostrolenk, Faber, Gerb & Soffen, LLP

(57) ABSTRACT

A substrate (W) is held in an approximately horizontal position by a substrate holder (10) and is rotated by a spinning motor (13). A rinsing liquid supply nozzle (140) is rotatably supported at its one end by a second nozzle movement mechanism (150) and is rotated to pass over the substrate (W). The rinsing liquid supply nozzle (140) is rotated to pass over the substrate (W) and at the same time to discharge a rinsing liquid from its discharge unit. At this time, the rinsing liquid supply nozzle (140) and the substrate (W) are rotated so that a virtual scanning direction (La) of the substrate (W) is substantially perpendicular to a direction of extension of the rinsing liquid supply nozzle (140). That is, since the rinsing liquid supply nozzle (140) is shifted in the virtual scanning direction (La), a non-supplying area of the substrate (W) where a rinsing liquid is not supplied can successively be made up and eliminated as the scanning by the nozzle (140) proceeds.

29 Claims, 43 Drawing Sheets

DEVELOPING APPARATUS AND DEVELOPING METHOD

BACKGROUND OF THE INVENTION

1. Field of the Invention

The present invention relates to a substrate processing apparatus and method for supplying a developer, a rinsing liquid and the like to substrates such as semiconductor wafers and glass substrates for liquid crystal display panels and for plasma display panels. And it relates especially to a developing apparatus and developing method for developing a thin resist film formed on those substrates and having a predetermined pattern exposed.

2. Description of the Background Art

Conventionally, developing apparatuses of this type comprise a developer supply nozzle having a slit developer discharge unit formed with an opening width equal to or greater than the width of a substrate, and a rinsing liquid supply nozzle having a slit rinsing liquid discharge unit formed with an opening width equal to or greater than the width of a substrate (refer to, for example, U.S. Pat. No. 6,092,937 and Japanese Patent Application Laid-open No. 10-340836).

Such developing apparatuses move the developer supply nozzle from one end of a substrate to the other to supply a developer to the entire upper surface of the substrate (this developer supply method is also called a slit scan developing method), and after the expiration of a predetermined time interval, move the rinsing liquid supply nozzle from one end of the substrate to the other with the same travel speed as the developer supply nozzle to supply a rinsing liquid to the entire upper surface of the substrate and thereby to stop development on the upper surface of the substrate.

In this case, making equal the travel speeds of the developer supply nozzle and the rinsing liquid supply nozzle carries the advantages that development time is approximately the same at each point on the upper surface of the substrate, thereby preventing unevenness in development, and that uniformity in the line width of a resist pattern after development can be improved.

However, in the above developing apparatuses, for reasons such as adhesion of undesirable matter to the discharge units and any possible defects resulting therefrom, the supply of a rinsing liquid from the slit discharge unit may not be uniform (for example, in amount and in velocity) along a discharge width of the discharge unit. The same can be said of the supply of a developer, but since especially a rinsing liquid needs to be passed over a layer of developer, the spacing between the rinsing liquid supply nozzle and the substrate becomes greater and, as a result, there is a greater likelihood that the supply of a rinsing liquid is not uniform.

In this case, since the rinsing liquid supply nozzle and the like are moved linearly from one end of the substrate to the other, a streak of area to which processing liquids were not supplied may remain along a direction of nozzle movement on the substrate, and therefore, the supply of a rinsing liquid and the like to the substrate may become nonuniform along the width of the substrate.

SUMMARY OF THE INVENTION

The present invention is directed to an apparatus and method for supplying a developer and a rinsing liquid to a substrate.

A developing apparatus for developing a thin resist film with a developer and stopping development with a rinsing liquid, the resist film being formed on a major surface of a substrate and having a predetermined pattern exposed, includes a substrate holder, a developer supply section, a rinsing liquid supply nozzle, a rinsing liquid supply system and a rinsing liquid supply nozzle moving section. The substrate holder is configured to hold a substrate. The developer supply section is configured to supply a developer to the major surface of the substrate held by the substrate holder to form a developer layer on the major surface of the substrate. The rinsing liquid supply nozzle has a rinsing liquid discharge unit for discharging a rinsing liquid with a discharge width substantially equal to or greater than the width of the substrate. The rinsing liquid supply system is configured to supply a rinsing liquid to the rinsing liquid supply nozzle and to cause the rinsing liquid supply nozzle to discharge a rinsing liquid from the rinsing liquid discharge unit. The rinsing liquid supply nozzle moving section is configured to move the rinsing liquid supply nozzle along a line running diagonally relative to a virtual scanning direction from a supply start point on one end of the substrate held at rest by the substrate holder to a supply end point on the other end of the substrate, so that the rinsing liquid supply nozzle passes over the developer layer on the major surface of the substrate in such a position that a direction along the discharge width of the rinsing liquid discharge unit is substantially perpendicular to the virtual scanning direction. In the development apparatus, the rinsing liquid supply nozzle is moved from the supply start point of the substrate to the supply end point by the rinsing liquid supply nozzle moving section and is at the same time caused to discharge a rinsing liquid from the rinsing liquid discharge unit onto the developer layer by the rinsing liquid supply system.

Shifting the rinsing liquid discharge unit in a direction substantially perpendicular to the virtual scanning direction improves uniformity in the supply of a rinsing liquid.

The present invention is also directed to a developing apparatus for developing a thin resist film with a developer and stopping development with a rinsing liquid, the resist film being formed on the major surface of a substrate and having a predetermined pattern exposed. The development apparatus includes a substrate holder, a substrate rotating section, a developer supply section, a rinsing liquid supply nozzle, a rinsing liquid supply system, a rinsing liquid supply nozzle rotating section and a controller. The substrate holder is configured to hold a substrate. The substrate rotating section is configured to rotate the substrate held by the substrate holder. The developer supply section is configured to supply a developer to the major surface of the substrate held by the substrate holder to form a developer layer on the major surface of the substrate. The rinsing liquid supply nozzle has a rinsing liquid discharge unit for discharging a rinsing liquid with a discharge width substantially equal to or greater than the width of the substrate. The rinsing liquid supply system is configured to supply a rinsing liquid to the rinsing liquid supply nozzle and to cause the rinsing liquid supply nozzle to discharge a rinsing liquid from the rinsing liquid discharge unit. The rinsing liquid supply nozzle rotating section is configured to support one end of the rinsing liquid supply nozzle so that the rinsing liquid supply nozzle is rotatable on a rotation axis outside the substrate held by the substrate holder, and to rotate the rinsing liquid supply nozzle so that the rinsing liquid supply nozzle passes over the substrate held by the substrate holder. The controller is configured to control the substrate rotating section, the rinsing liquid supply system and the rinsing liquid supply nozzle rotating section so that the substrate held by the substrate holder is rotated in a first rotational direction by the substrate rotating section, and so that the rinsing liquid supply nozzle, while being rotated in the first rotational direction to pass over the developer layer formed on the major surface of the substrate being rotated, discharges a rinsing liquid from the rinsing liquid discharge unit to supply a rinsing liquid from a supply start point on one end of the substrate to a supply end point on the other end.

With a substrate being rotated, the rinsing liquid supply nozzle is rotated to pass over the substrate and at the same time to supply a rising liquid to the major surface of the substrate. That is, the rinsing liquid supply nozzle moves along an arc relative to the substrate, which improves uniformity in the supply of a rinsing liquid.

In the developing apparatus, the controller controls the substrate rotating section and the rinsing liquid supply nozzle rotating section so that a virtual scanning direction from the supply start point of the substrate to the supply end point is substantially perpendicular to a direction along the discharge width of the rinsing liquid discharge unit.

Preferably, control of the controller is made such that a velocity of the developer supply nozzle when moving over the substrate and, out of relative velocity components of the rinsing liquid supply nozzle with respect to the substrate being rotated by the substrate rotating section, a relative velocity component in a virtual scanning direction from the supply start point of the substrate to the supply end point have substantially the same constant velocity pattern.

Since the velocity of the developer supply nozzle and the relative velocity component of the rinsing liquid supply nozzle in the virtual scanning direction have substantially the same constant velocity pattern, the timing of termination of the development can be made approximately the same at each point in the plane of the substrate and also the amounts of the supply of a developer and a rinsing liquid can be made approximately uniform.

More preferably, a rinsing liquid is discharged from the rinsing liquid discharge unit in a direction opposite to a direction of movement of the rinsing liquid supply nozzle relative to a substrate. And, at a point in time when a rinsing liquid discharged from the rinsing liquid discharge unit drops onto the developer layer on the major surface of the substrate, out of relative velocity components of the rinsing liquid with respect to the substrate, a relative velocity component in a direction of its discharge with respect to a direction of a plane of the substrate is set to be greater than 0.

Since the relative velocity component of the rising liquid in the direction of its discharge with respect to the plane of the substrate is set to be greater than 0, it is possible to prevent the occurrence of such situations that a rinsing liquid is swept in front of the rinsing liquid supply nozzle.

The present invention is also directed a developing method for developing a thin resist film with a developer and stopping development with a rinsing liquid, the resist film being formed on a major surface of a substrate and having a predetermined pattern exposed. The developing method includes the steps of: (a) supplying a developer onto the major surface of a substrate to form a developer layer on the major surface; (b) discharging a rinsing liquid onto the developer layer from a rinsing liquid discharge unit with a discharge width substantially equal to or greater than the width of the substrate; (c) while keeping the rinsing liquid discharge unit in such a position that a direction along the discharge width of the rinsing liquid discharge unit is substantially perpendicular to a virtual scanning direction from a supply start point on one end of the substrate to the supply end point on the other end, relatively moving the rinsing liquid discharge unit from the supply start point of the substrate to the supply end point; and (d) shifting the rinsing liquid discharge unit in a direction substantially perpendicular to the virtual scanning direction. The steps (b) through (d) are performed in parallel after the step (a).

Shifting the rinsing liquid discharge unit in a direction orthogonal to the virtual scanning direction improves uniformity in the supply of a rinsing liquid.

Thus, an object of the present invention is to improve uniformity in the supply of a rinsing liquid.

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

In this first preferred embodiment, a developing apparatus is described which, while holding a substrate at rest, moves a developer supply nozzle and a rinsing liquid supply nozzle along a line running diagonally relative to a virtual scanning direction of the substrate.

Figure 1:
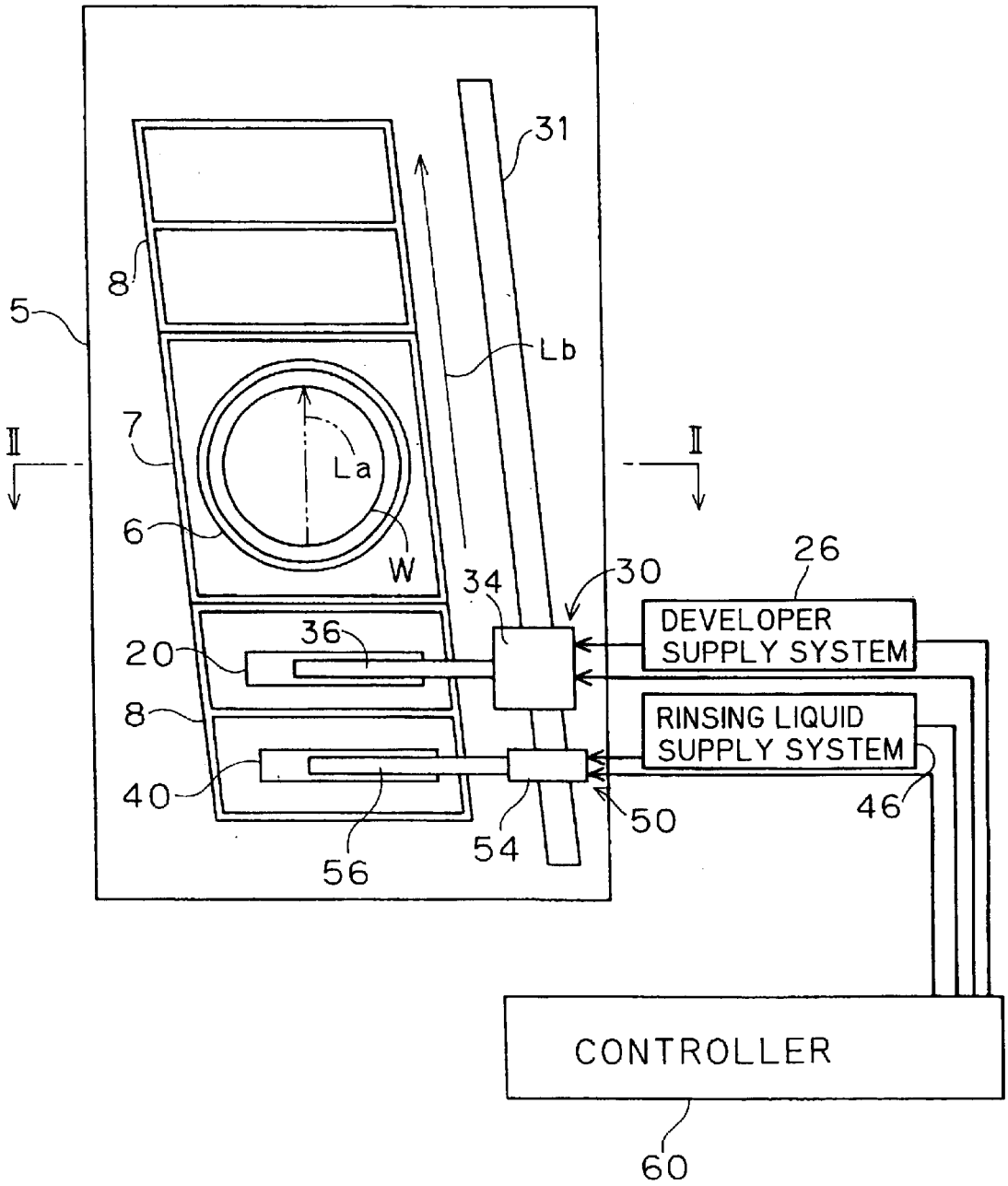
FIG. 1 is a schematic plan view showing a developing apparatus according to a first preferred embodiment of the present invention.
Figure 2:
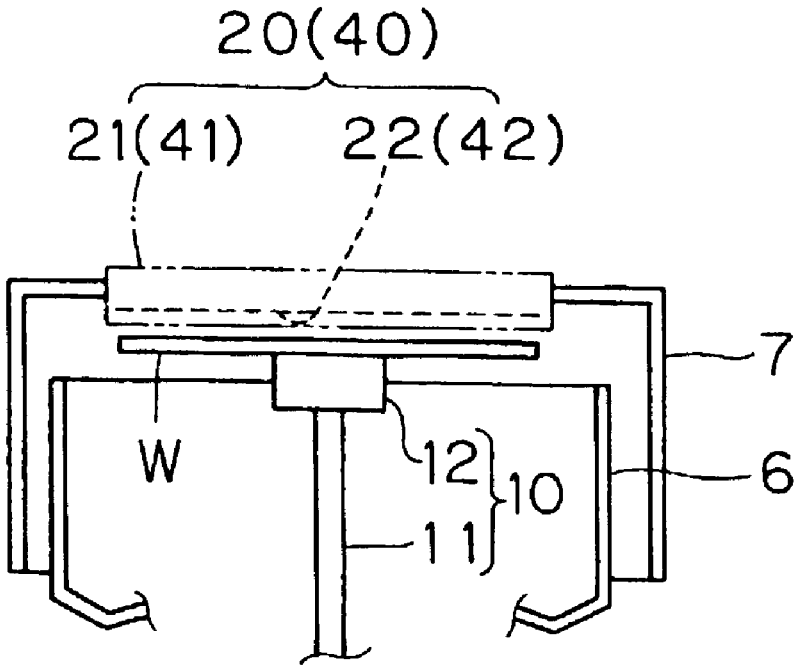
FIG. 2 is a schematic cross-sectional view taken along the line II—II of FIG. 1.

FIG. 1 is a plan view showing a schematic configuration of the developing apparatus according to the first preferred embodiment of the present invention, and FIG. 2 is a cross-sectional view taken along the line II—II of FIG. 1. In FIG. 2, a developer supply nozzle 20 or a rinsing liquid supply nozzle 40 moving over a substrate W is illustrated by the dash-double dot lines.

This developing apparatus is configured to supply a developer and a rinsing liquid as processing liquids to the substrate W after being exposed for development processing. It comprises a substrate holder 10 for holding the substrate W, the developer supply nozzle 20, a first nozzle movement mechanism 30 for moving the developer supply nozzle 20, the rinsing liquid supply nozzle 40, a second nozzle movement mechanism 50 for moving the rinsing liquid supply nozzle 40, and a controller 60 for controlling the operation of the entire apparatus.

The substrate holder 10 holds the substrate W in an approximately horizontal position.

More specifically, the substrate holder 10 comprises a support shaft 11 located in an approximately vertical position near the center of an apparatus body 5, and a support base 12 fixedly mounted on the upper end of the support shaft 11. The support base 12 is configured to be capable of holding the substrate W in an approximately horizontal position by suction. Here, it is to be noted that the support base 12 is not limited to the configuration of holding the substrate W by suction, but it may be configured to, for example, grasp the peripheral portion of the substrate W. In the present example, a thin resist film having a predetermined pattern exposed is formed on the major surface of the substrate W.

Around the substrate holder 10, a circular inner cup 6 is provided to surround the substrate W and a generally square outer cup 7 is provided around the outer periphery of the inner cup 6. Also, standby pots 8 are provided on both sides of the outer cup 7.

The developer supply nozzle 20, as shown in FIGS. 1, 2, 3A and 3B, has a discharge unit 22 for discharging a processing liquid with a discharge width substantially equal to or greater than the width of the substrate W.

In this preferred embodiment, the slit discharge unit 22 is formed in the lower end portion of a transversely elongated nozzle body 21. The discharge unit 22 extends along the length of the nozzle body 21 and its longitudinal dimension is substantially equal to or greater than the width of the substrate W.

Here, the width of the substrate W is the dimension of the substrate W in a direction orthogonal to a virtual scanning direction La from a supply start point on one end of the substrate W to a supply end point on the other end. In this preferred embodiment, the substrate W is of substantially a generally circular disk shape, wherein the supply start point and the supply end point are respectively on one and the other ends of the substrate W having a predetermined diameter and the virtual scanning direction La is a direction from the supply start point to the supply end point. The supply start point and the supply end point are located at diametrically opposed positions on the outer periphery of the generally circular disk substrate W, to sandwich the center of the substrate. Since the substrate W is of substantially a generally circular disk shape, the width of the substrate W indicates the diameter of a circle defining a plan configuration of the substrate W.

The ideal condition is when the discharge unit 22 discharges a developer along the whole discharge width in the form of a curtain, i.e., with a constant velocity and a constant amount along the whole discharge width.

Figure 3A:
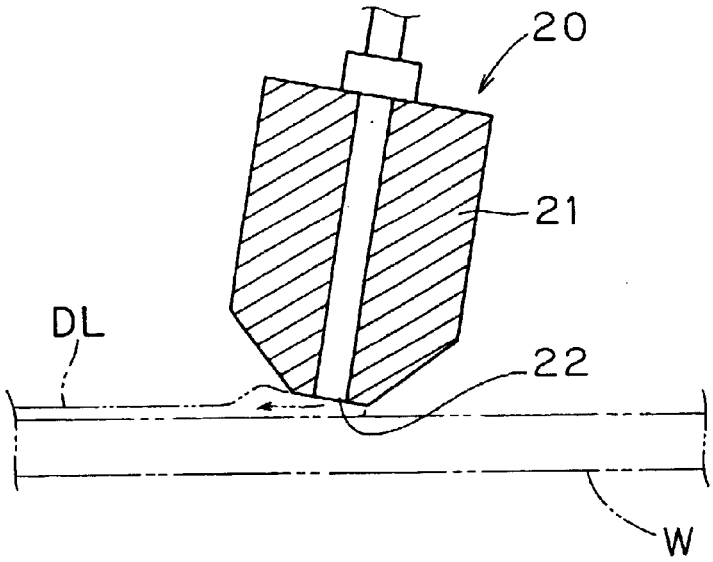
FIG. 3A is a cross-sectional view of a developer supply nozzle.
Figure 3B:
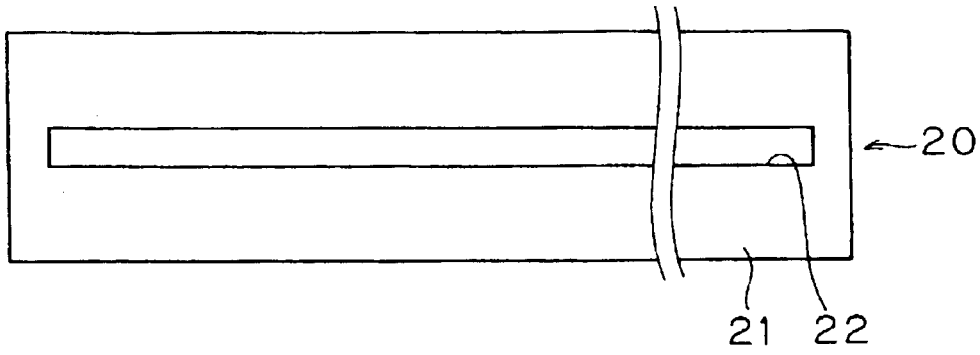
FIG. 3B is a bottom view of the developer supply nozzle.

The discharge unit 22 of the developer supply nozzle 20 is inclined at a predetermined angle with respect to a direction opposite to a direction of movement of the developer supply nozzle 20 (see FIG. 3A). Thus, a developer discharged from the discharge unit 22 flows in the direction opposite to the direction of movement of the developer supply nozzle 20. This prevents a developer from flowing ahead of the movement of the developer supply nozzle 20.

The developer supply nozzle 20 is coupled to a developer supply system 26.

The developer supply system 26 comprises a developer supply source for storing a developer and an on-off valve (both not shown), and is configured to supply a developer from the developer supply source to the developer supply nozzle 20 in a predetermined timed relationship with the opening and closing of the on-off valve.

The first nozzle movement mechanism 30, while keeping the direction of extension (discharge width) of the discharge unit 22 substantially perpendicular to the virtual scanning direction La of the substrate W held by the substrate holder 10, moves the developer supply nozzle 20 along a line Lb running diagonally relative to the virtual scanning direction La. In the following description, for convenience of reference to the drawings, it will be assumed that the directions of extension of the developer supply nozzle 20 and the discharge unit 22 are approximately the same, but this is not an absolute necessity.

More specifically, the first nozzle movement mechanism 30 comprises a guide rail 31, a horizontal driver 34 which is movable along the guide rail 31, and a support arm 36.

The guide rail 31 is laid in an approximately horizontal position on the side of the substrate holder 10 and on the upper surface of the apparatus body 5. The guide rail 31 extends along the diagonal line Lb. The horizontal driver 34 is configured to be reciprocally movable along the guide rail 31 by an actuator such as an air cylinder or a motor. The support arm 36 is supported in a cantilever manner by the horizontal driver 34 to extend toward the substrate holder 10. On a free end of the support arm 36, the developer supply nozzle 20 is supported in an approximately horizontal position so that the direction of extension of the discharge unit 22, i.e., the direction of extension of the developer supply nozzle 20, is substantially orthogonal to the virtual scanning direction La. The developer supply nozzle 20, while maintaining this position, passes over the substrate W.

Driven by the horizontal driver 34, the developer supply nozzle 20 is moved from one end of the substrate W to the other to pass over the major surface of the substrate W. At this time, since the guide rail 31 is diagonal to the virtual scanning direction La, the discharge unit 22 is moved while also being shifted in a direction orthogonal to the virtual scanning direction La.

The rinsing liquid supply nozzle 40 has a discharge unit 42 for discharging a rinsing liquid with a discharge width substantially equal to or greater than the width of the substrate W.

More specifically, the rinsing liquid supply nozzle 40 is identical in configuration to the developer supply nozzle 20. That is, the rinsing liquid supply nozzle 40 is configured such that the discharge unit 42 which is identical in configuration to the discharge unit 22 is formed in the lower end portion of a nozzle body 41 which is identical in configuration to the nozzle body 21.

As in the case of the developer supply nozzle 20, the ideal condition is when the discharge unit 42 discharges a rinsing liquid uniformly along the whole discharge width in the form of a curtain so that a rinsing liquid is supplied along the whole width of the substrate W.

The discharge unit 42 of the rinsing liquid supply nozzle 40 is also inclined at a predetermined angle with respect to a direction opposite to the direction of movement of the rinsing liquid supply nozzle 40 (see FIG. 3A). Thus, a rinsing liquid discharged from the discharge unit 42 flows in the direction opposite to the direction of movement of the rinsing liquid supply nozzle 40. This prevents a rinsing liquid from flowing ahead of the movement of the rinsing liquid supply nozzle 40 and also prevents a rinsing liquid from sweeping a developer on the substrate W ahead of the movement of the rinsing liquid supply nozzle 40.

The rinsing liquid supply nozzle 40 is coupled to a rinsing liquid supply system 46. The rinsing liquid supply system 46 comprises a rinsing liquid supply source for storing a rinsing liquid and an on-off valve (both not shown) and is configured to supply a rinsing liquid from the rinsing liquid supply source to the rinsing liquid supply nozzle 40 in a predetermined timed relationship with the opening and closing of the on-off valve.

The second nozzle movement mechanism 50, while keeping the direction of extension (discharge width) of the discharge unit 42, i.e., the direction of extension of the rinsing liquid supply nozzle 40, substantially perpendicular to the virtual scanning direction La of the substrate W held by the substrate holder 10, moves the rinsing liquid supply nozzle 40 along the line Lb running diagonally relative to the virtual scanning direction La.

More specifically, the second nozzle movement mechanism 50 is identical in configuration to the first nozzle movement mechanism 30 and more specifically, comprises the guide rail 31, a horizontal driver 54 corresponding to the horizontal driver 34, and a support arm 56 corresponding to the support arm 36. The guide rail 31 is shared by the first nozzle movement mechanism 30 and the second nozzle movement mechanism 50.

Driven by the horizontal driver 54, the rinsing liquid supply nozzle 40 is moved from one end of the substrate W to the other to pass over the major surface of the substrate W. At this time, since the guide rail 31 is diagonal to the virtual scanning direction La, the discharge unit 42 is moved while also being shifted in a direction orthogonal to the virtual scanning direction La.

The controller 60 is for controlling the entire apparatus. It comprises a CPU, a ROM, a RAM and the like, and is configured of a general microcomputer which performs predetermined computations by executing a previously stored software program.

This controller 60 controls a sequence of operations next to be described and performs at least an act of supplying a developer and then supplying a rinsing liquid to the substrate W.

Now, the basic operation of this developing apparatus will be described with reference to FIGS. 4 to 8.

Figure 4:
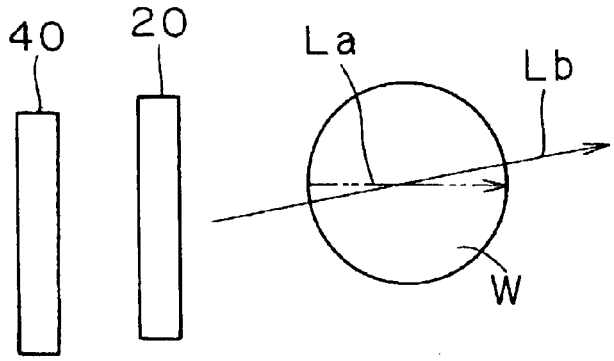
FIG. 4 is an explanatory diagram showing an initial state of the developing apparatus according to the first preferred embodiment.

First, in an initial standby state, as shown in FIG. 4, the developer supply nozzle 20 and the rinsing liquid supply nozzle 40 are positioned on one end of the substrate W (upstream of the virtual scanning direction La). During the following operation, the substrate W is supported at rest in a horizontal position.

Figure 5:
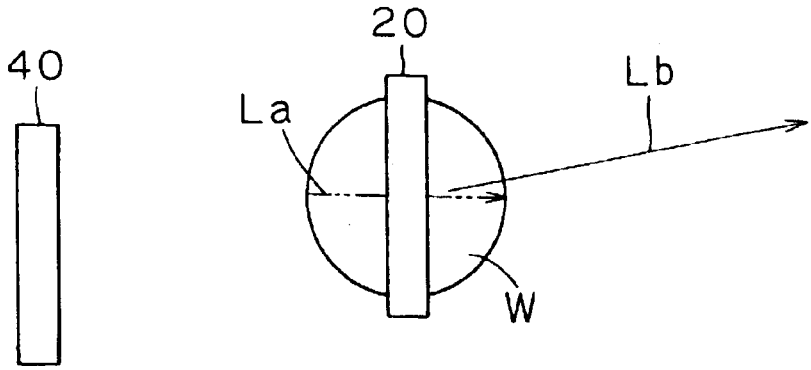
FIG. 5 is an explanatory diagram showing the developing apparatus according to the first preferred embodiment when supplying a developer.

After the initiation of processing, as shown in FIG. 5, the developer supply nozzle 20 moves from a supply start point on one end of the substrate W to a supply end point on the other end over the major surface of the substrate W. In passing over the major surface of the substrate W, the developer supply nozzle 20 discharges a developer so that a developer is supplied to the entire major surface of the substrate W. Thereby a layer of developer (developer layer DL) (see FIG. 3A) is formed on the major surface of the substrate W.

At this time, since the developer supply nozzle 20 moves along the diagonal line Lb, the discharge unit 22 is shifted in a direction substantially perpendicular to the virtual scanning direction La.

Figure 6:
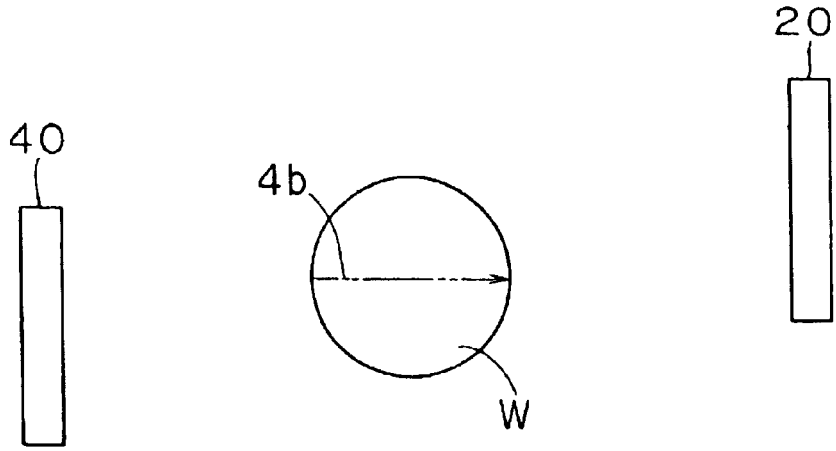
FIG. 6 is an explanatory diagram showing the developing apparatus according to the first preferred embodiment after the supply of a developer.
Figure 7:
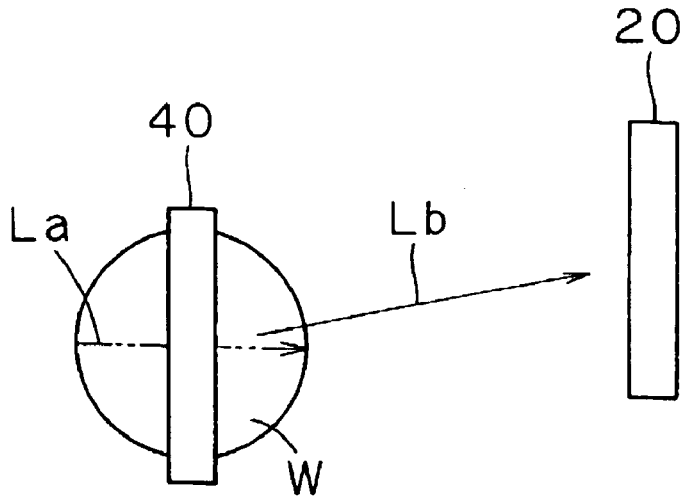
FIG. 7 is an explanatory diagram showing the developing apparatus according to the first preferred embodiment when supplying a rinsing liquid.
Figure 8:
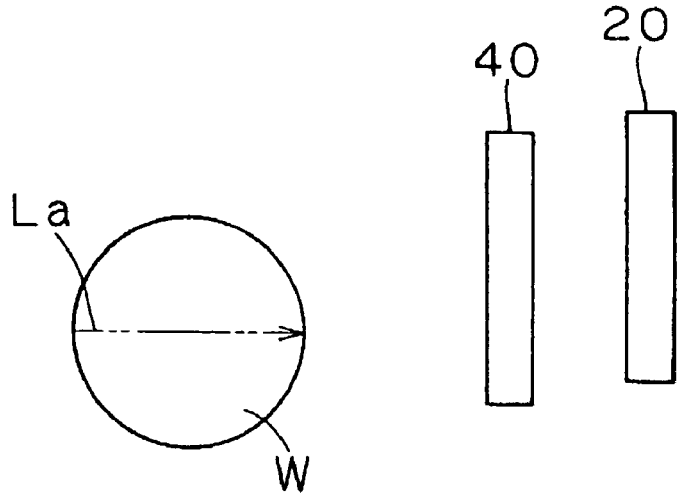
FIG. 8 is an explanatory diagram showing the developing apparatus according to the first preferred embodiment after the supply of a rinsing liquid.

After the developer supply nozzle 20 passed over the major surface of the substrate W as shown in FIG. 6 and after the elapse of a predetermined time required for development reactions on the substrate W, as shown in FIG. 7, the rinsing liquid supply nozzle 40 moves from the supply start point of the substrate W to the supply end point over the major surface of the substrate W (i.e., over the developer layer DL formed on the major surface of the substrate W). In passing over the major surface of the substrate W, the rinsing liquid supply nozzle 40 discharges a rinsing liquid toward the developer layer DL on the major surface of the substrate W so that a rinsing liquid is supplied to the entire major surface of the substrate W.

At this time, since the rinsing liquid supply nozzle 40 moves along the diagonal line Lb, the discharge unit 42 is shifted in a direction substantially perpendicular to the virtual scanning direction La. In other words, the discharge unit 42 is shifted along the width of the substrate W.

The supply of a rinsing liquid to the major surface of the substrate W stops development on the substrate W.

In this process, a rinsing liquid is supplied to the major surface of the substrate W in a similar manner to a developer (i.e., in the same direction and with the same velocity). Thus, development time is approximately the same at each point on the entire major surface of the substrate W.

Next described is an operation where, for reasons such as adhesion of undesirable matter to the discharge units 22, 42 and any possible defects resulting therefrom, a developer or a rinsing liquid is supplied nonuniformly (e.g., with different amounts and velocities) along the discharge width from the discharge unit 22 or 42.

Figure 9:
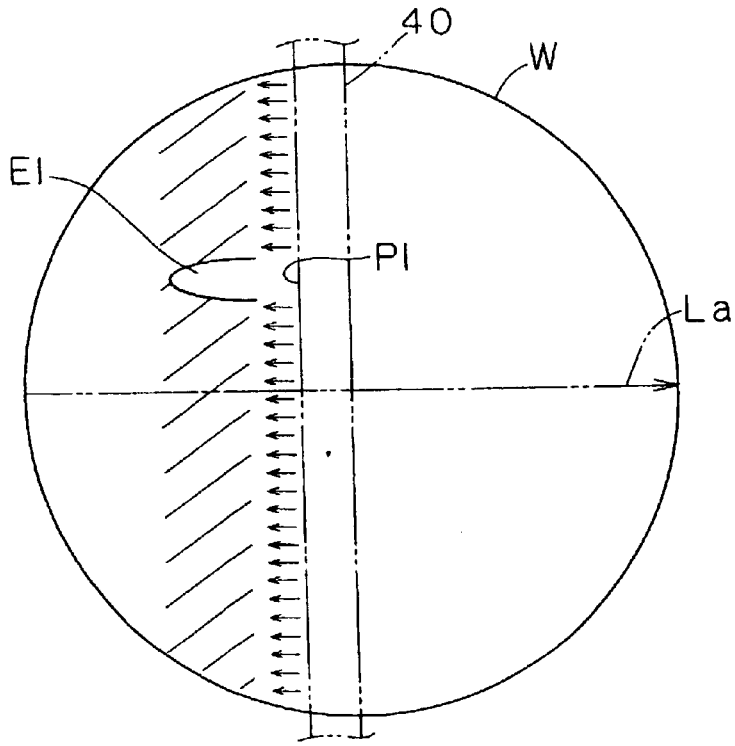
FIG. 9 is an explanatory diagram showing how the developing apparatus according to the first preferred embodiment supplies a rinsing liquid.
Figure 10:
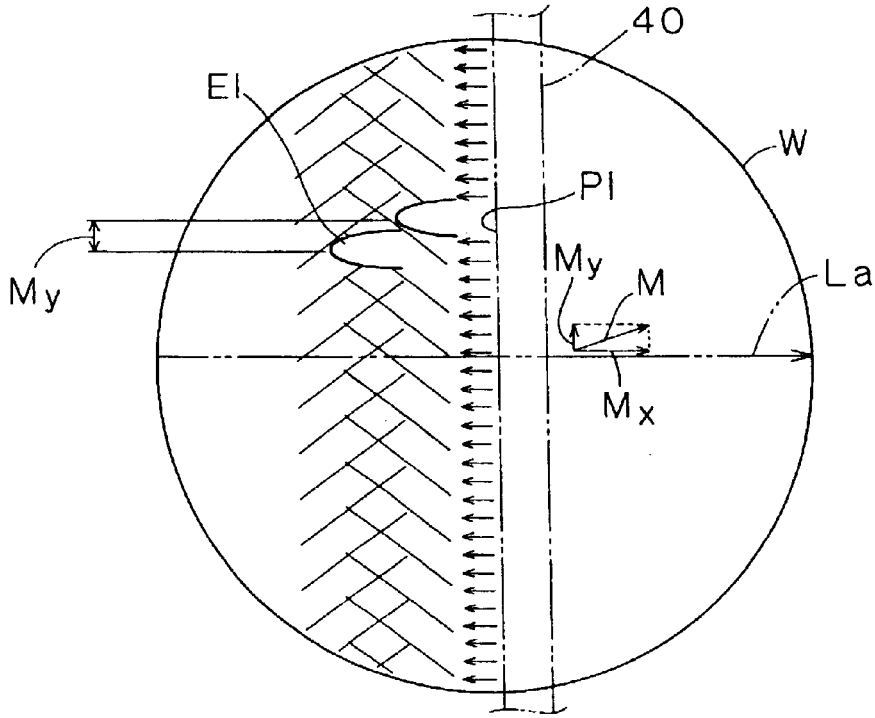
FIG. 10 is an explanatory diagram showing how the developing apparatus according to the first preferred embodiment supplies a rinsing liquid in time sequence.

FIGS. 9 and 10 show how a rinsing liquid is supplied to the substrate W if the rinsing liquid supply nozzle 40 has, in a certain part along its direction of extension, a non-supplying part P1 from which a rinsing liquid is not supplied. In FIGS. 9 and 10, an area of oblique lines which extend upwardly to the right indicates an area where a rinsing liquid was supplied at the time of FIG. 9. In FIG. 10, an area of oblique lines which extend upwardly to the left indicates an area where a rinsing liquid was supplied at the time of FIG. 10.

As shown in FIG. 9, assuming that the rinsing liquid supply nozzle 40 has moved halfway along the virtual scanning direction La of the substrate W, a streak of non-supply area E1 where a rinsing liquid was not supplied will remain on a rearward extension of the non-supplying point P1 on the substrate W.

Then, as shown in FIG. 10, the rinsing liquid supply nozzle 40 moves a distance M along the diagonal line Lb. That is, the rinsing liquid supply nozzle 40 moves a distance $M_x$ along the virtual scanning direction La and a distance $M_y$ along a direction substantially orthogonal to the virtual scanning direction La. Thus, the non-supplying part P1 of the discharge unit 42 is also moved to a position which deviates by the distance $M_y$ from the position shown in FIG. 9 along the direction substantially orthogonal to the virtual scanning direction La, and accordingly, other part of the discharge unit 42 which is capable of supplying a rinsing liquid (i.e., any part other than the non-supplying part P1) is located in a position corresponding to the non-supply area E1. In the state shown in FIG. 10, a rinsing liquid discharged from that part of the discharge unit 42 which is capable of supplying a rinsing liquid is supplied to the non-supply area E1.

These operations are performed successively with the movement of the rinsing liquid supply nozzle 40, which eliminates non-supply areas where a rinsing liquid is not supplied on the substrate W.

In a similar manner as above described, the discharge unit 22 of the developer supply nozzle 20 supplies a developer to the substrate W.

In the developing apparatus of the aforementioned configuration, when a developer and a rinsing liquid are supplied from the developer supply nozzle 20 and the rinsing liquid supply nozzle 40, the discharge units 22 and 42 are shifted in a direction substantially perpendicular to the virtual scanning direction La. This improves uniformity in the supply of processing liquids.

While in this preferred embodiment, both the developer supply nozzle 20 and the rinsing liquid supply nozzle 40 are shifted in a direction substantially perpendicular to the virtual scanning direction La, only one of them may be shifted in the direction substantially perpendicular to the virtual scanning direction La.

Second Preferred Embodiment

<A. Description of Developing Apparatus>

In this second preferred embodiment, a developing apparatus is described which, while rotating a substrate, rotates a processing liquid supply nozzle so that the nozzle passes over the substrate.

Figure 11:
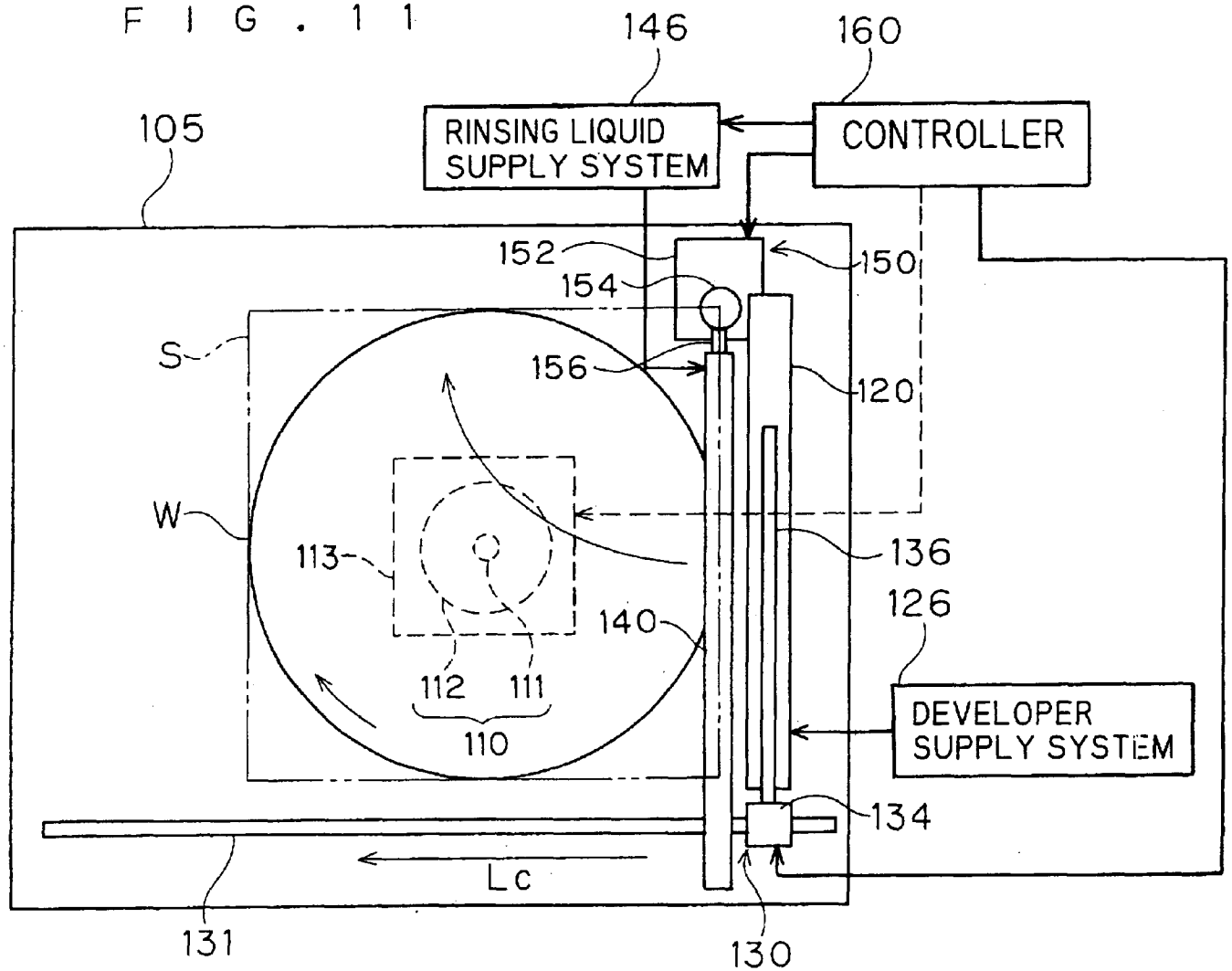
FIG. 11 is a schematic plan view showing a developing apparatus according to a second preferred embodiment of the present invention.

FIG. 11 is a plan view showing a schematic configuration of the developing apparatus according to the second preferred embodiment of the present invention.

The developing apparatus is configured to supply a developer and a rinsing liquid as processing liquids to the substrate W after being exposed for development processing. It comprises a substrate holder 110 for holding the substrate W, a developer supply nozzle 120, a first nozzle movement mechanism 130 for moving the developer supply nozzle 120, a rinsing liquid supply nozzle 140, a second nozzle movement mechanism 150 which is a rinsing liquid supply nozzle rotating section for rotating the rinsing liquid supply nozzle 140, and a controller 160 for controlling the operation of the entire apparatus.

The substrate holder 110 holds the substrate W in an approximately horizontal position.

More specifically, the substrate holder 110 comprises a support shaft 111 located in an approximately vertical position near the center of an apparatus body 105, and a support base 112 fixedly mounted on the upper end of the support shaft 111. The support base 112 is configured to be capable of holding the substrate W in an approximately horizontal position by suction. Here, it is to be noted that the support base 112 is not limited to the configuration of holding the substrate W by suction, but may be configured to, for example, grasp the peripheral portion of the substrate W.

The lower end of the support shaft 111 is coupled to a spinning motor 113 which is a substrate rotating section for rotating the substrate W. Rotation of this spinning motor 113 is transmitted through the support shaft 111 to the support base 112. Thereby, the substrate W can be rotated in a horizontal plane on a vertical axis as a rotation axis. The rotational speed of the substrate W with this spinning motor 113 is variably controllable by the controller 160 later to be described.

Around the substrate holder 110, as in the first preferred embodiment, circular cups are provided to surround the substrate W and also standby pots are provided in positions corresponding to stand-by positions of the developer supply nozzle 120 and the rinsing liquid supply nozzle 140. Those cups and pots are not shown herein.

The developer supply nozzle 120 has a discharge unit for discharging a processing liquid with a discharge width substantially equal to or greater than the width of the substrate W.

The developer supply nozzle 120 herein has the same configuration as the developer supply nozzle 20 of the aforementioned first preferred embodiment.

Also, the developer supply nozzle 120 is connected to a developer supply system 126 which is identical in configuration to the developer supply system 26 of the aforementioned first preferred embodiment, whereby a developer is supplied to the developer supply nozzle 120 in predetermined timed relation.

The first nozzle movement mechanism 130 moves the developer supply nozzle 120 along a developer scanning direction $L_c$ from one end of the apparatus body 105 to the other.

This first nozzle movement mechanism 130 comprises a guide rail 131, a horizontal driver 134 which is movable along the guide rail 131, and a support arm 136.

The guide rail 131 is laid in an approximately horizontal position from one end of the apparatus body 105 to the other, on the upper surface of the apparatus body 105 and on the side of the substrate holder 110. The horizontal driver 134, like the horizontal driver 34 of the aforementioned first preferred embodiment, is configured to be reciprocally movable along the guide rail 131. The support arm 136 supports the developer supply nozzle 120 in an approximately horizontal position so that a direction of extension of the developer supply nozzle 120 is substantially orthogonal to the developer scanning direction Lc.

Driven by the horizontal driver 134, the developer supply nozzle 120 is moved along the developer scanning direction Lc to pass over the major surface of the substrate W. In passing over the substrate W, the developer supply nozzle 120 discharges a developer from its discharge unit so that a developer is supplied onto the major surface of the substrate W.

The rinsing liquid supply nozzle 140 has a discharge unit for discharging a processing liquid with a discharge width substantially equal to or greater than the width of the substrate W.

The rinsing liquid supply nozzle 140 herein is identical in configuration to the rinsing liquid supply nozzle 40 of the aforementioned first preferred embodiment.

Also, the rinsing liquid supply nozzle 140 is connected to a rinsing liquid supply system 146 which is identical in configuration to the rinsing liquid supply system 46 of the aforementioned first preferred embodiment, whereby a rinsing liquid is supplied to the rinsing liquid supply nozzle 140 in predetermined timed relation.

The second nozzle movement mechanism 150 rotatably supports one end of the rinsing liquid supply nozzle 140 and rotates the rinsing liquid supply nozzle 140 so that the nozzle 140 passes over the substrate W.

More specifically, the second nozzle movement mechanism 150 comprises a nozzle rotary driver 152, a rotary shaft 154, and a support arm 156.

The rotary shaft 154 is freely rotatable on one vertex of a virtual square S which circumscribes the substrate W held by the substrate holder 110.

The nozzle rotary driver 152 is configured of an actuator such as a spinning motor, and the rotary shaft 154 is driven to rotate by this nozzle rotary driver 152. The rotational speed of the nozzle rotary driver 152 is variably controllable by the controller 160.

The support arm 156 is fixedly coupled at its one end to the rotary shaft 154 and is supported in a cantilever manner above the apparatus body 105. On a free end of the support arm 156, the rinsing liquid supply nozzle 140 is supported in an approximately horizontal position.

Driven by the nozzle rotary driver 152, the rinsing liquid supply nozzle 140 is rotated on a rotation axis of the rotary shaft 154 over the substrate W. In passing over the substrate W, the rinsing liquid supply nozzle 140 discharges a rinsing liquid from its discharge unit so that a rinsing liquid is supplied onto the major surface of the substrate W.

The developer supply nozzle 120 and the rinsing liquid supply nozzle 140 can be moved without interfering each other, for example by being placed at different levels.

The controller 160 is for controlling the entire apparatus and, like the controller 60, is configured of a general microcomputer.

The controller 160 controls a sequence of operations next to be described and performs at least an act of rotating the substrate W and the rinsing liquid supply nozzle 140 so that the virtual scanning direction La from the supply start point on one end of the substrate W to the supply end point on the other end is substantially perpendicular to a direction of extension of the rinsing liquid supply nozzle 140.

Now, the operation of this developing apparatus will be described with reference to FIGS. 12 to 15.

Figure 12:
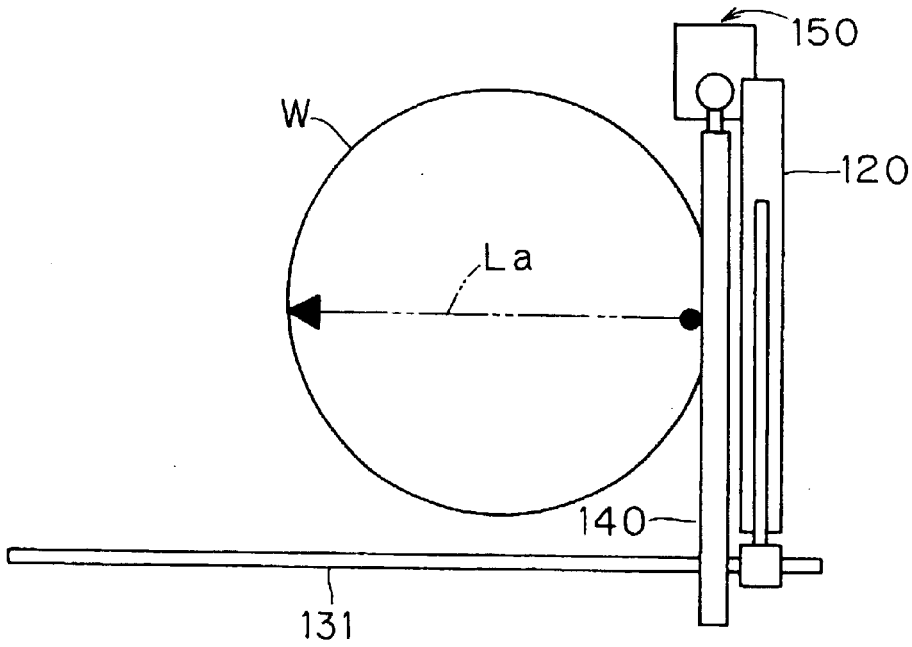
FIG. 12 is an explanatory diagram showing an initial state of the developing apparatus according to the second preferred embodiment.

First, in an initial standby state, as shown in FIG. 12, the substrate W is supported at rest in a horizontal position by the substrate holder 110. On one and the other ends of the substrate W, respectively, are the supply start point and the supply end point, and the virtual scanning direction La is a direction which is virtually set from the supply start point of the substrate W to the supply end point. In FIGS. 12 to 15, the supply start point is shown with a closed circle and the supply end point with a closed triangle, and the virtual scanning direction La is indicated by a dash-double dot line. In this initial state, the supply start point of the substrate W is on one end of the apparatus body 105 (on the right side of FIG. 12).

The developer supply nozzle 120 and the rinsing liquid supply nozzle 140 are located on one end of the apparatus body 105 (upstream of the developer scanning direction Lc). That is, in the initial state, the developer supply nozzle 120 and the rinsing liquid supply nozzle 140 face the supply start point of the initial-state substrate W.

Figure 13:
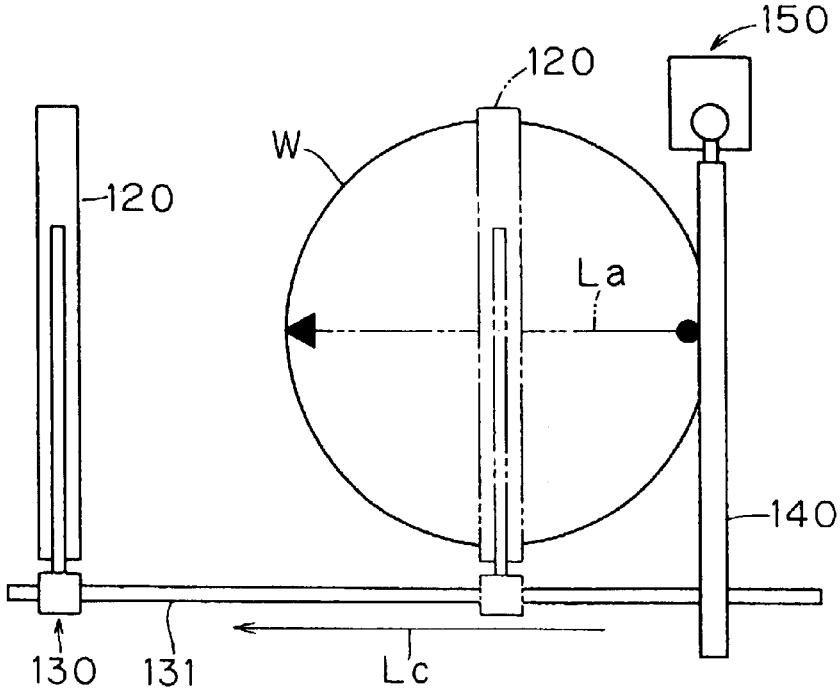
FIG. 13 is an explanatory diagram showing the developing apparatus according to the second preferred embodiment when supplying a developer.

After the initiation of processing, as shown in FIG. 13, the developer supply nozzle 120 moves along the developer scanning direction Lc over the major surface of the substrate W. At this time, the substrate W is not rotating. Thus, the developer supply nozzle 120 moves along the virtual scanning direction La over the major surface of the substrate W.

In passing over the major surface of the substrate W, the developer supply nozzle 120 discharges a developer so that a developer is supplied sequentially along the virtual scanning direction La onto the entire major surface of the substrate W.

After passing over the major surface of the substrate W, the developer supply nozzle 120 is brought to its standby state on the other end of the apparatus body 105 (downstream of the developer scanning direction Lc).

Figure 14:
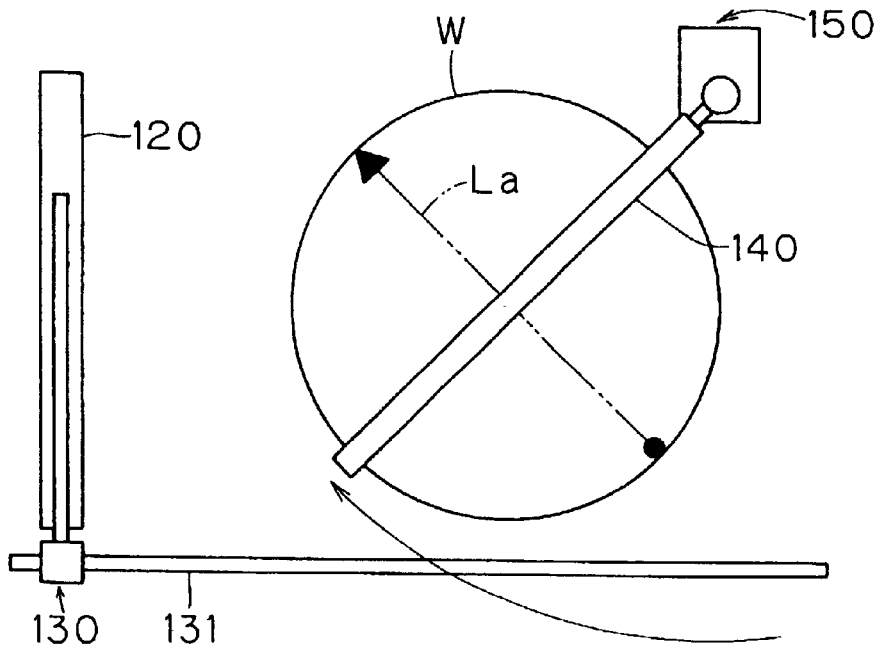
FIG. 14 is an explanatory diagram showing the developing apparatus according to the second preferred embodiment when supplying a rinsing liquid.

After the supply of a developer to the major surface of the substrate W and after the elapse of a predetermined time required for development reactions on the substrate W, as shown in FIG. 14, a rinsing liquid is supplied.

More specifically, the rinsing liquid supply nozzle 140 rotates on its rotation axis in a first rotational direction over the substrate W (i.e., over a developer layer (see FIG. 3A) on the major surface of the substrate W).

In response to the rotation of the rinsing liquid supply nozzle 140, the substrate W rotates in the first rotational direction. The rotation of the substrate W is made such that its virtual scanning direction La is substantially orthogonal to a direction of extension of the rinsing liquid supply nozzle 140. Thus, the rinsing liquid supply nozzle 140 moves along an arc in the form of a strip relative to the substrate W.

To make the virtual scanning direction La of the substrate W substantially orthogonal to the direction of extension of the rinsing liquid supply nozzle 140, the rotational speeds of the substrate W and the rinsing liquid supply nozzle 140 should be made substantially equal.

In passing over the substrate W, the rinsing liquid supply nozzle 140 discharges a rinsing liquid so that a rinsing liquid is supplied to the major surface of the substrate W. At this time, since the direction of extension of the rinsing liquid supply nozzle 140 and the virtual scanning direction La of the substrate W are substantially orthogonal to each other, the timing of the supply of a rinsing liquid is approximately the same at each point along a direction substantially perpendicular to the virtual scanning direction La.

Figure 15:
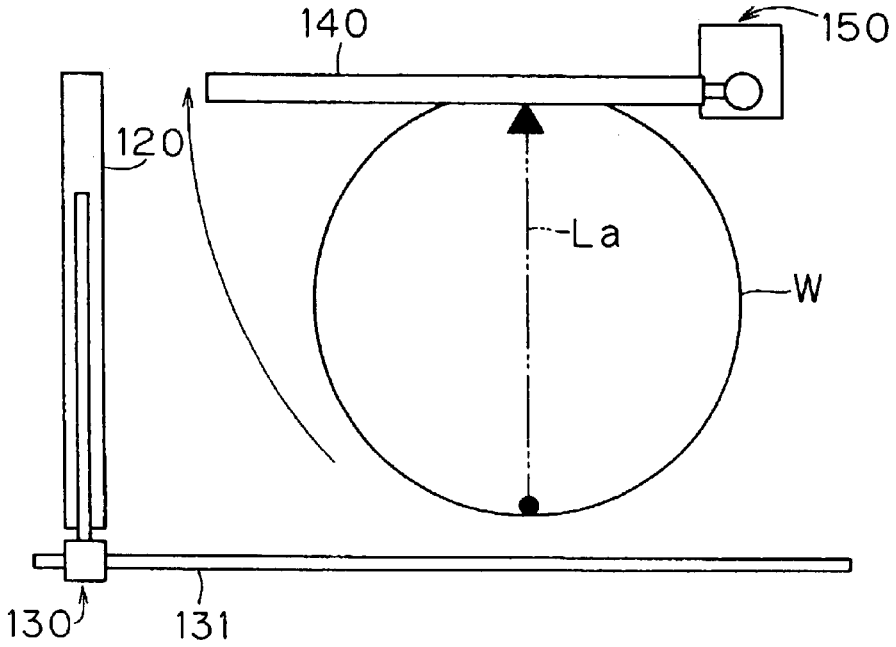
FIG. 15 is an explanatory diagram showing the developing apparatus according to the second preferred embodiment after the supply of a rinsing liquid.

After the rinsing liquid supply nozzle 140 passed over the substrate W as shown in FIG. 15, the rinsing liquid supply nozzle 140 and the substrate W stop their rotation. In the present example, the substrate W and the rinsing liquid supply nozzle 140 stop rotating after rotation of $\pi/2$ radians.

The supply of a rinsing liquid to the major surface of the substrate W in this way stops development on the substrate W.

Accordingly, a rinsing liquid is supplied in the same direction as a developer to the major surface of the substrate W, which allows the development time to be the same as precisely as possible at each point on the entire major surface of the substrate W.

Now, the movements of the developer supply nozzle 120 and the rinsing liquid supply nozzle 140 with respect to the substrate W will be described.

Figure 16:
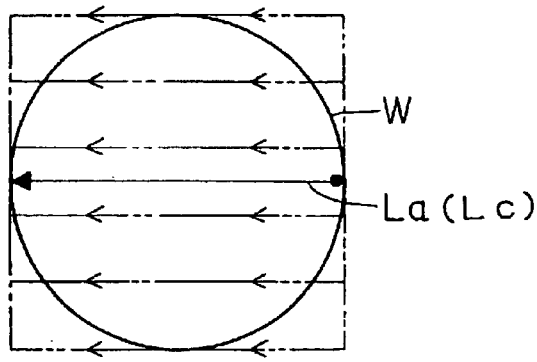
FIG. 16 is an explanatory diagram showing the path of movement of a developer supply nozzle with respect to a substrate.
Figure 17:
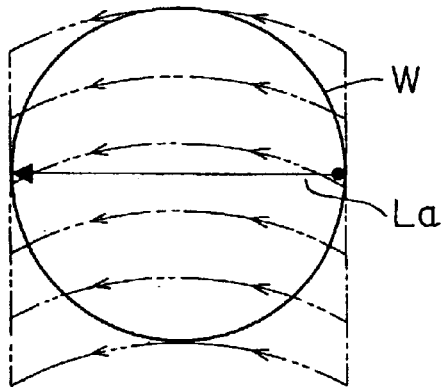
FIG. 17 is an explanatory diagram showing the path of movement of a rinsing liquid supply nozzle with respect to a substrate.

FIG. 16 is an explanatory diagram showing the path of movement of the developer supply nozzle 120 relative to the substrate W, and FIG. 17 is an explanatory diagram showing the path of movement of the rinsing liquid supply nozzle 140 relative to the substrate W when the substrate W and the rinsing liquid supply nozzle 140 are rotated such that the direction of extension of the rinsing liquid supply nozzle 140 is substantially orthogonal to the virtual scanning direction La of the substrate W.

As shown in FIG. 16, the developer supply nozzle 120 moves linearly along the virtual scanning direction La of the substrate W, which is approximately the same as the developer scanning direction Lc at this time. On the other hand, the rinsing liquid supply nozzle 140 describes a different path of movement from the developer supply nozzle 120. As shown in FIG. 17, the rinsing liquid supply nozzle 140 moves nonlinearly along the virtual scanning direction La of the substrate W, i.e., moves along an arc.

Figure 18:
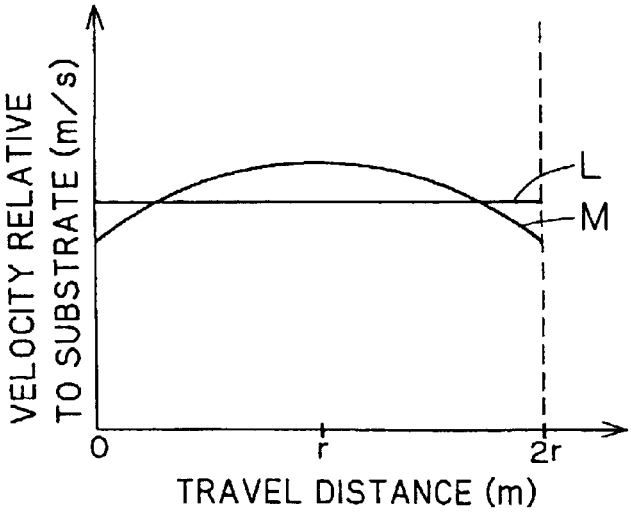
FIG. 18 is a diagram showing the relationship between travel distances and relative velocities of the developer supply nozzle and the rinsing liquid supply nozzle with respect to a substrate.

FIG. 18 is a diagram showing the relationship between travel distances and relative travel speeds of the developer supply nozzle 120 and the rinsing liquid supply nozzle 140 with respect to the substrate W, in which the straight line L indicates the relative travel speed of the developer supply nozzle 120 and the curve M indicates the relative travel speed of the rinsing liquid supply nozzle 140. The vertical axis of FIG. 18 indicates a relative velocity component with respect to the substrate W in the virtual scanning direction La of the substrate W. The relative travel speed of the rinsing liquid supply nozzle 140 shows variation when the substrate W and the rinsing liquid supply nozzle 140 are rotated with substantially the same constant rotational speed. In FIG. 18, values r and 2r represent a radius and a diameter of the substrate W, respectively.

As shown in this drawing, the developer supply nozzle 120 moves in the virtual scanning direction La of the substrate W to describe a constant velocity pattern. On the other hand, the rinsing liquid supply nozzle 140 moves in a different velocity pattern from that of the developer supply nozzle 120. More specifically, the rinsing liquid supply nozzle 140 moves in such a velocity pattern that its relative velocity with respect to the substrate W is gradually increased until the center of the substrate W is reached and thereafter reduced gradually; that is, the rinsing liquid supply nozzle 140 moves in a velocity pattern to describe an arc.

In the developing apparatus of the above configuration, since the rinsing liquid supply nozzle 140 rotates on a rotation axis located on its one end to pass over the substrate W, its discharge unit is moved along an arc in the form of a strip relative to the substrate W while also being shifted in a direction orthogonal to the virtual scanning direction La. This improves uniformity in the supply of a rinsing liquid.

Since the direction of extension of the rinsing liquid supply nozzle 140 is substantially perpendicular to the virtual scanning direction La, the timing of the supply of a rinsing liquid can be made approximately the same at each point along a direction substantially perpendicular to the virtual scanning direction La.

Further, the second nozzle movement mechanism 150 for rotating the rinsing liquid supply nozzle 140 is a rotary drive mechanism, which is more compact in size than a horizontal drive mechanism. This also contributes to a reduction in the size of the whole apparatus.

Furthermore, rotating the substrate W during the supply of a rinsing liquid can also achieve the effect of, by centrifugal force, conducting undesirable matter (e.g., particles) produced by development reactions to the outside of the substrate W with efficiency.

The rotation axis of the rinsing liquid supply nozzle 140 does not necessarily have to be located at one vertex of a virtual square S circumscribing the substrate W.

Figure 19:
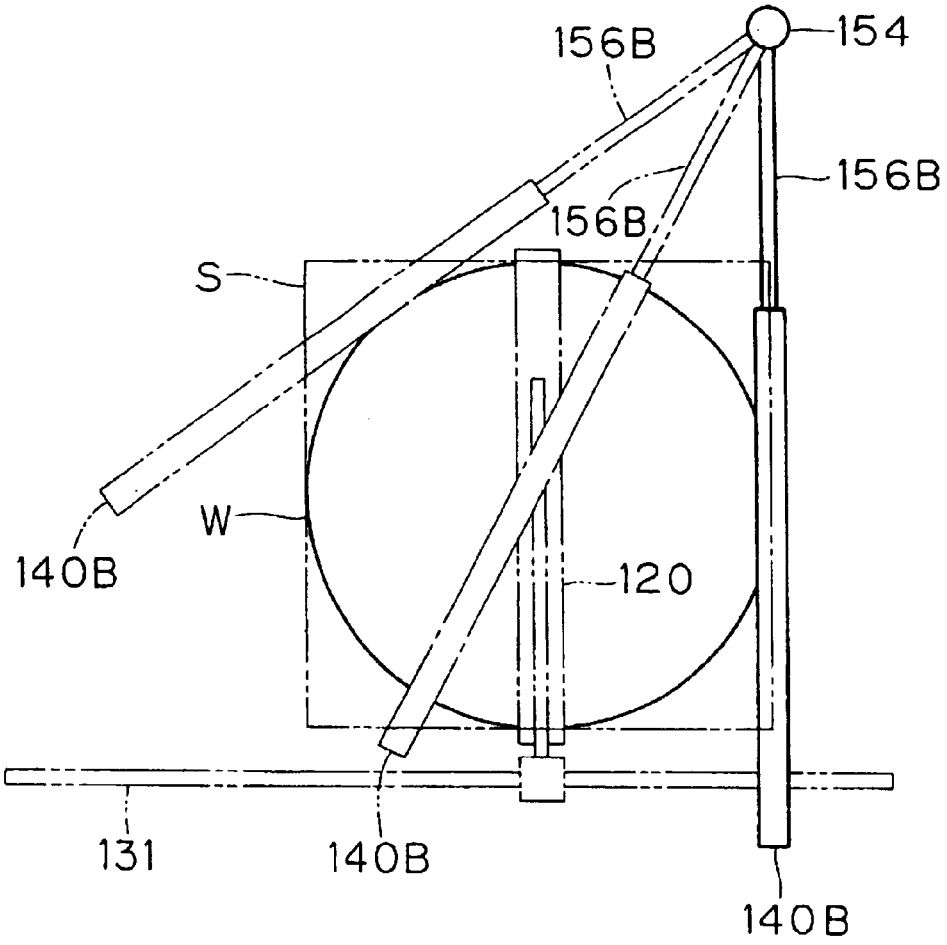
FIG. 19 is an explanatory diagram showing a modification in the location of a rotation axis of the rinsing liquid supply nozzle.

For example, as shown in FIG. 19, the rotation axis of a rinsing liquid supply nozzle 140B may be located outside the virtual square S.

In this case, a support arm 156B (corresponding to the support arm 156) should be elongated so that the rinsing liquid supply nozzle 140B (corresponding to the rinsing liquid supply nozzle 140) can pass over the substrate W.

Or, the rotation axes of the rinsing liquid supply nozzles 140 and 140B may be located inside the virtual square S.

In a word, the rotation axes of the rinsing liquid supply nozzles 140 and 140B only need to be located outside the substrate W.

To make the timing of termination of the development approximately the same at each point in the plane of the substrate W, it is preferable that a developer supply time during which the developer supply nozzle 120 discharges a developer from the supply start point of the substrate W to the supply end point be substantially equal to a rinsing liquid supply time during which the rinsing liquid supply nozzle 140 discharges a rinsing liquid from the supply start point of the substrate W to the supply end point.

Also, in order to equate the amount of the supply of a rinsing liquid at each point along the virtual scanning direction La of the substrate W, it is preferable that, out of relative velocity components of the rinsing liquid supply nozzle 140 with respect to the substrate W, a relative velocity component in the virtual scanning direction La be made constant. For this, for example in a rotating coordinate system based on the substrate W being rotated, the relations between the relative velocity of the rinsing liquid supply nozzle 140 and the rotational speeds of the rinsing liquid supply nozzle 140 and the substrate W should be obtained, and then, the rotational speeds of the rinsing liquid supply nozzle 140 and the substrate W should be controlled so as to make constant the above relative velocity component in the virtual scanning direction La.

This makes the discharge of a rinsing liquid along the virtual scanning direction La as uniform as possible.

The above-described relationships between the respective rotational speeds and between the developer supply time and the rinsing liquid supply time are also applicable to each of the other preferred embodiments later to be described.

<B. Discharge of Rinsing Liquid>

A description will now be made of a preferred form of the discharge of a rinsing liquid in the developing apparatus according to the second preferred embodiment.

Figure 20:
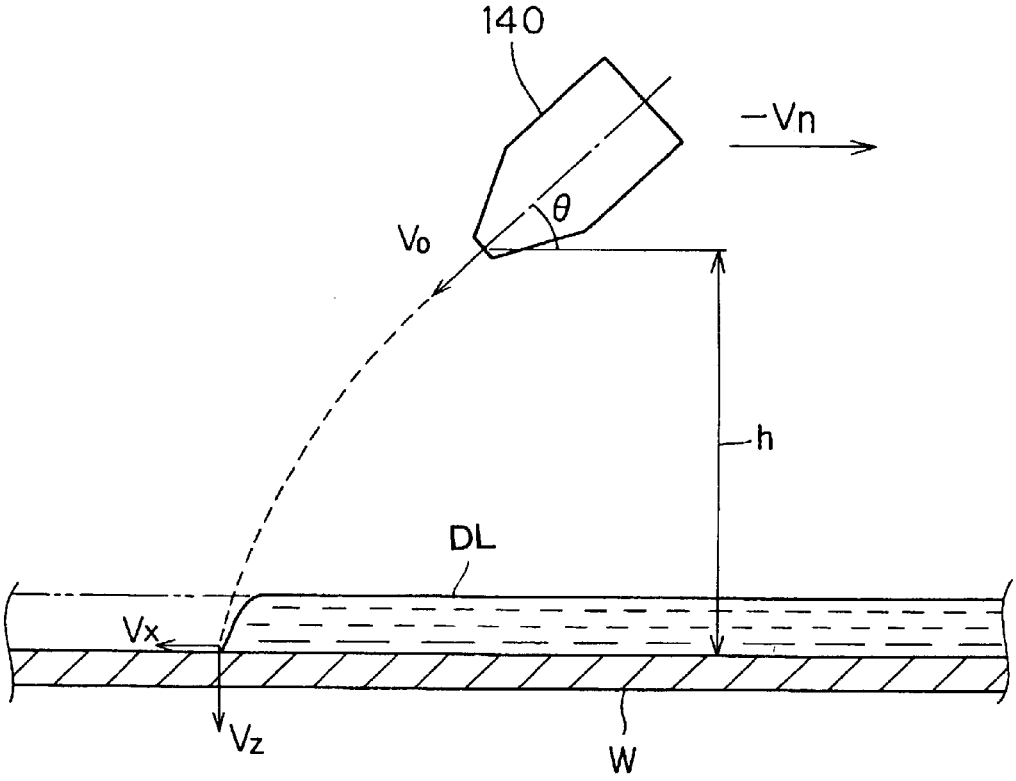
FIG. 20 is an explanatory diagram showing how a rinsing liquid discharged from the rinsing liquid supply nozzle drops onto a substrate.

FIG. 20 is an explanatory diagram showing how a rinsing liquid discharged from the discharge unit of the rinsing liquid supply nozzle 140 drops onto a developer layer DL formed on the substrate W. A rinsing liquid is discharged from the discharge unit of the rinsing liquid supply nozzle 140 in a direction opposite to the direction of movement of the rinsing liquid supply nozzle 140 relative to the substrate W.

First of all, let $V_0$ be the initial velocity of a rinsing liquid discharged from the discharge unit of the rinsing liquid supply nozzle 140, θ be the angle of discharge of a rinsing liquid with respect to the plane of the substrate W ($0 \leqq \theta < \pi/4$), and h be the height from the major (upper) surface of the substrate W to the discharge unit of the rinsing liquid supply nozzle 140.

Of relative velocity components of the rinsing liquid supply nozzle 140 when moving relative to the substrate W, a relative velocity component along the direction of discharge of a rinsing liquid is defined as $(-V_n)$, where the direction of discharge of a rinsing liquid is assumed to be a positive direction, i.e., $V_n>0$. In the second preferred embodiment, the rinsing liquid supply nozzle 140, while moving along an arc in the form of a strip relative to the substrate W, discharges a rinsing liquid in a direction opposite to the virtual scanning direction La. Thus, out of the relative velocity components of the rinsing liquid supply nozzle 140 when moving relative to the substrate W, a relative velocity component in a direction opposite to the direction of movement of the nozzle 140 along the virtual scanning direction La of the substrate W corresponds to the above relative velocity component $(-V_n)$. Since, in this second preferred embodiment, the substrate W is also rotated, the relative velocity component $(-V_n)$ of the rinsing liquid supply nozzle 140 when moving relative to the substrate W is calculated based on the rotational speeds of the substrate W and the nozzle 140.

At the time when a rinsing liquid discharged from the discharge unit of the rinsing liquid supply nozzle 140 drops onto the developer layer DL on the substrate W, relative velocity components of a rinsing liquid with respect to the substrate W include a relative velocity component $V_x$ in the direction of discharge of a rinsing liquid along a direction of the plane of the substrate W. In this second preferred embodiment, the direction of the relative velocity component $V_x$ is opposite from the virtual scanning direction La of the substrate W. A relative velocity component of a rinsing liquid in a vertically downward direction with respect to the substrate W is defined as $V_z$.

In this case, the relative velocity components $V_x$ and $V_z$ can be expressed as:

$$V_x = V_0 \cdot \cos\theta - V_n$$

$$V_z = V_0 \cdot \sin\theta + g \cdot t$$

where g is the gravitational acceleration, t is the time interval from when a rinsing liquid is discharged from the discharge unit of the rinsing liquid supply nozzle 140 to when the rinsing liquid drops onto the developer layer DL on the substrate W, and $h = V_0 \cdot t \cdot \sin\theta + 1/2 \cdot g \cdot t^2$.

For the discharge of a rinsing liquid, it is preferable that, at the time when a rinsing liquid drops onto the developer layer DL, out of the relative velocity components of a rinsing liquid with respect to the substrate W, the relative velocity component $V_x$ in the direction of discharge of a rinsing liquid with respect to the plane of the substrate W be set to be greater than 0. That is, it is preferable to satisfy $V_x = V_0 \cdot \cos\theta - V_n > 0$.

This prevents the occurrence of such situations that a rinsing liquid is swept in front of the rinsing liquid supply nozzle 140 and also resolves a difference in development time at each point on the substrate W with great precision. Thereby, after development, uniformity in the line width of a resist pattern at each point on the substrate W can be improved.

More preferably, at the time when a rinsing liquid drops onto the developer layer DL, out of the relative velocity components of a rinsing liquid with respect to the substrate W, the relative velocity component $V_x$ in the direction of discharge of a rinsing liquid with respect to the plane of the substrate W is set to be substantially equal to or greater than the relative velocity component $V_z$ in the vertically downward direction with respect to the substrate W. That is, $V_x \geqq V_z$.

This prevents the occurrence of such situations that a rinsing liquid is swept in front of the rinsing liquid supply nozzle 140, with more reliably and also resolves a difference in development time at each point on the substrate W with greater precision.

The setting of those relative velocity components $V_x$ and $V_z$ can be made, for example by adjusting and setting, for example, the initial velocity V of a rinsing liquid, the relative velocity component of the rinsing liquid supply nozzle 140 ($-V_n$) (i.e., the rotational speeds of the nozzle 140 and the substrate W), the height h of the rinsing liquid supply nozzle 140, and the angle θ of discharge of a rinsing liquid.

Even if the values are within the above prescribed range, the dimensions of, for example, a resist pattern at each point on the substrate W may vary depending on the type of the resist, the scanning speed of the nozzle 140, the flow rate, and the like. Thus, it is preferable to previously obtain optimum set values by experiment or the like. In the second preferred embodiment, the height of the major surface of the substrate W and the height of the surface of the developer layer DL are shown to be approximately the same. More specifically, in consideration of the thickness of the developer layer DL, defining the height from the major surface of the substrate W to the discharge unit of the rinsing liquid supply nozzle 140 as the height h, the relative velocity component of the rinsing liquid may be determined at the position higher than the major surface of the substrate W by the thickness of the developer layer DL.

The discharge of a rinsing liquid in this form is applicable not only to the second preferred embodiment but also in a similar manner to the aforementioned first preferred embodiment and each of the other preferred embodiments later to be described.

<Third Preferred Embodiment>

<A. Description of Developing Apparatus>

A description will now be made of a developing apparatus according to a third preferred embodiment of the present invention.

Figure 21:
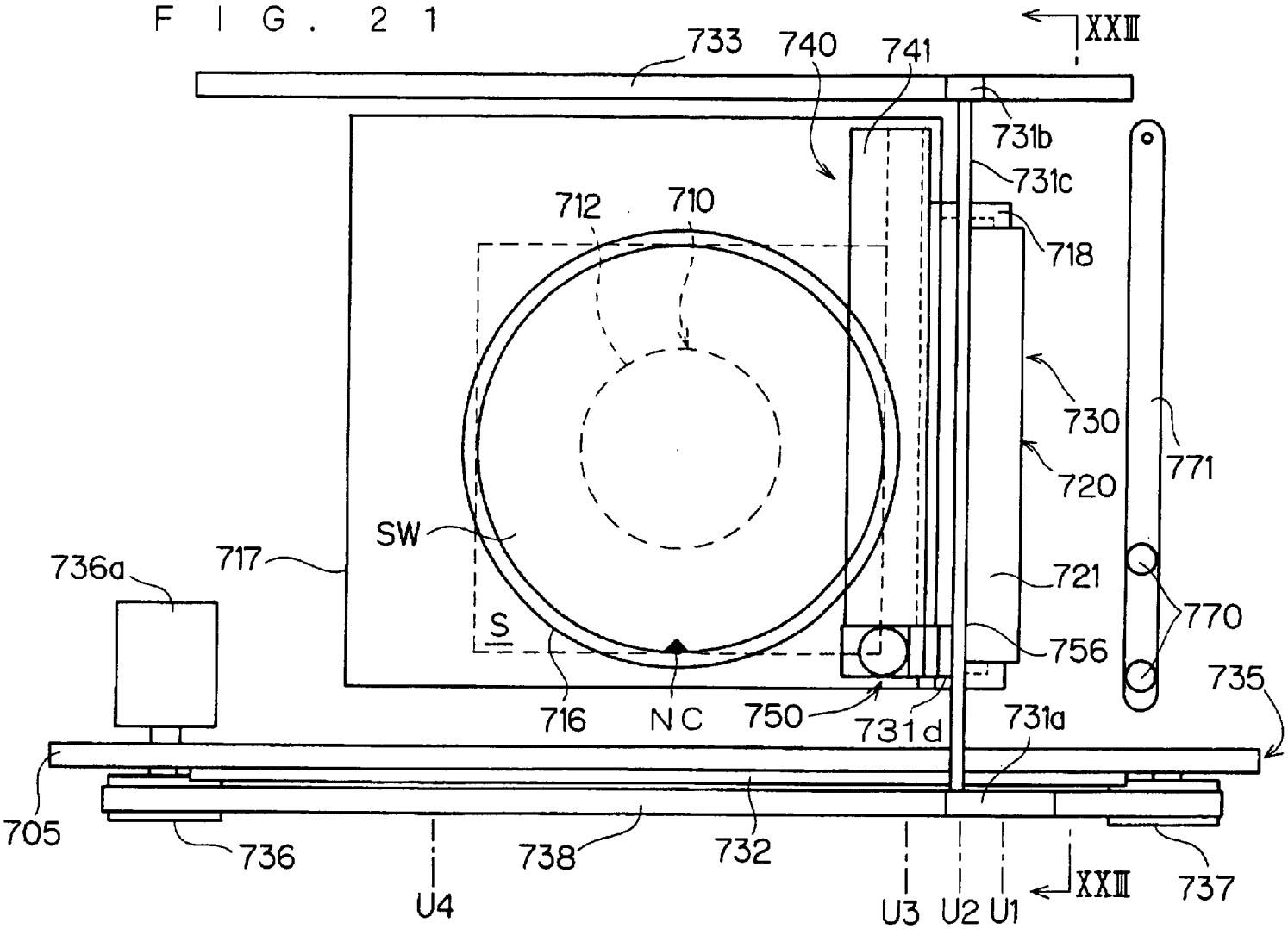
FIG. 21 is a plan view showing a schematic configuration of a developing apparatus.
Figure 22:
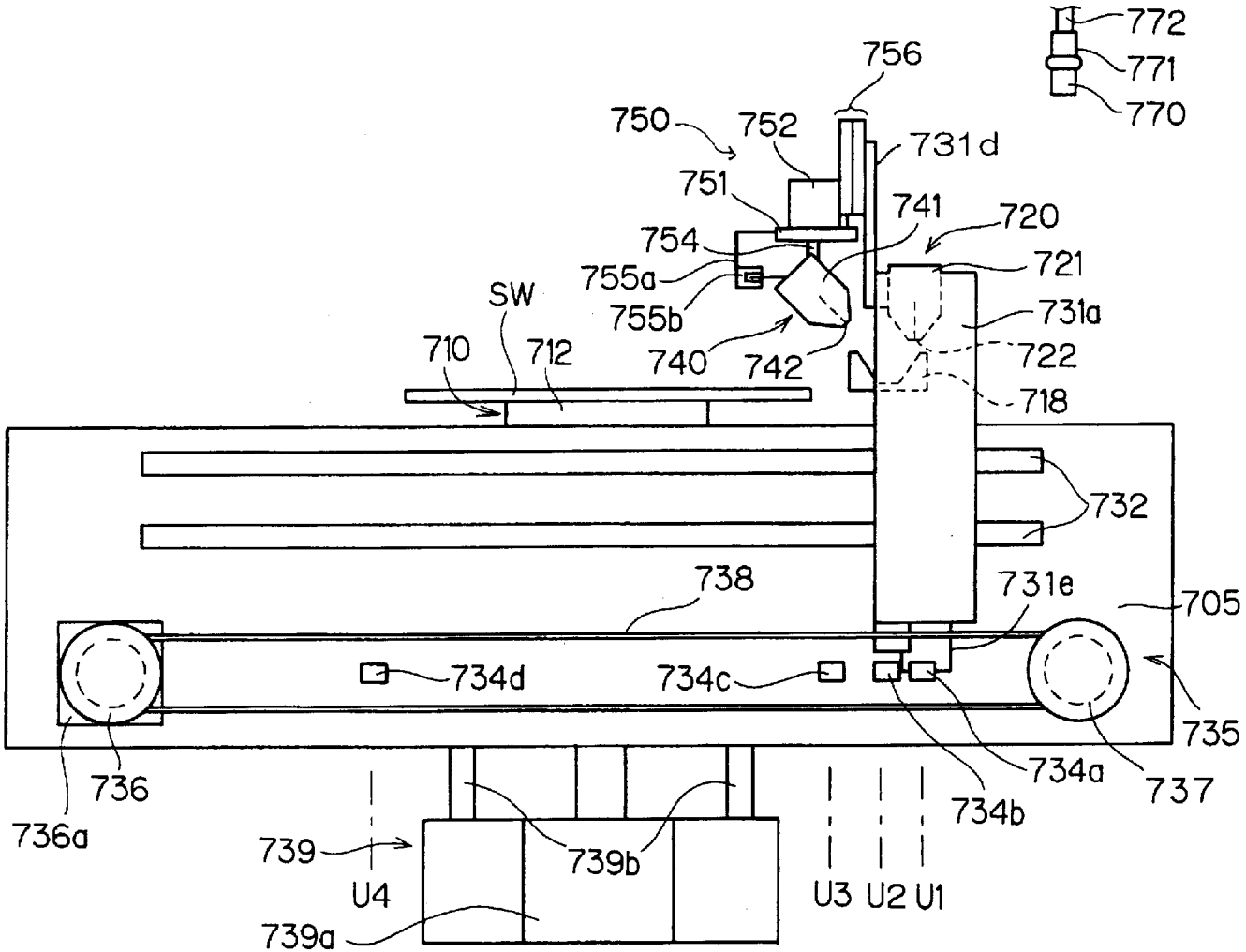
FIG. 22 is a side view showing a schematic configuration of the developing apparatus.
Figure 23:
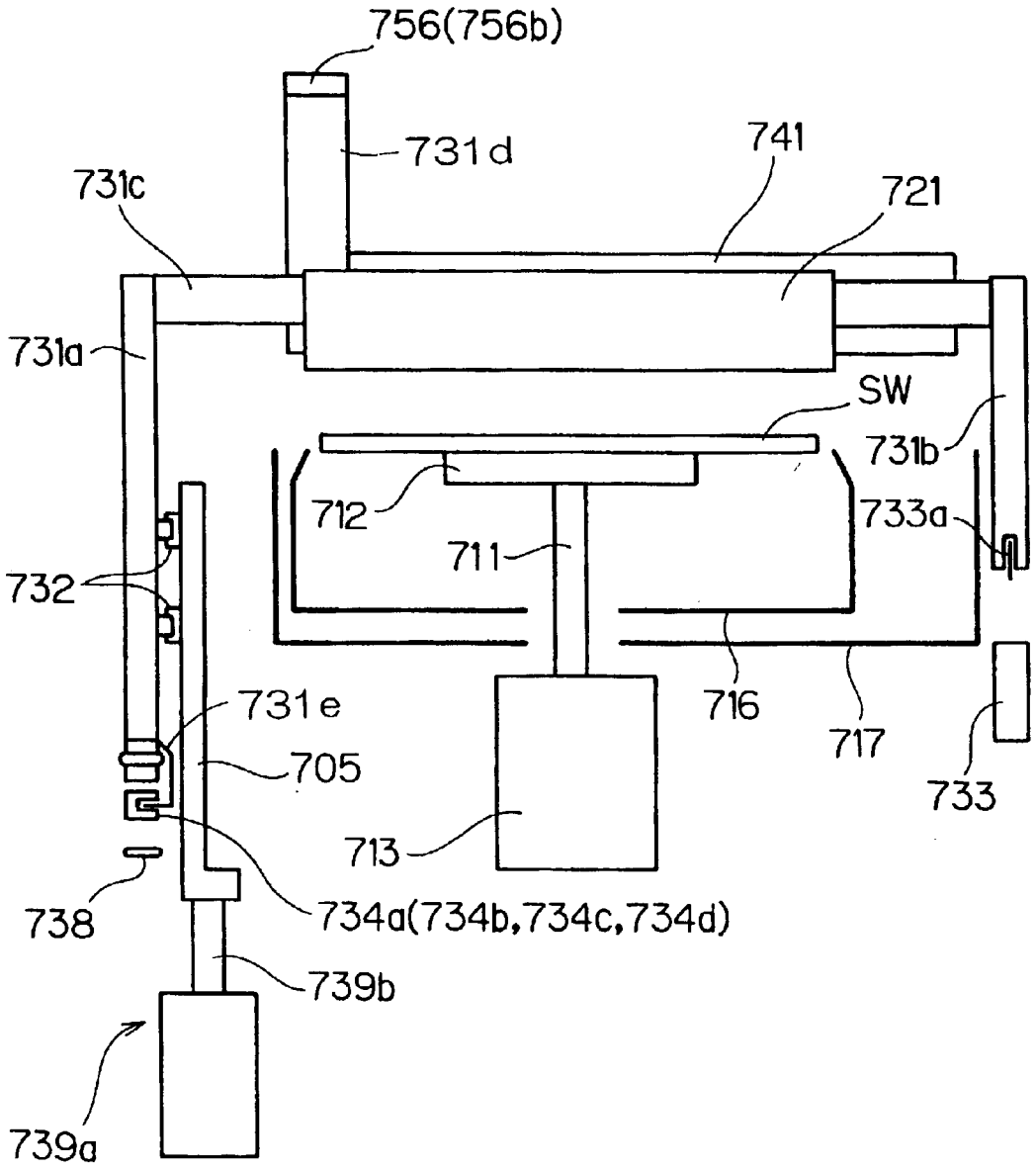
FIG. 23 is a cross-sectional view taken along the line XXIII—XXIII of FIG. 21.

FIGS. 21 and 22, respectively, are plan and side views showing a schematic configuration of the developing apparatus, and FIG. 23 is a cross-sectional view taken along the line XXIII—XXIII of FIG. 21. In FIG. 23, a portion where a substrate is held is also shown in cross section.

This developing apparatus is configured to develop a thin resist film which is formed on the surface of a semiconductor wafer SW as a substrate. Prior to development processing by this apparatus, a predetermined pattern is exposed onto the thin resist film by an exposure apparatus.

More specifically, this developing apparatus may, for example, be disposed as a development unit in a substrate processing apparatus disclosed in U.S. Pat. No. 6,051,101. It is, however, to be understood that the form of installation of the developing apparatus of this preferred embodiment in another developing apparatus is not limited to the particular form disclosed in the above U.S. patent. In fact, it is, for example, possible that, by replacing a coating unit in the substrate processing apparatus of the above U.S. patent with the developing apparatus of this preferred embodiment, the substrate processing apparatus of the U.S. patent may be configured as a developing apparatus for performing only development processing.

A semiconductor wafer SW to be processed is formed in substantially a circular disk shape. The diameter of the semiconductor wafer SW is, for example, 200 or 300 mm. The semiconductor wafer SW has a notch NC or an orientation flat formed in part of its outer peripheral edge.

This developing apparatus comprises a wafer holding and rotation mechanism 710, a developer supply nozzle 720, a developer supply system (see FIG. 26), a developer supply nozzle scan mechanism 730, a developer supply nozzle up-and-down mechanism 739, a rinsing liquid supply nozzle 740, a rinsing liquid supply system (see FIG. 27), a rinsing liquid supply nozzle rotation mechanism 750, a rinsing liquid supply nozzle up-and-down mechanism 756, and a final rinsing liquid supply nozzle 770.

The wafer holding and rotation mechanism 710 is a mechanism for holding and rotating the semiconductor wafer SW and comprises a support shaft 711, a spin chuck 712 provided on the upper end of the support shaft 711, and a spinning motor 713 having a rotation axis coupled to the lower end of the support shaft 711.

The spin chuck 712 is configured to hold the semiconductor wafer SW in an approximately horizontal position and consists of a vacuum chuck for holding the semiconductor wafer SW by suction. Alternatively, a mechanical chuck for grasping and holding the outer peripheral edge of the semiconductor wafer SW may be used as the spin shuck 712.

The spinning motor 713 consists for example of a servo motor and is configured to be capable of variably controlling the rotational speed and the amount of rotation in response to a signal (such as a pulse signal) given from a controller 760 later to be described. Rotation of this spinning motor 713 is transmitted through the support shaft 711 to the spin shuck 712. Rotatably driven by this spinning motor 713, the semiconductor wafer SW can be rotated in a horizontal plane on a vertical axis as a rotation axis.

Around the spin chuck 712, an inner cup 716 of a generally circular shape in plan view is provided to surround the semiconductor wafer SW held by the spin chuck 712. The inner cup 716 becomes narrower toward its upper end to form an upper opening. By an up-and-down mechanism (not shown) such as an air cylinder, the inner cup 716 is vertically movable between its upward position at which its upper opening edge is positioned to surround the outer periphery of the semiconductor wafer SW, and its downward position which is at a lower level than the upward position.

Also, an outer cup 717 of a generally square shape in plan view is provided to surround the inner cup 716. When the developer supply nozzle 720 or the rinsing liquid supply nozzle 740 discharges a developer or a rinsing liquid onto the semiconductor wafer SW, a developer or a rinsing liquid which is supplied and falls off the edge of the semiconductor wafer SW is conducted along the outer surface of the inner cup 716 or along a path between the inner cup 716 and the outer cup 717 to the bottom of the outer cup 717.

A standby pot 718 is provided in a position corresponding to a stand-by position of the developer supply nozzle 720, on one side of and outside the outer cup 717. The standby pot 718 is formed in the shape of a casing having an upper opening in which the developer supply nozzle 720 can be accommodated from above.

The developer supply nozzle 720 has a discharge unit 722 for discharging a developer with a discharge width substantially equal to or greater than the width (diameter) of the semiconductor wafer SW.

In the present example, the developer supply nozzle 720 has the slit discharge unit 722 formed on one end side of a long length of nozzle body 721. The discharge unit 722 extends along the length of the nozzle body 721. This discharge unit 722 is configured to discharge a developer in the form of a uniform curtain along the whole discharge width so that a developer can be supplied along the whole width of the semiconductor wafer SW.

The developer supply nozzle 720 is coupled to the developer supply system which will be described later.

The developer supply nozzle scan mechanism 730 is a mechanism for moving the developer supply nozzle 720 along a horizontal direction so that the nozzle 720 passes over the semiconductor wafer SW. It comprises a pair of support side plates 731*a* and 731*b* which are horizontally movably, and a horizontal driver 735 for horizontally reciprocating the support side plate 731*a* on one side.

The support side plate 731*a* on one side is formed in the shape of a long plate. With an upper portion of the support side plate 731*a* extending beyond the support 705, a lower portion of the support side plate 731*a* is horizontally movably supported by two linear guides 732 provided on one outer sidewall surface of the support 705.

The horizontal driver 735 comprises a drive pulley 736 and an idler pulley 737 which are provided on both sides of one sidewall surface of the support 705, a developer supply nozzle scanning motor 736*a* for rotating the drive pulley 736, and a belt 738 stretched between the pulleys 736 and 737. The lower end of the support side plate 731*a* is secured above an upper portion of the belt 738 running around the pulleys 736 and 737. By driving and rotating the drive pulley 736 with the developer supply nozzle scanning motor 736*a*, the belt 738 is rotated, in response to which the support side plate 731*a* is horizontally reciprocated on one side of the support 705. The developer supply nozzle scanning motor 736*a* consists for example of a stepping motor and is configured to be capable of controlling the amount of rotation and the rotational speed in both forward and backward directions in response to a signal (such as a pulse signal) given from the controller 760.

On one outer sidewall surface of the support 705, a plurality of position sensors 734*a*, 734*b*, 734*c* and 734*d* are provided to detect the position of the moving developer supply nozzle 720 by detecting the position of the moving support side plate 731*a*. In order from the right side of FIG. 22, there are the position sensor 734*a* for detecting a rinsing liquid supply position U1, the position sensor 734*b* for detecting a stand-by position U2, the position sensor 734*c* for detecting a developer discharge start position U3, and the position sensor 734*d* for detecting a developer discharge stop position U4. A sector 731*e* provided with the support side plate 731*a* is inserted into each of the sensors 734*a*, 734*b*, 734*c* and 734*d*, by which each of the positions U1, U2, U3 and U4 can be detected.

The support side plate 731*b* on the other side is formed in the shape of a long plate. A guide rail 733 is secured to a support other than the support 705. With an upper portion of the support side plate 731*b* extending beyond the support 705, a lower end portion of the support side plate 731*b* is supported so as to be reciprocally movable in a horizontal direction through a cam follower 733*a* along the guide rail 733. With the developer supply nozzle 720 in its upward position, the cam follower 733*a* and the guide rail 733 are spaced apart from each other.

The developer supply nozzle 720 is fixedly supported to bridge a gap between the upper end portions of both the support side plates 731*a* and 731*b*. The developer supply nozzle 720 is held in an approximately horizontal position with its discharge unit 722 facing in a downward direction, i.e., in a position to discharge a developer almost directly downward. Also a lateral rod 731*c* for reinforcement is provided on one side of the developer supply nozzle 720 to bridge a gap between the upper end portions of both the support side plates 731*a* and 731*b*. Preferably, those support side plates 731*a*, 731*b* and the lateral rod 731*c* are integrally formed by, for example, cast molding. Driven by the developer supply nozzle scanning mechanism 730, the developer supply nozzle 720 can pass over the semiconductor wafer SW. In passing over the semiconductor wafer SW, the developer supply nozzle 720 discharges a developer from its discharge unit 722 so that a developer is supplied to the major surface of the semiconductor wafer SW.

Alternatively, the configuration may be such that the developer supply nozzle 720 is supported in a cantilever manner without provision of the support side plate 731*b* on the other side and the guide rail 733 for supporting the side plate 731*b*.

The developer supply nozzle up-and-down mechanism 739 is a mechanism for vertically moving the developer supply nozzle 720 between a position where the developer supply nozzle 720 can pass over the semiconductor wafer SW and a position which is at a lower level than the above position and at which the developer supply nozzle 720 can be housed in the standby pot 718. The developer supply nozzle up-and-down mechanism 739 comprises an air cylinder 739*a* and developer supply nozzle up-and-down guides 739*b*.

The developer supply nozzle up-and-down guides 739*b* vertically movably guide the support 705, and the air cylinder 739*a* vertically moves the support 705. Vertical movement of the support 705 results in vertical movement of the respective components attached to the support 705, namely the developer supply nozzle 720, the developer supply nozzle scanning mechanism 730, the rinsing liquid supply nozzle 740 and the rinsing liquid supply nozzle rotation mechanism 750. Here, the wafer holding and rotation mechanism 710, the inner cup 716, the outer cup 717 and the standby pot 718 are supported by the support other than the support 705. Thus, the developer supply nozzle 720 and the rinsing liquid supply nozzle 740, which move vertically together with the support 705, move up and down relative to the semiconductor wafer SW held by the wafer holding and rotation mechanism 710.

Instead of the air cylinder 739*a*, a servo motor and a ball screw mechanism may be used. This has the advantage that the height of the developer supply nozzle 720 can be set to any value.

The developer supply nozzle scanning mechanism 730 and the developer supply nozzle up-and-down mechanism 739 constitute a mechanism for moving the developer supply nozzle 720.

The rinsing liquid supply nozzle 740 has a discharge unit 742 for discharging a rinsing liquid with a discharge width substantially equal to or greater than the width (diameter) of the semiconductor wafer SW.

In the present example, the rinsing liquid supply nozzle 740 has the slit discharge unit 742 formed on one side of a long length of nozzle body 742. The discharge unit 742 extends along the length of the nozzle body 741. This discharge unit 742 is configured to discharge a rinsing liquid in the form of a uniform curtain along the whole discharge width so that a rinsing liquid can be supplied along the whole width of the semiconductor wafer SW.

The developer supply nozzle 740 is coupled to the rinsing liquid supply system for supplying a rinsing liquid, which will be described later.

The rinsing liquid supply nozzle rotation mechanism 750 is a mechanism for rotating the rinsing liquid supply nozzle 740 so that the nozzle 740 passes over the semiconductor wafer SW. It comprises a rinsing liquid supply nozzle rotating motor 752 and a rotary shaft 754.

The rinsing liquid supply nozzle rotating motor 752 consists for example of a stepping motor and is mounted in a position close to one end of the developer supply nozzle 720, with a bracket 751 and the rinsing liquid supply nozzle up-and-down mechanism 756 in between. The rotational speed and the amount of rotation of this motor 752 is variably controllable in response to a signal (such as a pulse signal) given from the controller 760.

The rotary shaft 754 is coupled to a motor shaft of the rinsing liquid supply nozzle rotating motor 752 and is disposed vertically from under the lower surface of the bracket 751. With the developer supply nozzle 720 in the rinsing liquid supply position U1, the rotary shaft 754 is freely rotatable on one vertex of a virtual square S circumscribing the semiconductor wafer SW held by the wafer holding and rotation mechanism 710.

The rinsing liquid supply nozzle 740 is fixedly coupled at its one end to the lower end of the rotary shaft 754, whereby the rinsing liquid supply nozzle 740 is supported in a cantilever manner in an approximately horizontal position above the support 705. The discharge unit 742 of the rinsing liquid supply nozzle 740 is arranged inclined at an angle in the range of 15 to 60 degrees to a horizontal plane toward a direction opposite to the direction of rotation of the rinsing liquid supply nozzle 740 during discharge. Inclining the discharge unit 742 in this way in the direction opposite to the direction of rotation of the rinsing liquid supply nozzle 740 is in order to prevent a rinsing liquid from flowing ahead of the movement of the rinsing liquid supply nozzle 740 (see FIG. 20). By driving and rotating the rotary shaft 754 with the rinsing liquid supply nozzle rotating motor 752, the rinsing liquid supply nozzle 740 is rotated to pass over the semiconductor wafer SW. In passing over the semiconductor wafer SW, the rinsing liquid supply nozzle 740 discharges a rinsing liquid from its discharge unit 742 so that a rinsing liquid is supplied to the major surface of the semiconductor wafer SW.

The rinsing liquid supply nozzle 740 is attached to the above lateral rod 731*c* via the bracket 751, the rinsing liquid supply nozzle rotating motor 752, the rinsing liquid supply nozzle up-and-down mechanism 756 and a cylinder mounting bracket 731*d* later to be described.

The bracket 751 is provided with a sensor 755*b* for detecting an original position of the rinsing liquid supply nozzle 740, with a sensor bracket 755*a* in between. On the other hand, a sector 741*a* (FIG. 24) to be sensed is secured to the nozzle body 741 of the rinsing liquid supply nozzle 740. With the rinsing liquid supply nozzle 740 in its original position (i.e., in a position substantially parallel to the developer supply nozzle 720), the sector 741*a* is inserted into the sensor 755*b*. Thereby the sensor 755*b* detects whether the rinsing liquid supply nozzle 740 is in its original position.

Figure 24:
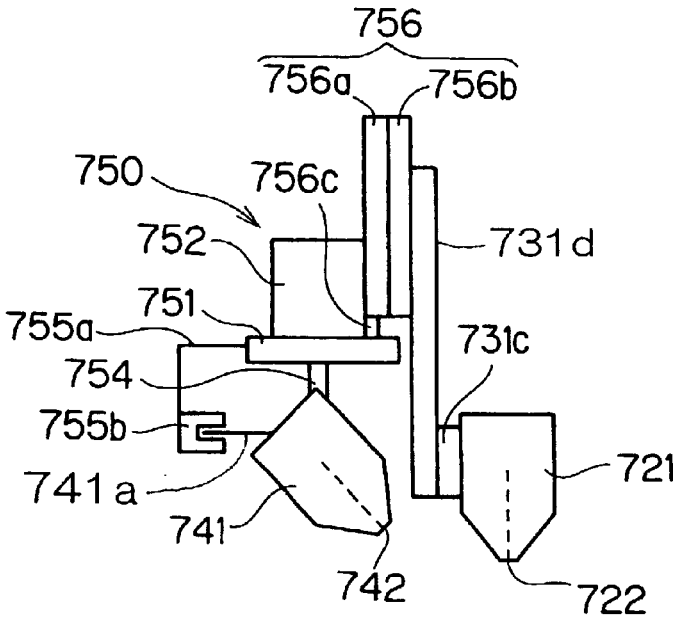
FIGS. 24 and 25 are enlarged views showing major parts of a developer supply nozzle and a rinsing liquid supply nozzle.
Figure 25:
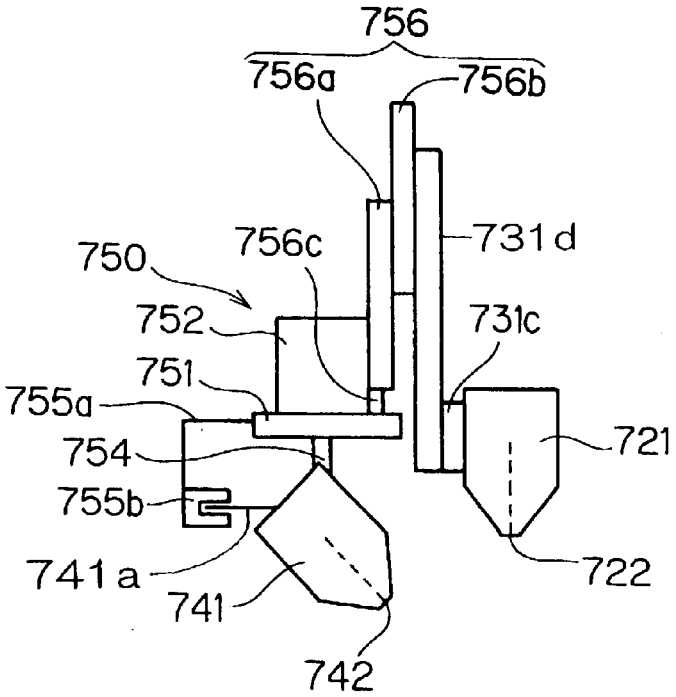

FIGS. 24 and 25 are enlarged views showing major parts of the developer supply nozzle 720 and the rinsing liquid supply nozzle 740. FIG. 24 shows the rinsing liquid supply nozzle 740 being in its upward position, and FIG. 25 shows the rinsing liquid supply nozzle 740 being in its downward position.

The rinsing liquid supply nozzle up-and-down mechanism 756 comprises a block piece 756*a* fixedly secured to the bracket 751 with the rode 756*c* in between, and a block piece 756*b* fixedly secured to the lateral rod 731*c* with the cylinder mounting bracket 731*d* in between. Those block pieces 756*a* and 756*b* are vertically slidably coupled. The block piece 756*a* is, for example, air driven to slide relative to the other block piece 756*b*. Thereby the bracket 751 is moved up and down and the rinsing liquid supply nozzle 740, together with the rinsing liquid supply nozzle rotating motor 752 and the like, is moved vertically relative to the developer supply nozzle 720.

While in this preferred embodiment, the rinsing liquid supply nozzle 740 is integrally mounted on the developer supply nozzle 720, they may, of course, be provided separately and independently as in the aforementioned second preferred embodiment.

Two final rinsing liquid supply nozzles 770 are mounted on the tip of a nozzle support arm 771 and in a position on the arm 771 slightly away from the tip. The final rinsing liquid supply nozzle 770 on the tip is for supplying a rinsing liquid to the central portion of the semiconductor wafer SW, while the other final rinsing liquid supply nozzle 770 is for supplying a rinsing liquid to the outer peripheral portion of the semiconductor wafer SW. One end of the nozzle support arm 771 is rotatably mounted in a position outside the semiconductor wafer SW, more specifically, in a position outside the rinsing liquid supply position U1. During the supply of a developer or a rinsing liquid to the semiconductor wafer SW, the nozzle support arm 771 is located in its stand-by position and spaced laterally from the semiconductor wafer SW (see FIG. 21). After the supply of a rinsing liquid to the semiconductor wafer SW for termination of development reactions, in order to clean the upper surface of the semiconductor wafer SW, the nozzle support arm 771 is, for example, motor driven and rotated so that the final rinsing liquid supply nozzle 770 on the tip is located above the semiconductor wafer SW and discharges a rinsing liquid to the central portion of the semiconductor wafer SW and a portion closer to the outer periphery.

Figure 26:
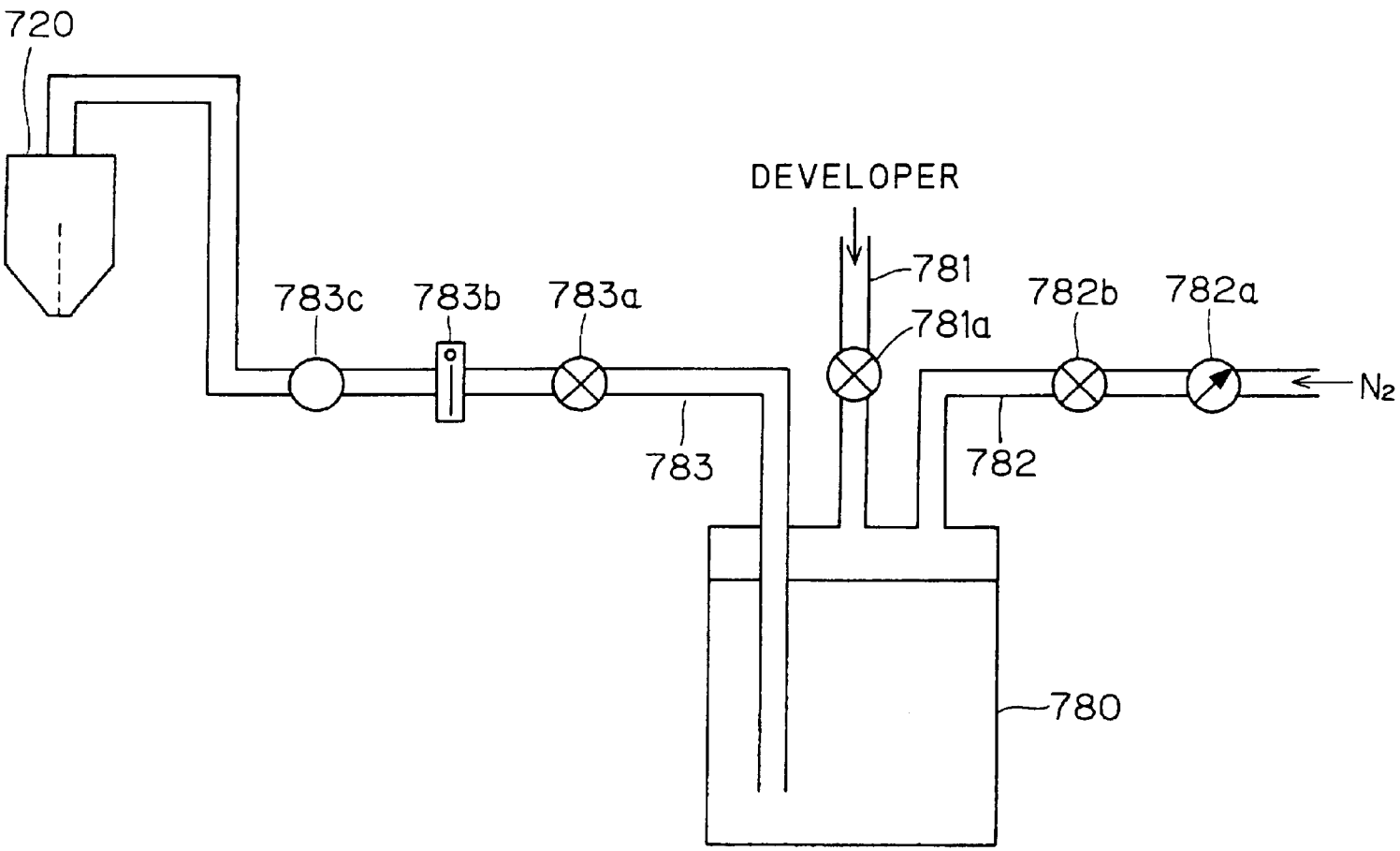
FIG. 26 is a piping diagram showing a developer supply system.

FIG. 26 is a piping diagram showing the developer supply system.

The developer supply system comprises a pressure developer tank 780, first developer piping 781 connecting between the developer tank 780 and another developer reservoir tank or a plant utility which is a predetermined developer supply source installed in a plant, second developer piping 782 connecting between a predetermined $N_2$ gas supply source and the developer tank 780, and third developer piping 783 connecting between the developer tank 780 and the developer supply nozzle 720. The first developer piping 781 has an air operation valve 781*a* interposed therein. The air operation valve is a valve opened or closed by air flow responsive to the opening and closing of a solenoid valve. The second developer piping 782 has interposed therein a regulator 782*a* for controlling the rate of $N_2$ gas flow and an air operation valve 782*b*. The third developer piping 783 has interposed therein an air operation valve 783*a*, a flowmeter 783*b* having a mechanism for measuring and adjusting the rate of developer flow toward the developer supply nozzle 720, and a filter 783*c* for removing undesirable matter contained in a developer. One ends of the first developer piping 781 and the second developer piping 782 on the side of the developer tank 780 are opened to an upper space of the developer tank 780 where a developer is not stored, while one end of the third developer piping 783 on the side of the developer tank 780 is led to the bottom of the developer tank 780 and opened to be immersed in a developer stored. The on-off control of the respective air operation valves 781*a*, 782*b* and 783*a* is exercised by controlling the rate of gas flow such as $N_2$ gas, and the rate of gas flow for use in the above on-off control is controlled by the on-off control of a solenoid valve through the controller 760.

Prior to the supply of a developer to the developer supply nozzle 720, a developer is supplied into the developer tank 780. During the supply of a developer into the developing tank 780, with the air operation valves 782*b* and 783*a* in their closed positions, the air operation valve 781*a* is opened to supply a developer through the first developer piping 781 into the developer tank 780. After a sufficient amount of a developer is stored in the developer tank 780 and then when a developer is supplied to the developer supply nozzle 720, the air operation valves 782*b* and 783*a* are opened with the air operation valve 781*a* in its closed position. Accordingly, $N_2$ gas is introduced through the second developer piping 782 into the developer tank 780 and thereby an internal pressure in the developer tank 780 is increased. This increased internal pressure pushes the developer tank 780, whereby a developer is supplied through the third developer piping 783 to the developer supply nozzle 720. The rate of flow of a developer supplied to the developer supply nozzle 720 through the third developer piping 783 is controlled by the flowmeter 783*b*.

Figure 27:
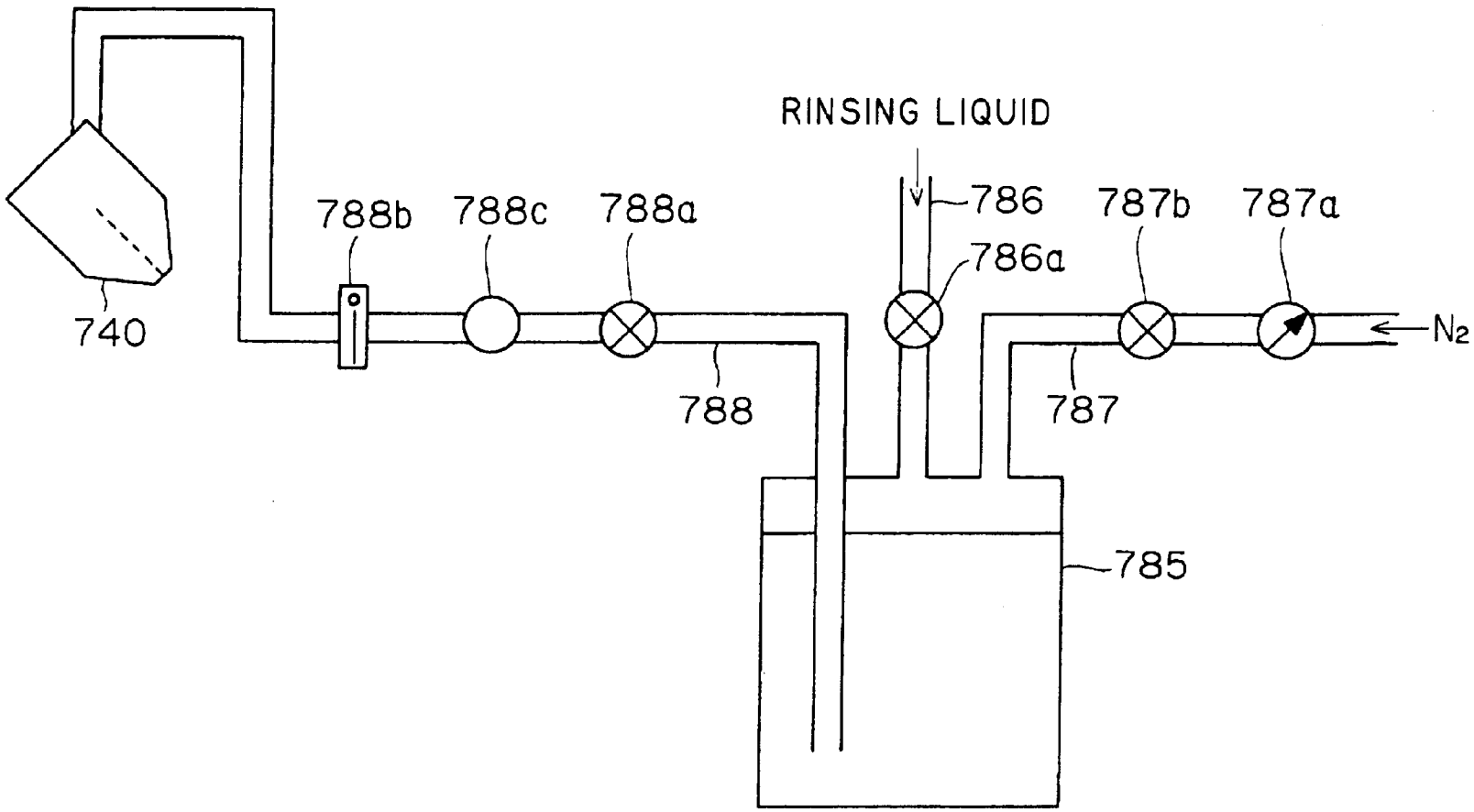
FIG. 27 is a piping diagram showing a rinsing liquid supply system.

FIG. 27 is a piping diagram showing a rinsing liquid supply system.

The rinsing liquid supply system comprises a pressure rinsing liquid tank 785, first rinsing liquid piping 786 connecting between the rinsing liquid tank 785 and another rinsing liquid reservoir tank or a plant utility which is a predetermined rinsing liquid supply source installed in a plant, second rinsing liquid piping 787 connecting between a predetermined $N_2$ gas supply source and the rinsing liquid tank 785, and third rinsing liquid piping 788 connecting between the rinsing liquid tank 785 and the rinsing liquid supply nozzle 740. The first rinsing liquid piping 786 has an air operation valve 786*a* interposed therein. The second rinsing liquid piping 787 has interposed therein a regulator 787*a* for controlling the rate of $N_2$ gas flow and an air operation valve 787*b*. The third rinsing liquid piping 788 has interposed therein an air operation valve 788*a*, a filter 788*c* for removing undesirable matter contained in a rinsing liquid, and a flowmeter 788*b* having a mechanism for measuring and adjusting the rate of rinsing liquid flow toward the rinsing liquid supply nozzle 740.

Except that the locations of the filter 788*c* and the flowmeter 788*b* are reversed in the third rinsing liquid piping 788, the rinsing liquid supply system is identical in configuration to the aforementioned developer supply system and, based on the same principle and in the same manner, supplies a rinsing liquid to the rinsing liquid supply nozzle 740.

Figure 28:
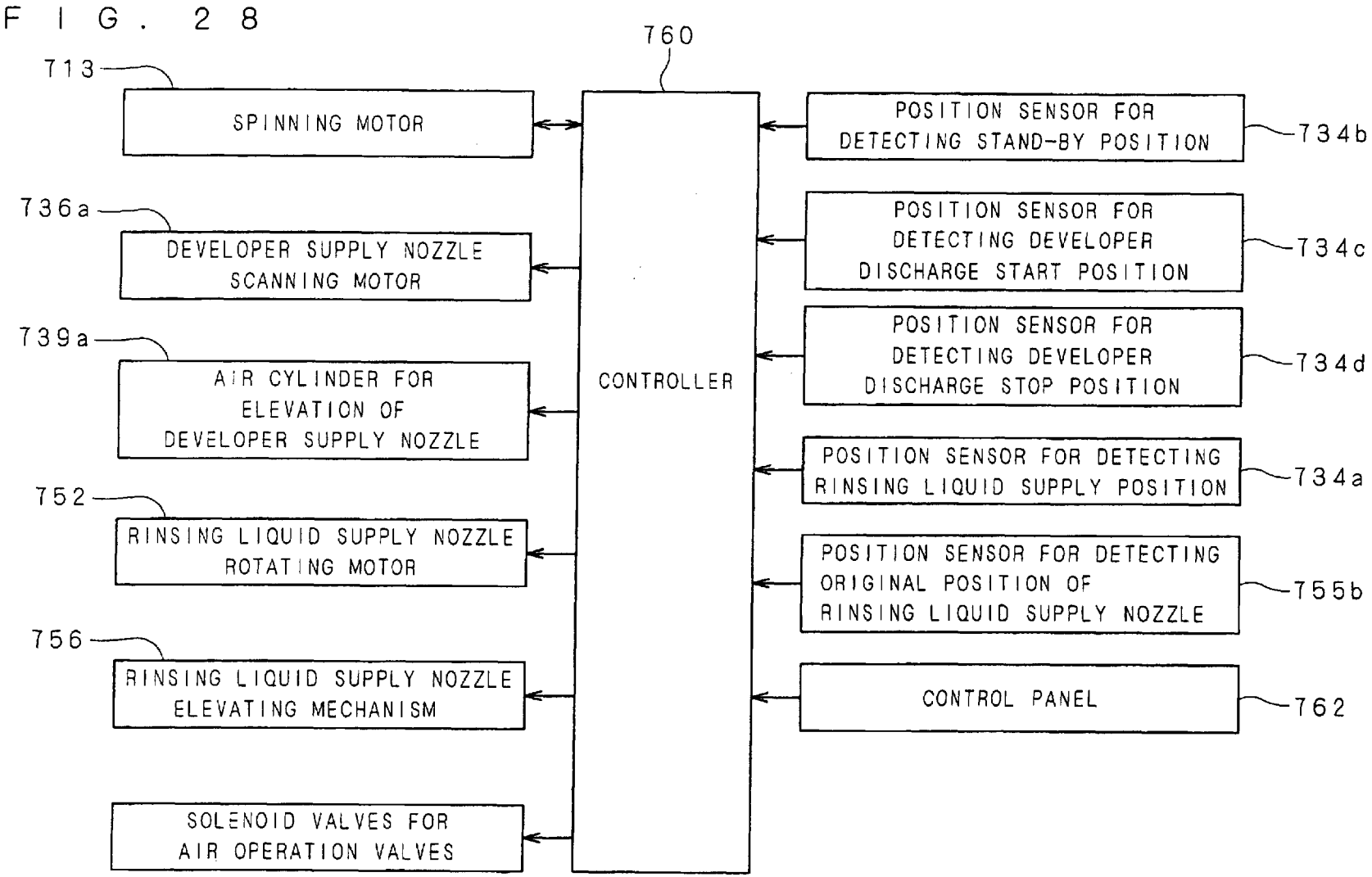
FIG. 28 is a block diagram showing an electrical structure of the developing apparatus.

FIG. 28 is a block diagram showing an electrical structure of the developing apparatus of this preferred embodiment.

The controller 760 controls a sequence of operations later to be described and comprises a CPU, a ROM, a RAM and the like. It consists of a general microcomputer which performs predetermined arithmetic and logical operations by executing a previously stored software program.

The controller 760 is connected to the position sensors 734*a*, 734*b*, 734*c* and 734*d* for detecting the position of the moving developer supply nozzle 720 and the sensor 755*b* for detecting an original position of the rinsing liquid supply nozzle 740, so that each detection signal is fed to the controller 760. The controller 760 is also connected to a control panel 762, through which a predetermined operator command is given to the controller 760.

Also, the spinning motor 713 consisting for example of a servo motor is connected to the controller 760. The controller 760 receives a detection signal outputted from, for example, a mechanism for detecting the amount of rotation such as a rotary encoder on the side of the spinning motor 713 and, based on the detection signal, exercises feedback control over the amount of rotation of the spinning motor 713.

The controller 760 is also connected to the developer supply nozzle scanning motor 736*a*, the air cylinder 739*a* for vertically moving the developer supply nozzle 720, the rinsing liquid supply nozzle rotating motor 752, the rinsing liquid supply nozzle up-and-down mechanism (air cylinder) 756, and solenoid valves for use with the respective air operation valves 781*a*, 782*b*, 783*a*, 786*a*, 787*b* and 788*a* in the aforementioned developer and rinsing liquid supply systems, all of whose operations are controlled by the controller 760.

Now, a sequence of development processing steps performed on the semiconductor wafer SW by this developing apparatus will be described.

Figure 29:
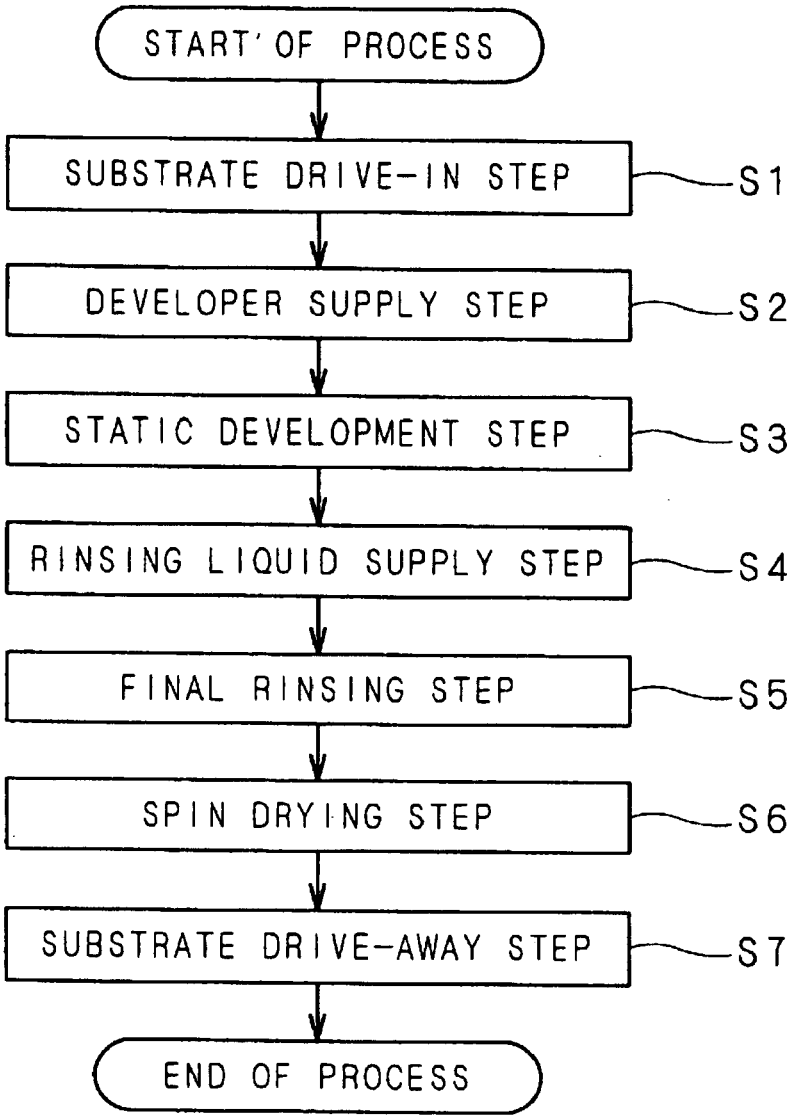
FIG. 29 is a flow chart illustrating a sequence of development processing by the developing apparatus.
Figure 30:
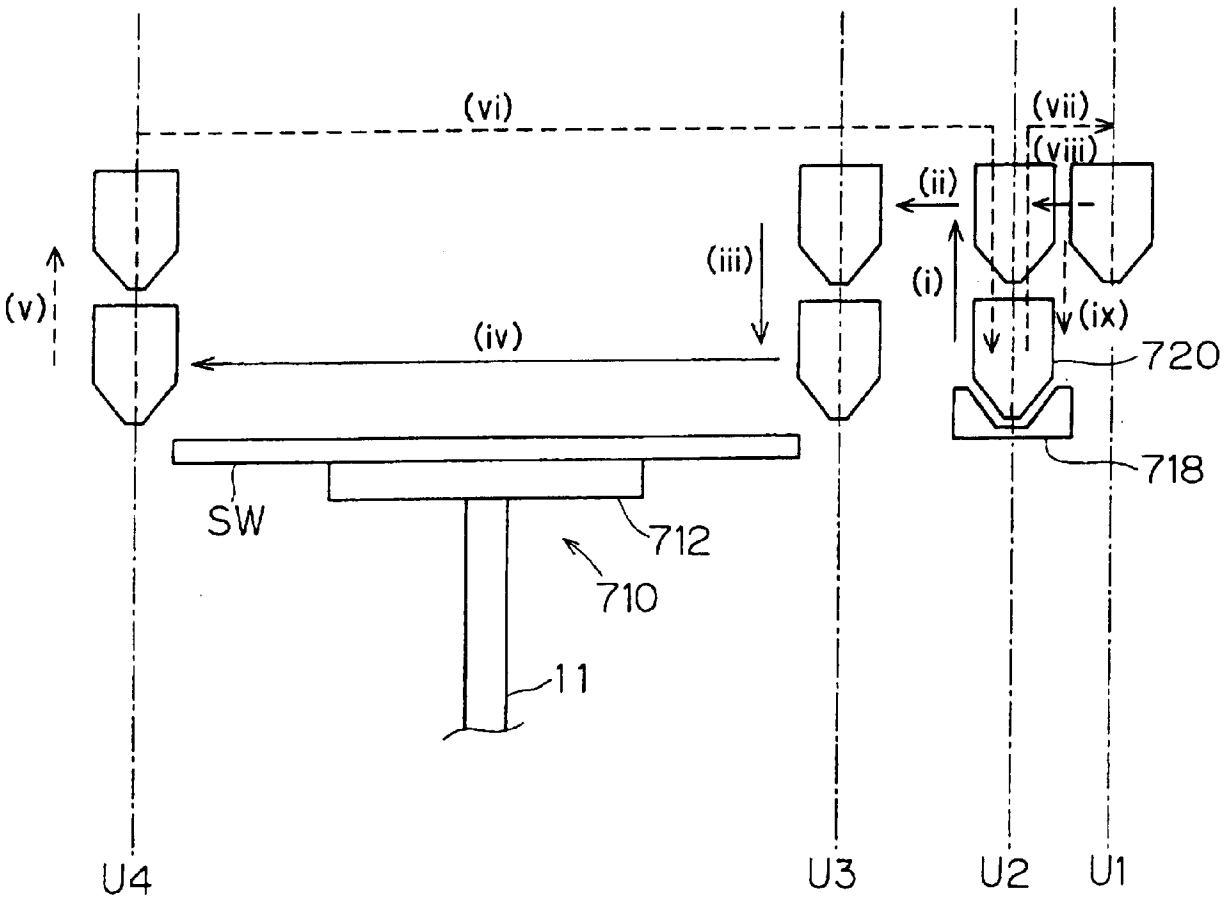
FIG. 30 is an explanatory diagram for explaining the movement of the developer supply nozzle.
Figure 31:
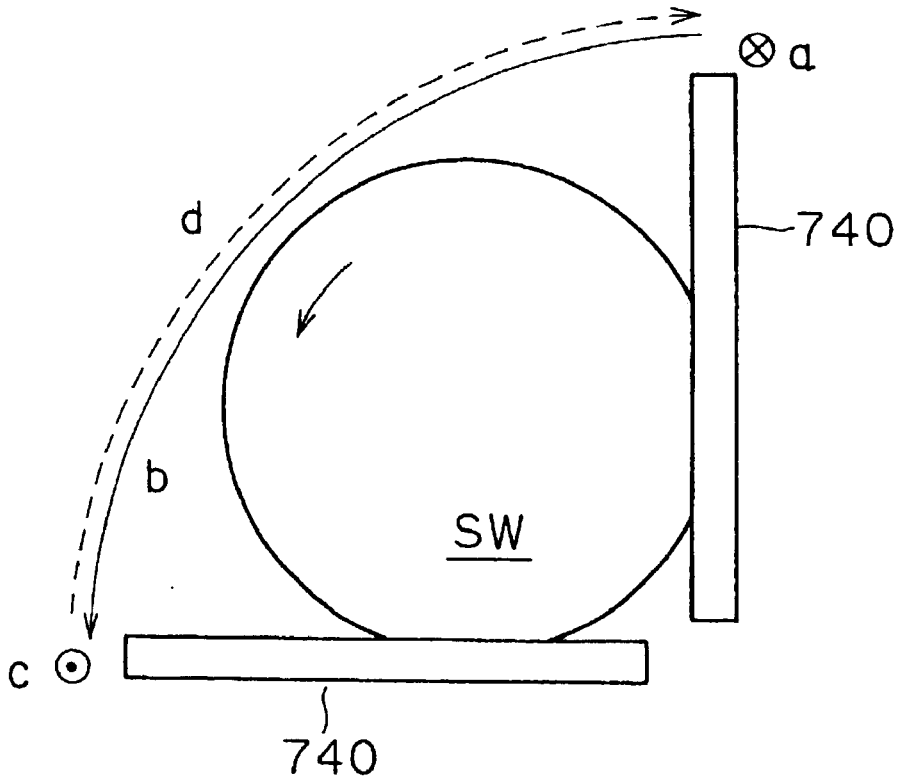
FIG. 31 is an explanatory diagram for explaining the movement of the rinsing liquid supply nozzle.

FIG. 29 is a flow chart showing a sequence of development processing steps by the developing apparatus, FIG. 30 is an explanatory diagram for explaining the movement of the developer supply nozzle 720, and FIG. 31 is an explanatory diagram for explaining the movement of the rinsing liquid supply nozzle 740.

After the initiation of processing, in step S1, the semiconductor wafer SW is transferred by a transfer robot onto the spin chuck 712 in the wafer holding and rotation mechanism 710. In the initial state, the inner cup 716 is in its downward position.

In step S2, a developer is supplied to the semiconductor wafer SW.

More specifically, as shown in FIG. 30, in the initial state, the developer supply nozzle 720 is located at the stand-by position U2 and in its downward position within the standby pot 718. After the initiation of processing of step S2, the developer supply nozzle 720, as indicated by the arrow (i), moves upward away from the standby pot 718 at the stand-by position U2. Then, as indicated by the arrow (ii), the developer supply nozzle 720 horizontally moves with a constant velocity toward the developer discharge start position U3 on one end of the semiconductor wafer SW. After that, as indicated by the arrow (iii), the developer supply nozzle 720 moves downward at the developer discharge start position U3 and starts to discharge a developer. Then, as indicated by the arrow (iv), the developer supply nozzle 720 horizontally moves with a constant velocity from the developer discharge start position U3 to the developer discharge stop position U4 on the other end of the semiconductor wafer SW and at the same time, supplies a developer to the semiconductor wafer SW at a constant flow rate. Thereby, a developer is formed in a puddle on the semiconductor wafer SW.

Here, the travel speed of the developer supply nozzle 720 when moving from the stand-by position U2 to the developer discharge start position U3 may be equal to that of the developer supply nozzle 720 when moving from the developer discharge start position U3 to the developer discharge stop position U4, or the former may be higher than the latter. The latter can be set to any value in the range of 30 to 70 mm/sec. A developer discharged is an aqueous alkaline solution or a predetermined solvent. The rate of flow of a developer to be supplied at this time can be set to any value in the range of 0.7 to 1.8 liters per minute. The set value for the flow rate is fixed after an optimum value is obtained by, for example, experiment under predetermined development processing conditions and a corresponding adjustment of the flowmeter 783*b* is made.

Figure 32:
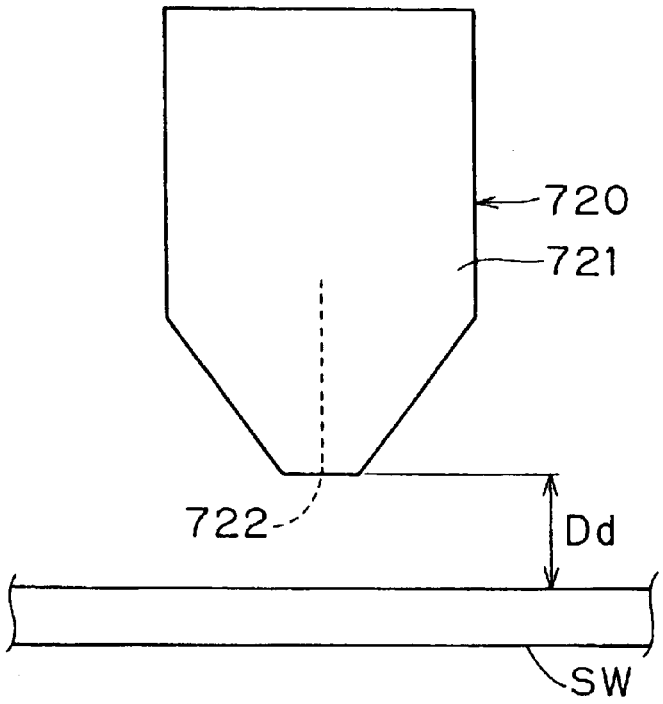
FIG. 32 is a diagram showing the relative positions of a semiconductor wafer and the developer supply nozzle.

As shown in FIG. 32, when the developer supply nozzle 720 moves over the semiconductor wafer SW, it is preferable that a spacing $D_d$ between the upper surface of the semiconductor wafer SW and the lower end of the developer supply nozzle 720 be approximately 1.5 mm.

Then, as indicated by the arrow (v), the developer supply nozzle 720 moves upward at the developer discharge stop position U4.

In this step S2, the rinsing liquid supply nozzle 740 is in its upward position and moves together with the developer supply nozzle 720. The semiconductor wafer SW is at rest.

Next, static development processing is performed in step S3.

More specifically, with the semiconductor wafer SW being at rest, development processing is performed on the semiconductor wafer SW after being exposed. The static development time depends on a solution velocity of a resist, throughput of the apparatus and the like, and is set to be in the range of 3 to 120 seconds.

After completion of the static development processing, as indicated by the arrow (vi) in FIG. 30, the developer supply nozzle 720 returns once to the stand-by position U2 and descends into the standby pot 718. In the configuration where the rinsing liquid supply nozzle 740 and the developing 720 are provided separately (as in the aforementioned second preferred embodiment), the developer supply nozzle 720 may return to the stand-by position U2 after completion of a substrate drive-away step (step S7) later to be described, i.e., after the semiconductor wafer SW is taken out.

In step S4, a rinsing liquid is supplied to the semiconductor wafer SW.

First, as indicated by the arrow (vii) in FIG. 30, the developer supply nozzle 720 moves upward and toward the rinsing liquid supply position U1 away from the semiconductor wafer SW. The developer supply nozzle 720 then comes to a stop in its upward position. At this time, the rinsing liquid supply nozzle 740 is located above one end of the semiconductor wafer SW. This position is slightly different from the position where the developer supply nozzle 720 starts the discharge of a developer and is slightly closer to the semiconductor wafer SW.

In this condition, as indicated by the arrow a in FIG. 31, the rinsing liquid supply nozzle 740 moves downward relative to the developer supply nozzle 720. The rinsing liquid supply nozzle 740 then starts the discharge of a rinsing liquid. At the start of the discharge of a rinsing liquid, the rinsing liquid supply nozzle 740 starts to rotate and at the same time, the semiconductor wafer SW starts to rotate. Along the circumferential direction of the semiconductor wafer SW, a position to supply a rinsing liquid and a position to supply a developer are substantially the same. The rinsing liquid supply nozzle 740 is rotated by $\pi/2$ radians (90 degrees) (as indicated by the arrow b in FIG. 31) and similarly, the semiconductor wafer SW is rotated by $\pi/2$ radians (90 degrees).

The angular velocities of the rinsing liquid supply nozzle 740 and the semiconductor wafer SW during rotation can be set to any value in the range of $\pi/24$ to $\pi/4$ in radians per second. In the present example, both the angular velocities are assumed to be constant and equal to each other.

With such constant angular velocities, even if the time required for the developer supply nozzle 720 to scan the semiconductor wafer SW is equal to the time required for the rinsing liquid supply nozzle 740 to scan the semiconductor wafer SW (e.g., 4 seconds), a velocity component of the rinsing liquid supply nozzle 740 in a direction parallel to a scanning direction of the developer supply nozzle 720 with respect to the semiconductor wafer SW is not constant and not equal to a scanning velocity of the developer supply nozzle 720.

Also, when both the above angular velocities are set to be constant, the timing of termination of the development is not the same at each point on the semiconductor wafer SW. However, by controlling each of the above angular velocities and thereby equating the velocity of the developer supply nozzle 720 and the velocity component of the rinsing liquid supply nozzle 740 in the scanning direction of the developer supply nozzle 720 with respect to the semiconductor SW, the timing of termination of the development can be made approximately the same at each point on the semiconductor wafer SW.

The relationship between the angular velocities of the rinsing liquid supply nozzle 740 and the semiconductor wafer SW and a preferable form or the like will later be described in detail.

In the above example, a rinsing liquid is pure water, alcohol, a hydrogen peroxide solution, or a predetermine solvent. The rate of flow of a rinsing liquid to be supplied is set to any value in the range of 2.5 to 3.5 litters per minute. The set value for the flow rate is fixed after an optimum value is obtained by, for example, experiment under predetermined development processing conditions and a corresponding adjustment of the flowmeter 788*b* is made.

Figure 33:
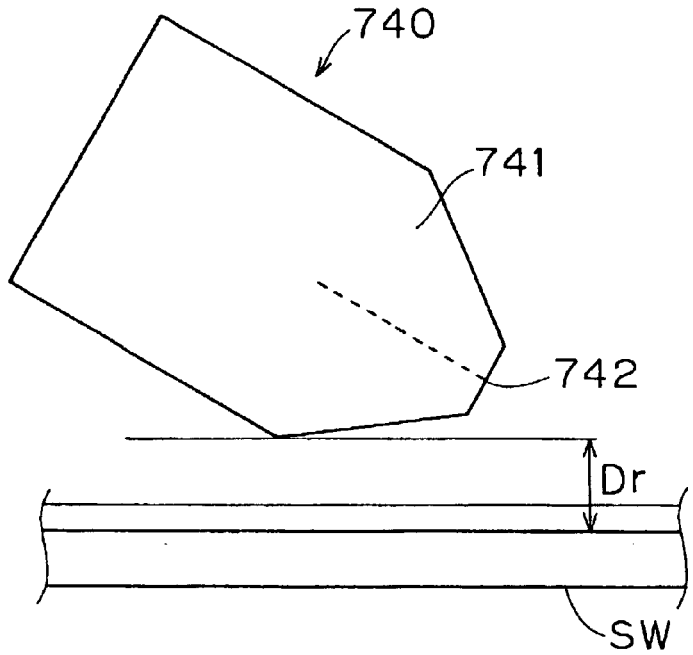
FIG. 33 is a diagram showing the relative positions of the semiconductor wafer and the rinsing liquid supply nozzle.

As shown in FIG. 33, when the rinsing liquid supply nozzle 740 passes over the semiconductor wafer SW, it is preferable that a spacing Dr between the upper surface of the semiconductor wafer SW and the lower end of the rinsing liquid supply nozzle 740 be approximately 8 mm differently from the aforementioned spacing Dd for the developer supply nozzle 720. This is in order to prevent the rinsing liquid supply nozzle 740 from interfering with an approximately 3-mm thick developer formed in a puddle on the semiconductor wafer SW.

The supply of a rinsing liquid onto the semiconductor wafer SW in this way stops development reactions on the semiconductor wafer SW.

After being rotated over the semiconductor wafer SW, the rinsing liquid supply nozzle 740 moves upward relative to the developer supply nozzle 720 as indicated by the arrow c in FIG. 31 and then moves backward to return to its original position as indicated by the arrow d. Then, as indicated by the arrows (viii) and (ix) in FIG. 30, the developer supply nozzle 720 moves to the stand-by position U2 and descends into the standby pot 718.

Next, in step S5, a final supply of a rinsing liquid is provided to the semiconductor wafer SW.

More specifically, the inner cup 716 is moved upward and, with the semiconductor wafer SW being rotated, a rinsing liquid (pure water) is supplied from the final rinsing liquid supply nozzles 770 to the central portion of the semiconductor wafer SW thereby to clean and remove undesirable matter (e.g., particles) produced by development reactions.

The rate of rotation of the semiconductor wafer SW at this time is in the range of 500 to 1000 rpm.

Then, in step S6, the semiconductor wafer SW is rotated with a high velocity to spin off a rinsing liquid on the semiconductor wafer SW and to dry the semiconductor wafer SW.

The rate of rotation of the semiconductor wafer SW at this time is in the range of 1500 to 3000 rpm.

Finally, in step S7, the inner cup 716 is moved downward, and the semiconductor wafer SW, after being released from adsorption and holding by the spin chuck 712, is transferred to the outside by the transfer robot.

In the developing apparatus of the aforementioned configuration, with the semiconductor wafer SW being rotated, the rinsing liquid supply nozzle 740 is rotated to pass over the semiconductor wafer SW and at the same time to supply a rinsing liquid. Thus, the discharge unit 742 is shifted in the direction of discharge of a rinsing liquid, which improves uniformity in the supply of a rinsing liquid to the semiconductor wafer SW.

Besides, the development time can be made approximately the same at each point on the entire surface of the semiconductor wafer SW, which results in uniform development processing.

Further, since the semiconductor wafer SW is rotated during the supply of a rinsing liquid in step S4, undesirable matter (e.g., particles) produced by development reactions can efficiently be led to the outside of the semiconductor wafer SW by centrifugal force.

<B. Relative Positions of Semiconductor Wafer and Nozzle>

<B1. Nozzle Position Relative to Semiconductor Wafer>

Now, the relative positions of the semiconductor wafer SW and the rinsing liquid supply nozzle 740 will be described in more detail.

Figure 34:
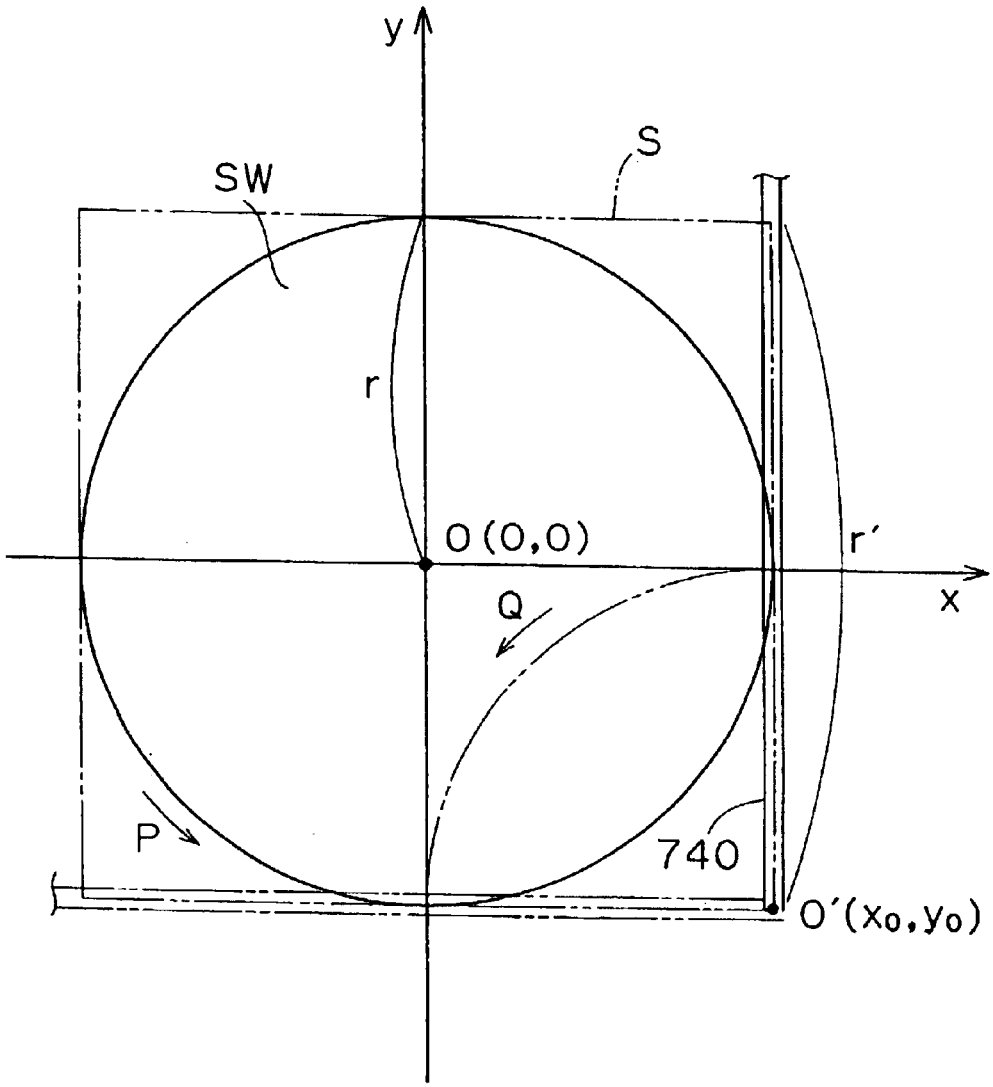
FIG. 34 is a diagram showing the relationship between the semiconductor wafer and the rinsing liquid supply nozzle in the XY plane.

FIG. 34 is a diagram showing the relative positions of the semiconductor wafer SW and the rinsing liquid supply nozzle 740 in the XY plane. The XY plane is assumed to have an origin point O which is the rotation axis of the semiconductor wafer SW, an x axis extending along the virtual scanning direction La of the semiconductor wafer SW, and a y axis orthogonal to the x axis. The virtual scanning direction La herein is identical to that described in the second preferred embodiment.

In this drawing, a center of rotation of the generally disc-shaped semiconductor wafer SW is at the origin point O (0, 0) and the wafer SW has a radius of r. During the supply of a rinsing liquid, the semiconductor wafer SW rotates counterclockwise (in a direction indicated by the arrow P) on the origin point O.

The rinsing liquid supply nozzle 740 rotates counterclockwise (in a direction indicated by the arrow Q) over the semiconductor wafer SW on one vertex of a square S circumscribing the semiconductor wafer SW as a center of rotation O' ($x_0$, $y_0$). Let r' be the distance between the center of rotation O' ($x_0$, $y_0$) and an arbitrary point along the direction of extension of the rinsing liquid supply nozzle 740.

Assuming that the semiconductor wafer SW is at rest, an arbitrary point (x', y') of the rinsing liquid supply nozzle 740 over the semiconductor wafer SW, t seconds after the start of rotation of the rinsing liquid supply nozzle 740, can be expressed by the following equation:

$$\begin{cases} x' = r'\cos\left(\theta' + \frac{\pi}{2}\right) + r \\ y' = r'\sin\left(\theta' + \frac{\pi}{2}\right) - r \end{cases} \quad (1)$$

where θ' is the rotation angle of the rinsing liquid supply nozzle 740, t seconds after the start of rotation of the rinsing liquid supply nozzle 740.

Next, consider the case where the semiconductor wafer SW rotates in response to the rotation of the rinsing liquid supply nozzle 740. Let θ be the rotation angle of the semiconductor wafer SW, t seconds after the start of rotation of the semiconductor wafer SW.

In this case, the point (x', y') can be assumed to be rotated at θ degrees and shifted to a point (x, y).

Figure 35:
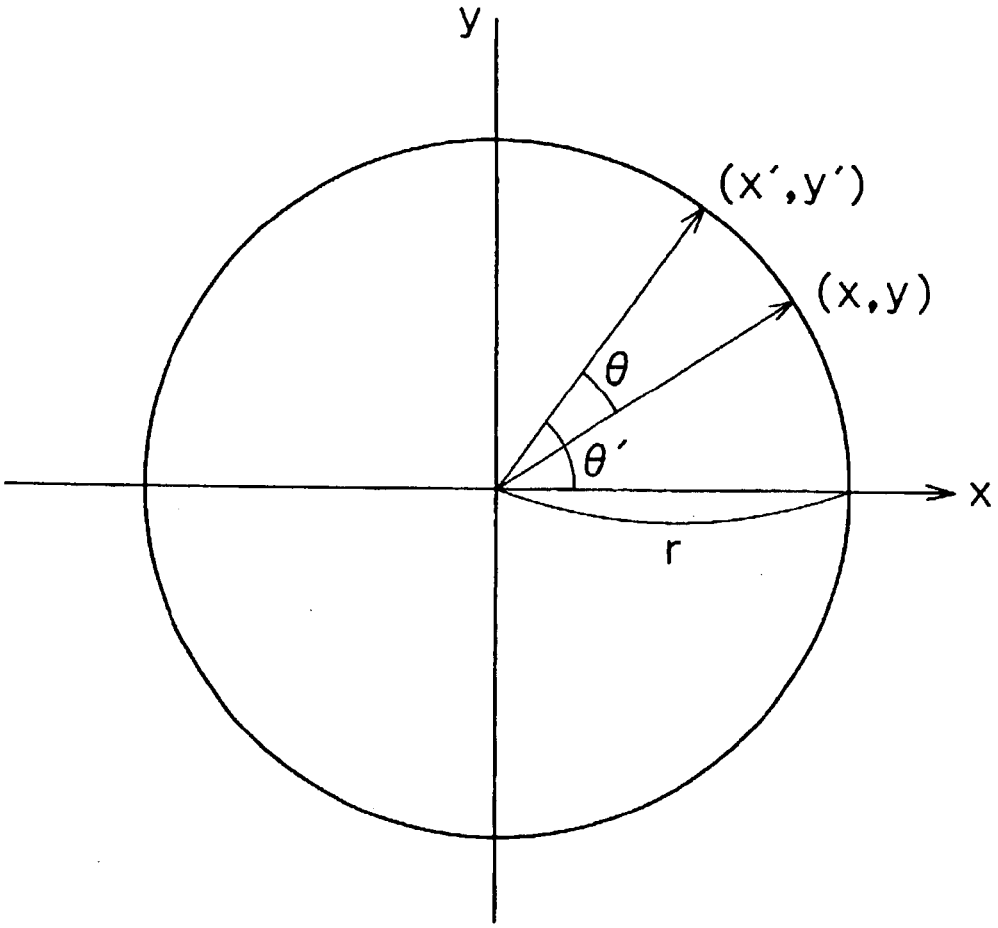
FIG. 35 is a diagram showing the relationship between the polar coordinates of the rinsing liquid supply nozzle and a rotation angle.

The point (x', y'), represented in a polar coordinate system, is as shown in FIG. 35 and can be expressed as:

$$\begin{cases} x' = r\cos\theta' \\ y' = r\sin\theta' \end{cases} \quad (2)$$

When the semiconductor wafer SW rotates θ degrees to the left, the above point (x',y') can be assumed to be rotated θ degrees to the right. Where θ is the rotation angle of the semiconductor wafer SW, t seconds after the start of rotation of the semiconductor wafer SW. In a rotating coordinate system in which the x axis is the virtual scanning direction La of the semiconductor wafer SW, the y axis is a coordinate axis orthogonal to the x axis and the origin point is at the center of rotation of the semiconductor wafer SW, the coordinates (x, y) of an arbitrary point of the rinsing liquid supply nozzle 740 relative to the semiconductor wafer W can be expressed as:

$$\begin{cases} x = r\cos(\theta' - \theta) \\ y = r\sin(\theta' - \theta) \end{cases} \quad (3)$$

According to the laws of cosines and sines, the equation (3) can be rewritten as:

$$\begin{cases} x = r(\cos\theta' \cdot \cos\theta + \sin\theta' \cdot \sin\theta) \\ y = r(\sin\theta' \cdot \cos\theta - \cos\theta' \cdot \sin\theta) \end{cases} \quad (4)$$

From the equations (2) and (4), the coordinates (x, y) of an arbitrary point of the rinsing liquid supply nozzle 740 relative to the semiconductor wafer SW after t seconds can be expressed by the following equation:

$$\begin{cases} x = x'\cos\theta + y'\sin\theta \\ y = y'\cos\theta - x'\sin\theta \end{cases} \quad (5)$$

where $$\begin{cases} x' = r'\cos\left(\theta' + \frac{\pi}{2}\right) + r \\ y' = r'\sin\left(\theta' + \frac{\pi}{2}\right) - r \end{cases}$$

By varying the value r' in the equation (5), the coordinates of each point of the rinsing liquid supply nozzle 740 relative to the semiconductor wafer SW after i seconds can be obtained.

When the rinsing liquid supply nozzle 740 rotates with a constant velocity at a rotational frequency of T' and the semiconductor wafer SW rotates with a constant velocity at a rotational frequency of T, the rotation angles θ and θ' can be expressed by the following equations:

$$\begin{cases} \theta = \frac{2\pi}{T}t \\ \theta' = \frac{2\pi}{T'}t \end{cases} \quad (6)$$

<B2. Relationship Between Angular Velocities of Semiconductor Wafer and Nozzle>

On the basis of the above equation (5), the relationship between the angular velocities of the semiconductor wafer SW and the rinsing liquid supply nozzle 740 will be described.

Where the angular velocities of both the semiconductor wafer SW and the rinsing liquid supply nozzle 740 are equal (including the case where both the angular velocities vary in synchronization with each other), the rotation angle θ of the semiconductor wafer SW and the rotation angle θ' of the rinsing liquid supply nozzle 740, after t seconds, are equal, i.e., θ=θ'. Thus, the equation (5) can be expressed as:

$$\begin{cases} x = r(\cos\theta - \sin\theta) \\ y = r' - r(\cos\theta + \sin\theta) \end{cases} \quad (7)$$

If, in the equation (7), the rinsing liquid supply nozzle 740 and the semiconductor wafer SW rotates with a constant velocity at the same rotational frequency of T, the following equation is true:

$$\theta = \frac{2\pi}{T}t \quad (8)$$

In the equation (7), it can be seen that the equation for x is a function of only the radius r and the rotation angle θ of the semiconductor wafer SW, not containing the term r'. This indicates that the value x is independent of a distance from the center of rotation of the rinsing liquid supply nozzle 740 and that the direction of extension of the rinsing liquid supply nozzle 740 is always parallel to the virtual scanning direction La of the semiconductor wafer SW.

Figure 36:
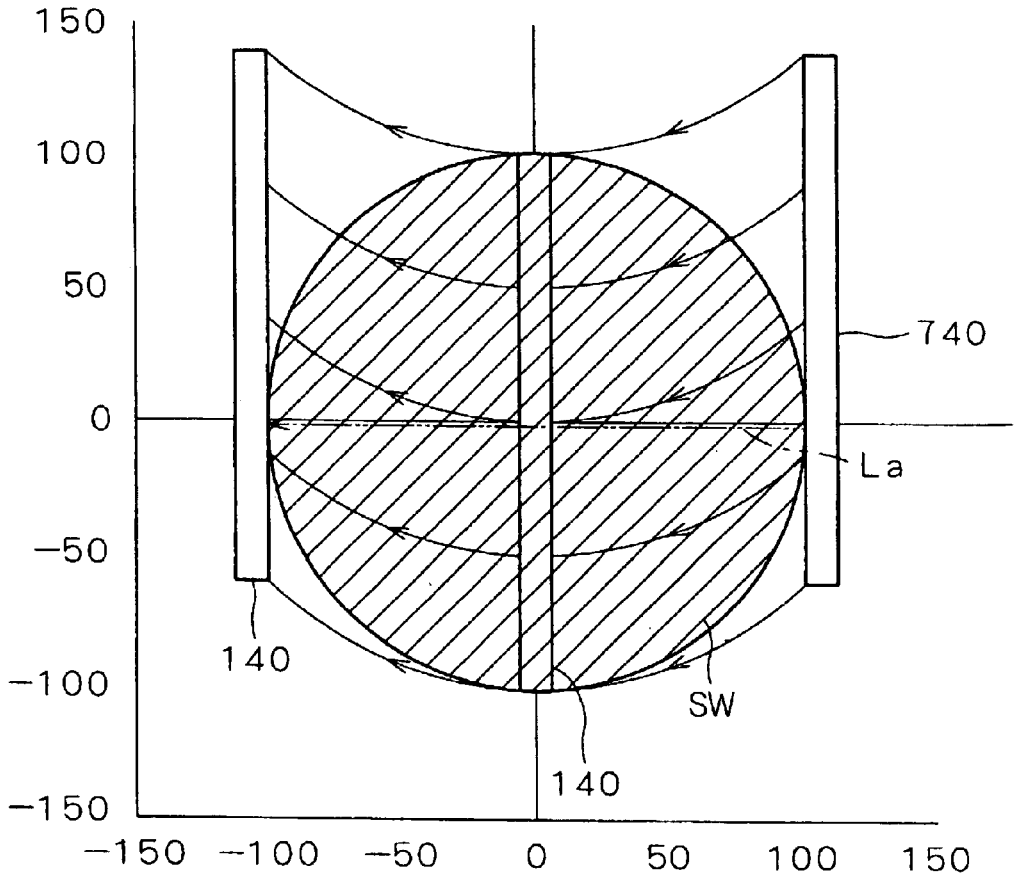
FIG. 36 is a diagram showing the path of movement of the rinsing liquid supply nozzle with respect to the semiconductor wafer.

On the basis of the equation (7), a path that the rinsing liquid supply nozzle 740 describes on the semiconductor wafer SW is shown in FIG. 36. FIG. 36 illustrates a coordinate system in which the horizontal axis is the virtual scanning direction La of the rotating semiconductor wafer SW and the longitudinal axis is a direction orthogonal to the horizontal axis. In the present example, the semiconductor wafer has a diameter of 200 mm.

As can be seen from this drawing, the rinsing liquid supply nozzle 740 moves along an arc in the form of a strip of a predetermined width over the semiconductor wafer SW. The direction of extension of the rinsing liquid supply nozzle 740 is always approximately perpendicular to the virtual scanning direction La of the semiconductor wafer SW; thus, it can be expected that the amount of a rinsing liquid discharged on the semiconductor wafer SW will be uniform at any point along a direction orthogonal to the virtual scanning direction La (in the longitudinal axial direction of FIG. 36).

That is, in order to make the amount of a rinsing liquid discharged on the semiconductor wafer SW as uniform as possible at each point along a direction orthogonal to the virtual scanning direction La, it is necessary to always equate the rotation angles θ and θ', i.e., angular velocities, of the semiconductor wafer SW and the rinsing liquid supply nozzle 740 after t seconds.

The same conclusion can be reached even if the coordinates of the rotation axis of the rinsing liquid supply nozzle 740 is set to any coordinates outside the semiconductor wafer SW.

<B3. Relative Velocity of Nozzle along Virtual Scanning Direction>

Based on the equation (7), we will now consider the amount of discharge of a rinsing liquid from the rinsing liquid supply nozzle 740 along the virtual scanning direction La of the semiconductor wafer SW.

Figure 37:
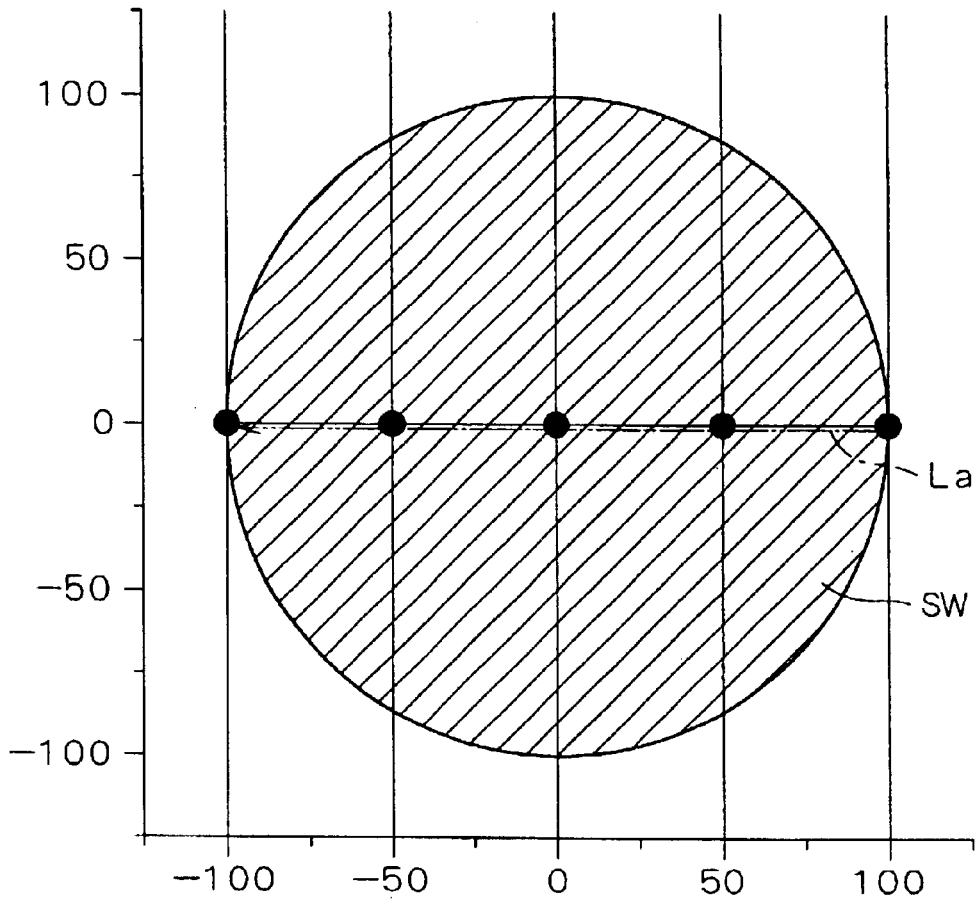
FIG. 37 is a diagram showing the travel distance of the rinsing liquid supply nozzle in a virtual scanning direction of the semiconductor wafer.

Closed circles on the semiconductor wafer SW shown in FIG. 37 indicate the positions of the rinsing liquid supply nozzle 740, respectively after 0, 1, 2, 3 and 4 seconds, when both the semiconductor wafer SW and the rinsing liquid supply nozzle 740, rotate with a constant velocity and make a quarter of rotation in 4 seconds, i.e., where T=16 sec.

At this time, the travel distance in the virtual scanning direction La for the first one second is 45.9 mm, that for the second one second is 54.1 mm, that for the third one second is 54.1 mm, and that for the fourth one second is 45.9 mm. That is, the travel distance of the rinsing liquid supply nozzle 740 per unit time varies.

Figure 38:
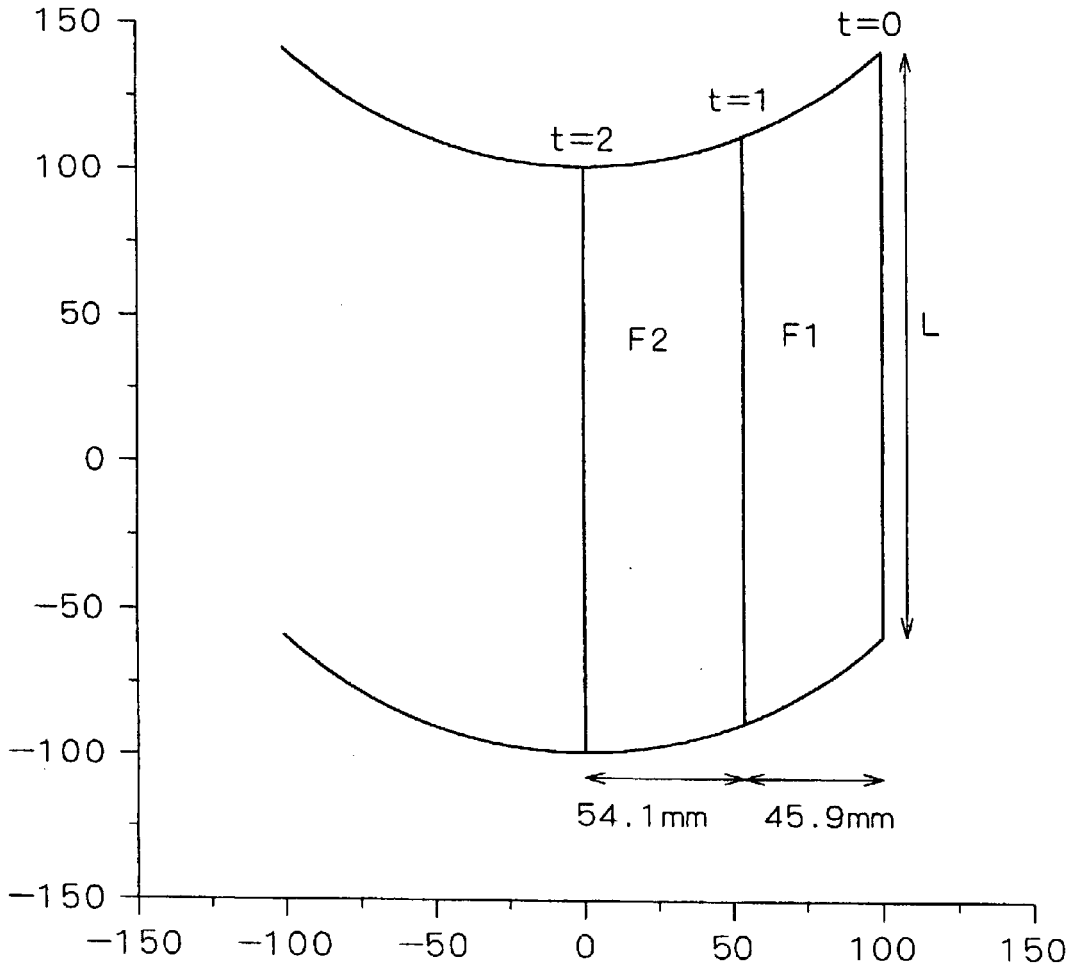
FIG. 38 is a diagram showing the area that the rinsing liquid supply nozzle will pass through per unit time.

FIG. 38 shows an area that the rinsing liquid supply nozzle 740 passes through per unit time.

F1 represents an area that the nozzle 740 passes through for the first one second, and F2 represents an area that the nozzle 740 passes through for the second one second. Letting L be the length of the nozzle 740, F1 and F2 can be expressed as:

$$F1 \approx 45.9 \times L(\mathrm{mm}^2)$$
$$F2 \approx 54.1 \times L(\mathrm{mm}^2) \quad (9)$$

For example if 100 cc of a rinsing liquid is discharged in one second, it is apparent that F1 has a larger amount of a rinsing liquid per unit area than F2.

Substituting the equation (8) into the equation (7) on condition that the equations (7) and (8) are true and differentiating the value x with respect to the time t, we obtain the relative velocity component of the rinsing liquid supply nozzle 740, which can be expressed by the following equation:

$$\frac{dx}{dt} = \frac{dx}{d\theta} \cdot \frac{d\theta}{dt} = -\frac{2\pi r}{T}(\cos\theta + \sin\theta) \quad (10)$$

By taking on the absolute value of the calculated value of the equation (10), the relative velocity component of the nozzle 740 in the virtual scanning direction La of the wafer SW can be obtained.

Figure 39:
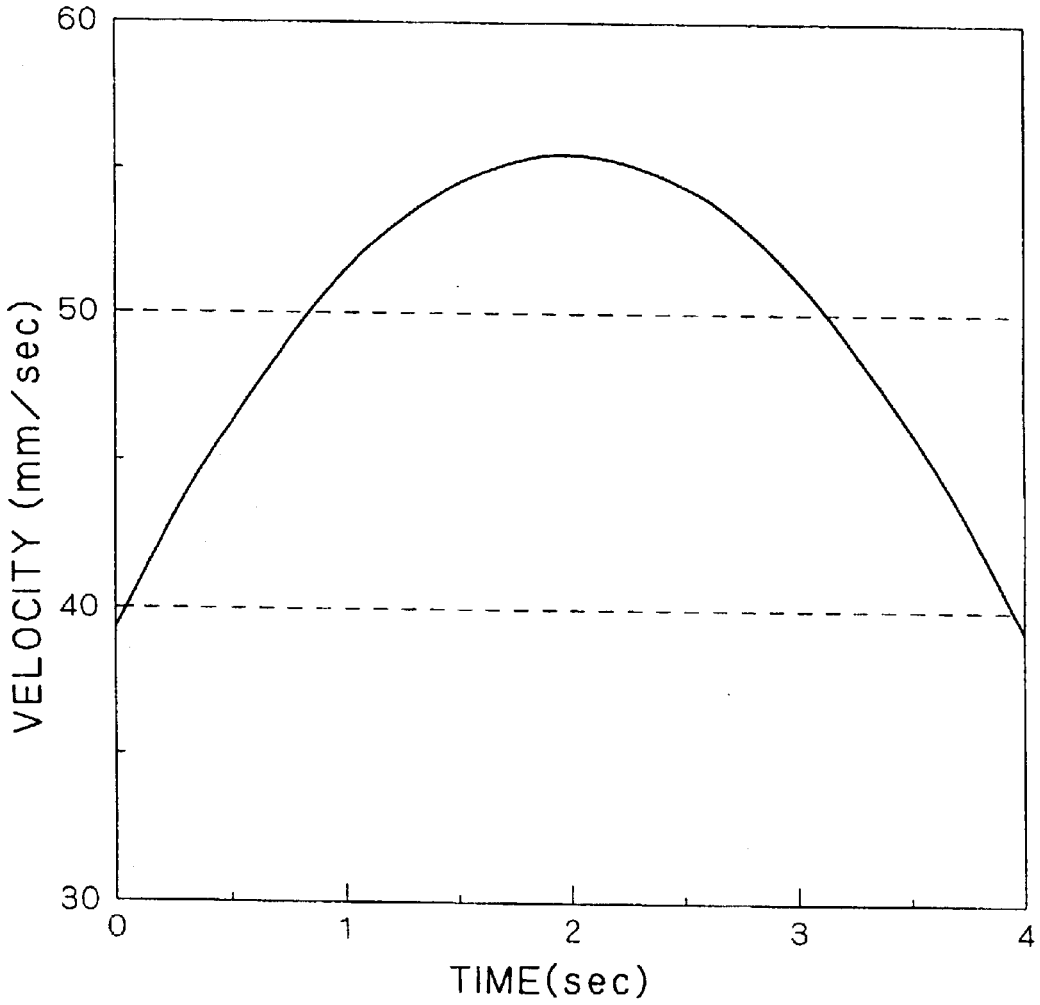
FIG. 39 is a diagram showing the variation in the relative velocity component of the rinsing liquid supply nozzle in the virtual scanning direction of the semiconductor wafer.

FIG. 39 is a diagram showing the relative velocity of the nozzle 740 with respect to the wafer SW where T=16 sec.

As shown in this drawing, two seconds after the start of rotation, i.e., when the nozzle 740 is rotated by π/4 radians, the speed becomes maximum, 55.5 mm/sec. On the other hand, at the start and the end of rotation of the nozzle 740 and the wafer SW, the speed becomes minimum, 39.3 mm/sec. With this difference in speed, the amount of a rinsing liquid discharged on the wafer SW along the virtual scanning direction La is the smallest at the central portion of the wafer SW and the largest at the supply start and end points. To avoid such nonuniformity, the relative velocity component of the nozzle 740 with respect to the wafer SW along the virtual scanning direction La needs to be constant. The conditions required therefor are as follows:

In the present case, the nozzle 740 should be moved with a constant velocity during the time when it passes over the wafer SW from end to end.

Where the nozzle 740 and the wafer SW are rotated with the same angular velocity (θ=θ') and let T" be the time required for the nozzle 740 and the wafer SW to make one rotation, the time required for the nozzle 740 to pass over the wafer SW can be expressed as T"/4. That is, the nozzle 740 should be moved a distance 2r corresponding to the diameter of the wafer SW, within the time T"/4 with a constant velocity.

The relative velocity component v, of the nozzle 740 with respect to the wafer SW along the virtual scanning direction La can be expressed by the following equation:

$$v_x = \frac{2\pi}{T''/4} = \frac{8r}{T''} \tag{11}$$

When the nozzle 740 is moved with the velocity component $v_x$, the position of the nozzle 740 after t seconds can be expressed as:

$$x = r - \frac{8r}{T''}t \tag{12}$$

Since the value x in the equation (12) and the value x in the equation (7) should be equal, from the equations (7) and (12), the following equation is true:

$$r(\cos\theta - \sin\theta) = r - \frac{8r}{T''}t \tag{13}$$

$$\therefore \cos\theta - \sin\theta = 1 - \frac{8}{T''}t$$

The use of a formula of the trigonometric function for the left side of the equation (13) gives:

$$\sqrt{2}\cos\theta\left(\theta + \frac{\pi}{4}\right) = 1 - \frac{8}{T''}t \tag{14}$$

From the equation (14), the angle θ can be expressed as:

$$\theta = -\frac{\pi}{4} + \cos^{-1}\left(\frac{1 - \frac{8}{T''}t}{\sqrt{2}}\right) \tag{15}$$

Figure 40:
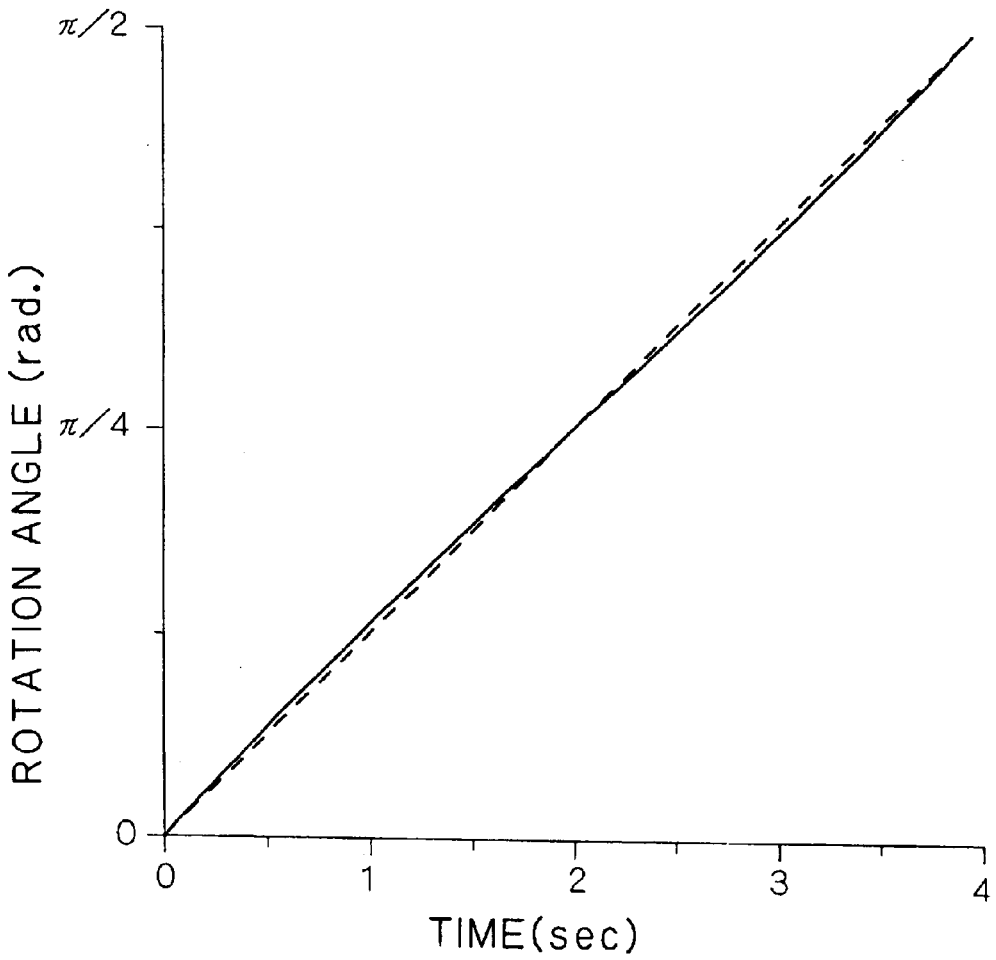
FIG. 40 is a diagram showing the relationship between the time elapsed since the start of rotation and the rotation angle.

FIG. 40 shows the relationship between the time t and the rotation angle θ where T"=16 sec. In the drawing, the dotted line indicates the relationship in the case of a constant angular velocity, and the solid line indicates the relationship in the case where the angular velocity is controlled according to the equation (15).

When the angular velocity is controlled to satisfy the equation (15), the relative velocity component $v_x$ of the nozzle 740 with respect to the wafer SW in the virtual scanning direction La of the wafer SW becomes constant.

Especially, if the relative velocity component of the aforementioned rinsing liquid supply nozzle 140 in the virtual scanning direction La and the velocity of the developer supply nozzle 120 when moving over the substrate W (for example in the following preferred embodiment, the relative velocity component of the developer supply nozzle 220 in the virtual scanning direction La) have substantially the same constant velocity pattern, the timing of termination of the development can be made the same at each point in the plane of the substrate W and also the amount of the supply of a rinsing liquid can be made approximately uniform.

<B4. Relative Positions of Center of Rotation of Rinsing Liquid Supply Nozzle and Semiconductor Wafer>

We will now consider the relative positions of the center of rotation of the rinsing liquid supply nozzle 740 and the semiconductor wafer SW.

In FIGS. 41, 42, 43 and 44, in a coordinate system in which the horizontal axis is the virtual scanning direction La of the rotating semiconductor wafer SW and the longitudinal axis is a direction orthogonal to the x axis, the wafer SW having a diameter of 200 mm is located such that its center of rotation coincides with the origin point (0, 0).

First, the case where the center of rotation of the rinsing liquid supply nozzle 740 is located outside the square S circumscribing the semiconductor wafer SW is shown below.

Figure 41:
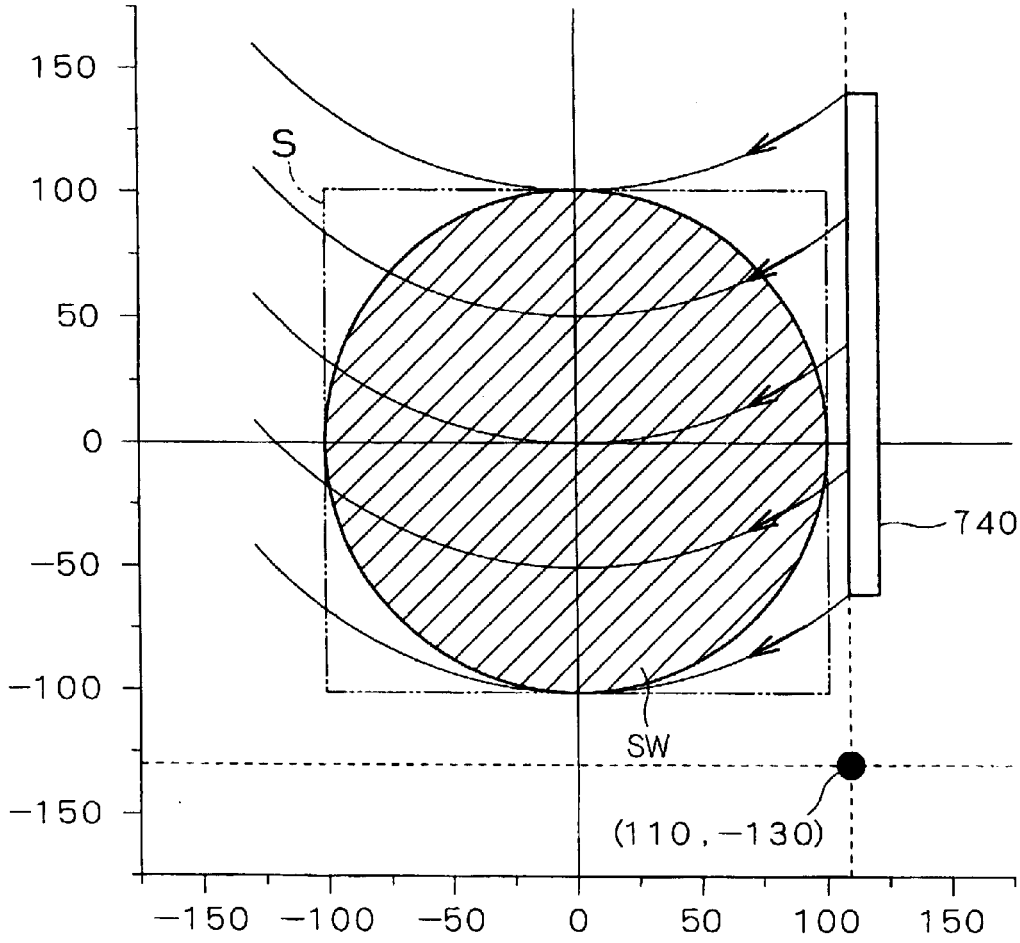
FIGS. 41 to 44 are diagrams showing the locus of the rinsing liquid supply nozzle passing over the semiconductor wafer.

More specifically, the case where, as shown in FIG. 41, the center of rotation of the nozzle 740 has the coordinates (110, −130) is shown below.

In this case, the nozzle 740 moves along an arc in the form of a strip over the wafer SW and when the wafer SW and the nozzle 740 are rotated approximately 80 degrees, the nozzle 740 can pass over the whole surface of the wafer SW. The arc-shaped curves in FIG. 41 represent the locus of the nozzle 740 when the wafer SW and the nozzle 740 are both rotated 90 degrees.

From this, it can be said that, when the center of rotation of the rinsing liquid supply nozzle 740 is located outside the square S circumscribing the semiconductor wafer SW, the rinsing liquid supply nozzle 740 can pass over the whole surface of the semiconductor wafer SW.

Next, the case where the center of rotation of the rinsing liquid supply nozzle 740 is located inside the square S circumscribing the semiconductor wafer SW and outside the semiconductor wafer SW is shown below.

Figure 42:
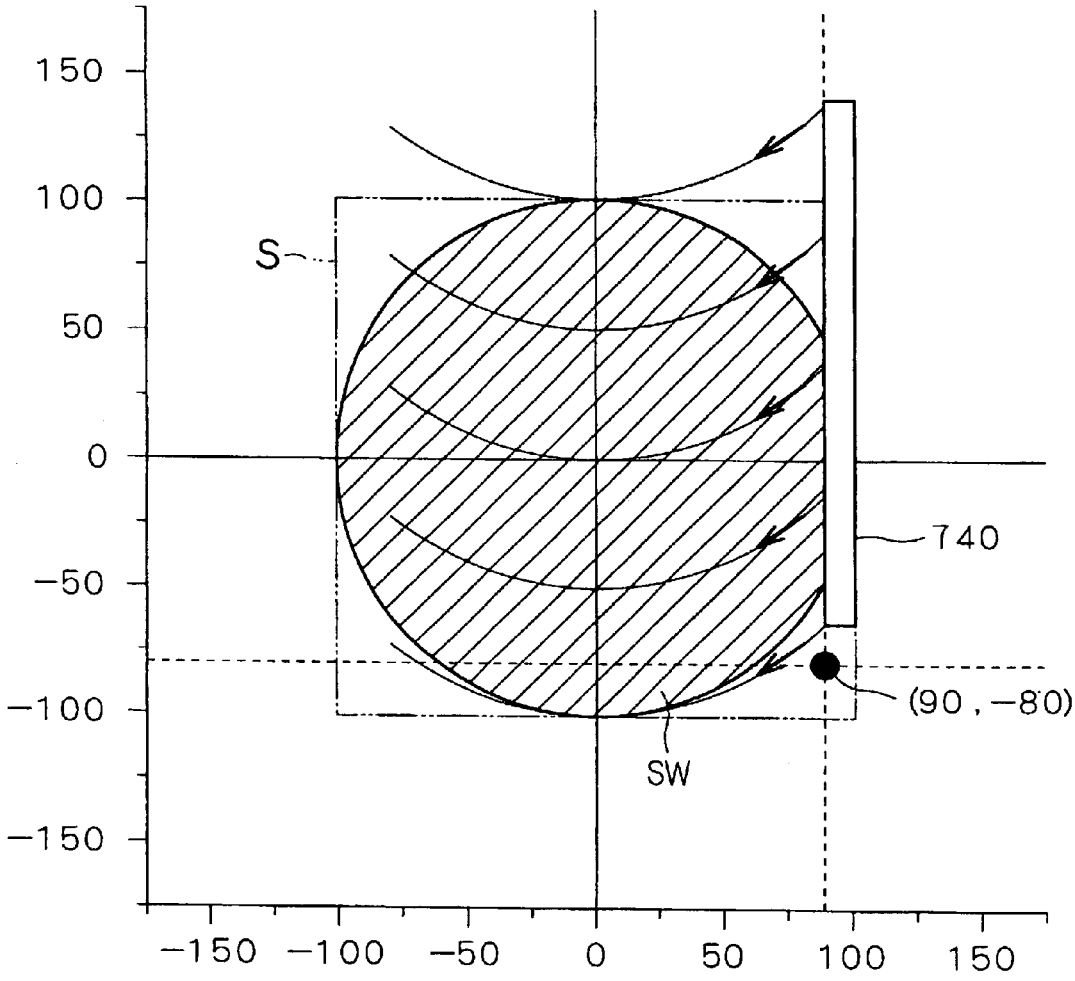
Figure 43:
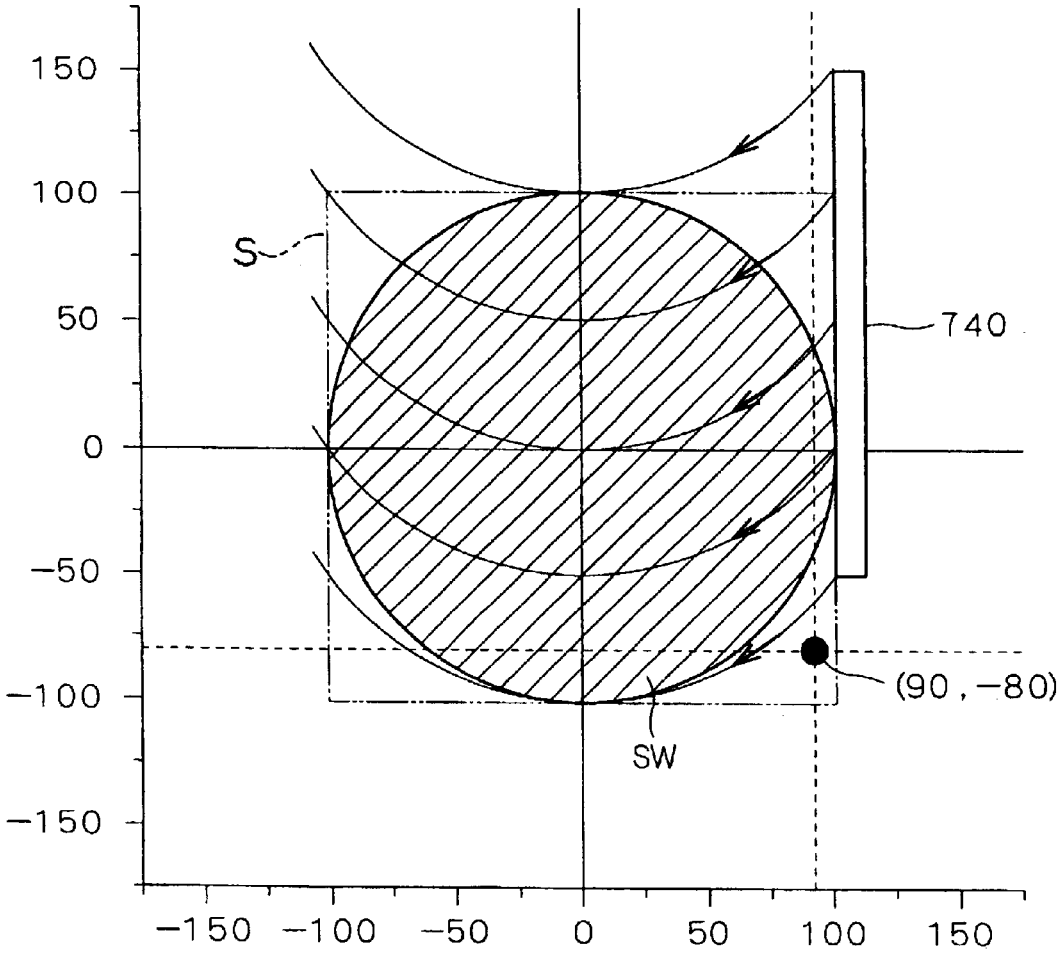

More specifically, the case where, as shown in FIGS. 42 and 43, the center of rotation of the rinsing liquid supply nozzle 740 has the coordinates (90, −80) is shown below.

FIG. 42 shows the locus of the nozzle 740 when the wafer SW and the nozzle 740 are both rotated 90 degrees, and FIG. 43 shows the locus of the nozzle 740 when the wafer SW and the nozzle 740 are both rotated 113 degrees.

As shown in these drawings, only 90 degrees of rotation of the wafer SW and the nozzle 740 does not allow the nozzle 740 to pass over the whole surface of the wafer SW, and the nozzle 740 is stopped on the way. To allow the nozzle 740 to pass over the whole surface of the wafer SW, it is necessary to rotate both the wafer SW and the nozzle 740 at 113 degrees.

Next, the case where the center of rotation of the rinsing liquid supply nozzle 740 is located inside the semiconductor wafer SW is shown below.

Figure 44:
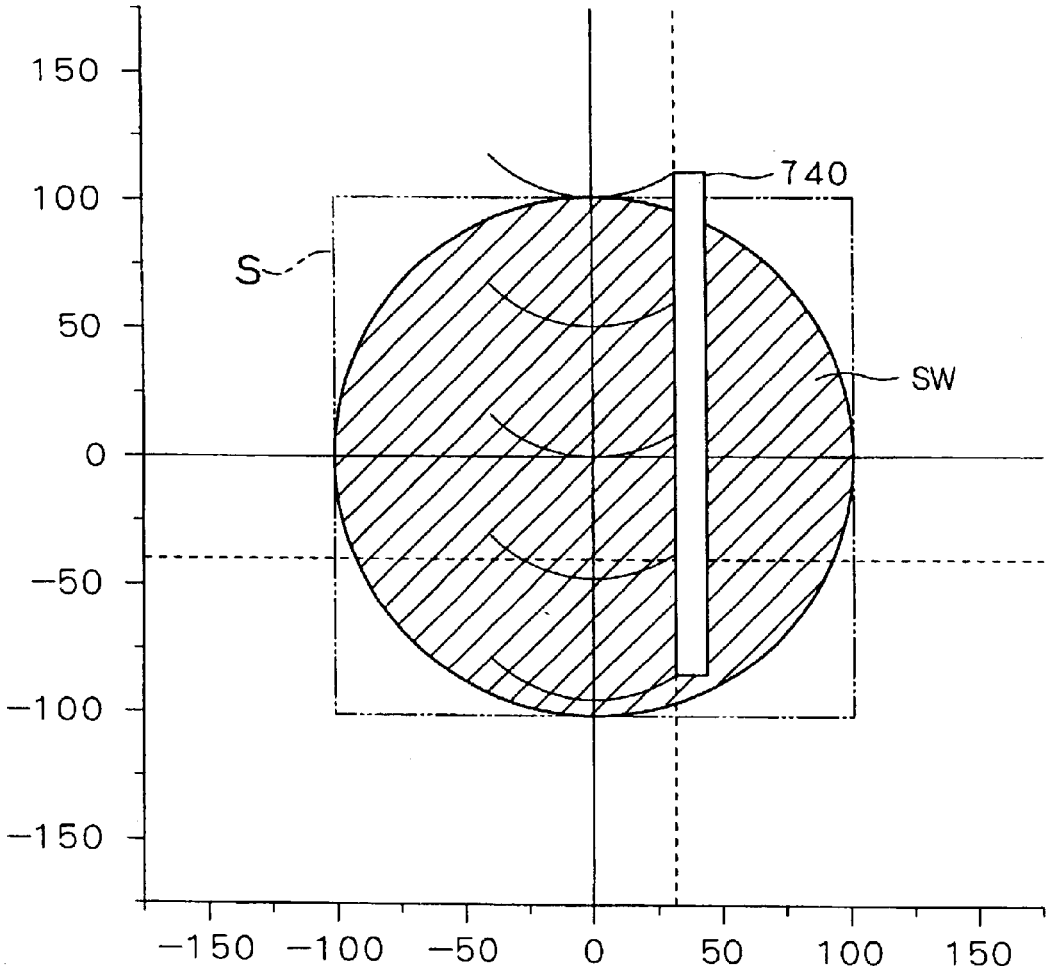

More specifically, the case where, as shown in FIG. 44, the center of rotation of the nozzle 740 has the coordinates (30, −40) is shown below.

The arc-shaped curves in this drawing represent the locus of the nozzle 740 when the wafer SW and the nozzle 740 are both rotated 90 degrees. In this case, it can be found that the nozzle 740 cannot pass over the whole surface of the wafer SW.

When the center of rotation of the nozzle 740 is located inside the wafer SW, however long the nozzle 740 and however great the rotation angle thereof, it is impossible in principle for the nozzle 740 to pass over the whole surface of the wafer SW as long as the wafer SW and the nozzle 740 are rotated with the same rotational speed.

An explanation therefor is given below.

If the center of rotation of the nozzle 740 has the coordinates ($x_1$, $y_1$) and the angular velocities of the nozzle 740 and the wafer SW are equal, i.e., θ=θ', the equation (5) can be rewritten as follows:

$$\begin{cases} x = x_1\cos\theta - y_1\sin\theta \\ y = r' - x_1\cos\theta - y_1\sin\theta \end{cases} \quad (16)$$

where $$\theta = \frac{2\pi}{T}t$$

The use of a composite formula of the trigonometric function for the value x in the equation (16) gives:

$$x = \sqrt{x_1^2 + y_1^2} \cdot \sin(\theta + \varphi) \quad (17)$$

where $$\tan\varphi = y_1 / x_1$$

Where the radius of the wafer SW is 100 mm and when the nozzle 740 scans the wafer SW from the outside, the value x should be equal to or greater than 100. That is, the following equation has to be true:

$$\sqrt{x_1^2 + y_1^2} \geq 100 \quad (18)$$

From the equation (18), it is found that the center of rotation of the nozzle 740 should be located outside a circle having a radius of 100 mm.

In summary, in order to allow the rinsing liquid supply nozzle 740 to pass over the whole surface of the wafer SW and to supply a rinsing liquid as uniformly as possible onto the semiconductor wafer SW, the following three points should preferably be satisfied:

Firstly, the semiconductor wafer SW and the rinsing liquid supply nozzle 740 should be rotated simultaneously and with the same angular velocity.

Secondly, the respective angular velocities of the semiconductor wafer SW and the rinsing liquid supply nozzle 740 should be controlled. For example, when the rotation axis of the rinsing liquid supply nozzle 740 is located at one vertex of the square S circumscribing the semiconductor wafer SW, the angular velocities should be controlled to satisfy the above equation (15).

Thirdly, the center of rotation of the rinsing liquid supply nozzle 740 should be located outside the semiconductor wafer SW.

The contents described for the relative positions of the semiconductor wafer and the nozzle is also applicable to the aforementioned second preferred embodiment and each of the other preferred embodiments described below.

Fourth Preferred Embodiment

In this fourth preferred embodiment, a developing apparatus will be described which is configured to rotate both the developer supply nozzle and the rinsing liquid supply nozzle.

Figure 45:
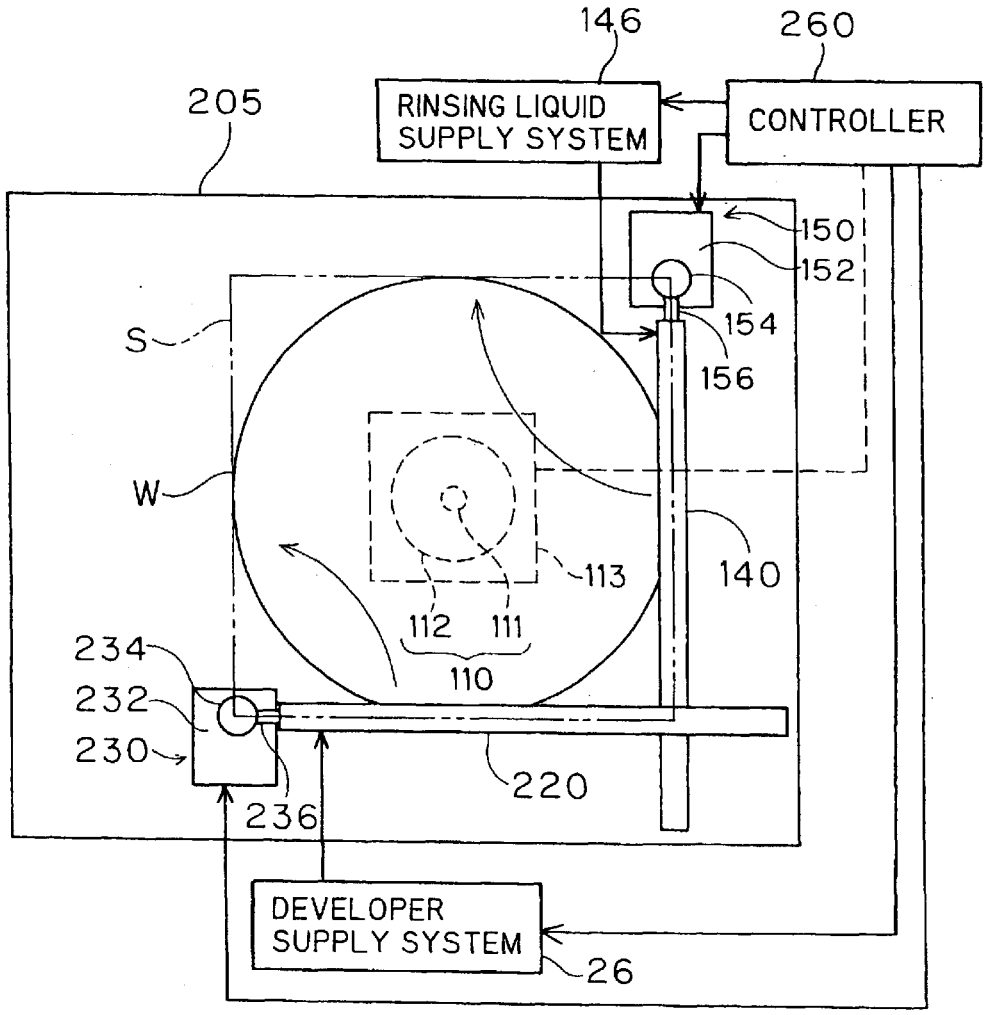
FIG. 45 is a schematic plan view showing a developing apparatus according to a fourth preferred embodiment of the present invention.

FIG. 45 is a plan view showing a schematic configuration of the developing apparatus according to the fourth preferred embodiment of the present invention.

The parts, which are identical to those of the developing apparatus shown in the second preferred embodiment, are referred to by the same reference numerals and not described here.

This developing apparatus comprises the substrate holder 110, a developer supply nozzle 220, a first nozzle movement mechanism 230 which is a developer supply nozzle rotating section for rotating the developer supply nozzle 220, the rinsing liquid supply nozzle 140, the second nozzle movement mechanism 150 for rotating the rinsing liquid supply nozzle 140, and a controller 260 for controlling the operation of the entire apparatus.

The developer supply nozzle 220 has a discharge unit for discharging a processing liquid with a discharge width substantially equal to or greater than the width of the substrate W.

In the present example, the developer supply nozzle 220 is identical in configuration to the rinsing liquid supply nozzle 40 described in the first preferred embodiment.

The developer supply nozzle 220 is coupled to the developer supply system 26 which comprises a developer supply source for storing a developer and an on-off valve (both not shown), whereby a developer from the developer supply source is supplied to the developer supply nozzle 220 in a predetermined timed relationship with the opening and closing of the on-off valve.

The first nozzle movement mechanism 230 rotatably supports one end of the developer supply nozzle 220 and rotates the developer supply nozzle 220 so that the nozzle 220 passes over the substrate W.

More specifically, the first nozzle movement mechanism 230 comprises a nozzle rotary driver 232, a rotary shaft 234, and a support arm 236.

The rotary shaft 234 is freely rotatable on one vertex of the virtual square S circumscribing the substrate W, the vertex being diagonally opposed to the rotary shaft of the second nozzle movement mechanism 150.

The nozzle rotary driver 232 consists of an actuator such as a spinning motor. Driven by this nozzle rotary driver 232, the rotary shaft 234 is rotated.

The support arm 236 is fixedly coupled at its one end to the rotary shaft 234 and is supported in a cantilever manner above an apparatus body 205. On a free end of the support arm 236, the developer supply nozzle 220 is supported in an approximately horizontal position.

Driven by the nozzle rotary driver 232, the developer supply nozzle 220 is rotated on a rotation axis of the rotary shaft 234 over the substrate W. In passing over the substrate W, the developer supply nozzle 220 discharges a developer from its discharge unit so that a developer is supplied onto the major surface of the substrate W.

The controller 260, like the controller 60, consists of a general microcomputer and controls a sequence of operations next to be described. It performs at least an act of rotating the substrate W, the developer supply nozzle 220 and the rinsing liquid supply nozzle 140 so that the virtual scanning direction La from the supply start point on one end of the substrate W to the supply end point on the other end is substantially perpendicular to directions of extension of the discharge units of the developer supply nozzle 220 and the rinsing liquid supply nozzle 140.

Now, the operation of this developing apparatus will be described with reference to FIGS. 46 to 48.

Figure 46:
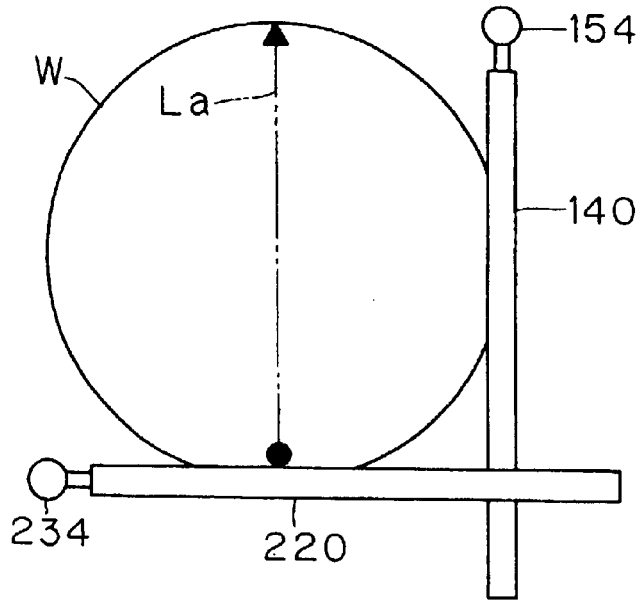
FIG. 46 is an explanatory diagram showing an initial state of the developing apparatus according to the fourth preferred embodiment.

First, in an initial state, as shown in FIG. 46, the substrate W is supported at rest in a horizontal position by the substrate holder 110. In FIGS. 46 to 48, the supply start point on one end of the substrate W is shown with a closed circle and the supply end point on the other end with a closed triangle, and the virtual scanning direction La from the supply start point to the supply end point is indicated by a dash-double dot line. In the initial state, the substrate W is supported such that its supply start point is on one end of the apparatus body 205 (on the bottom side of FIG. 46).

The developer supply nozzle 220 is on standby in a position to circumscribe the substrate W and to face the supply start point. The rinsing liquid supply nozzle 140 is on standby in a position to circumscribe the substrate W and to be orthogonal to the developer supply nozzle 220. This position of the rinsing liquid supply nozzle 140 is a position to face the supply start point of the substrate W after the supply of a developer as will later be described.

Figure 47:
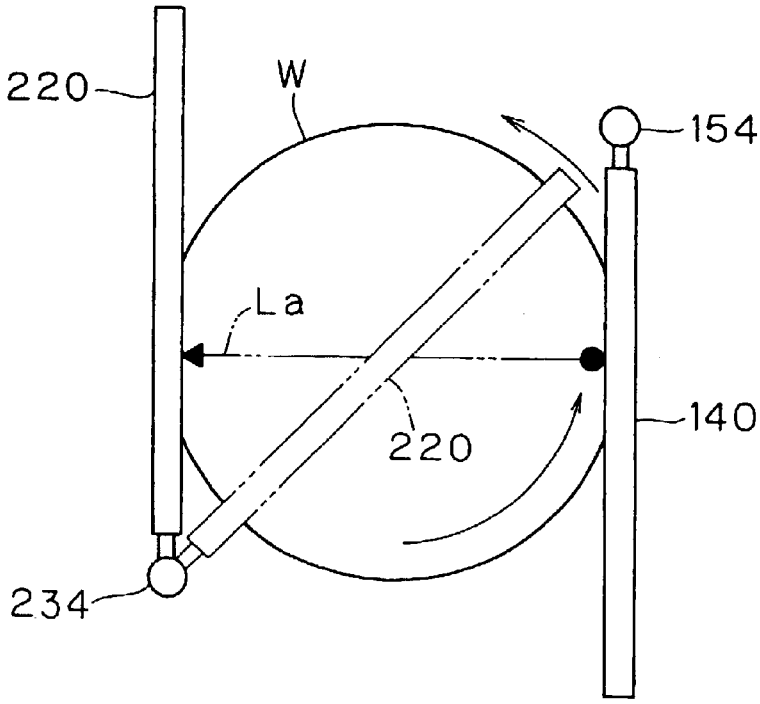
FIG. 47 is an explanatory diagram showing the developing apparatus according to the fourth preferred embodiment when supplying a developer.

After the initiation of processing, as shown in FIG. 47, the developer supply nozzle 220 is rotated in a second rotational direction to pass over the major surface of the substrate W. In response to this, the substrate W is rotated in the second rotational direction so that its virtual scanning direction La is orthogonal to a direction of extension of the developer supply nozzle 220. That is, the substrate W and the developer supply nozzle 220 are rotated with substantially the same rotational speeds.

In passing over the major surface of the substrate W, the developer supply nozzle 220 discharges a developer so that a developer is supplied sequentially onto the entire major surface of the substrate W along the virtual scanning direction La. At this time, the path of movement of the developer supply nozzle 220 with respect to the substrate W is described as an arc. Thereby a developer layer is formed on the major surface of the substrate W.

After counterclockwise rotation of $\pi/2$ radians over the major surface of the substrate W, the developer supply nozzle 220 is brought to its standby state on the other end of the apparatus body 205.

Since, in this condition, the substrate W and the developer supply nozzle 220 rotate with substantially the same rotational speeds, the substrate W is also rotated to the left by $\pi/2$ radians. Thus, the supply start point of the substrate W is shifted to one end of the apparatus body 205 (on the right side of FIG. 47) to face the rinsing liquid supply nozzle 140.

Figure 48:
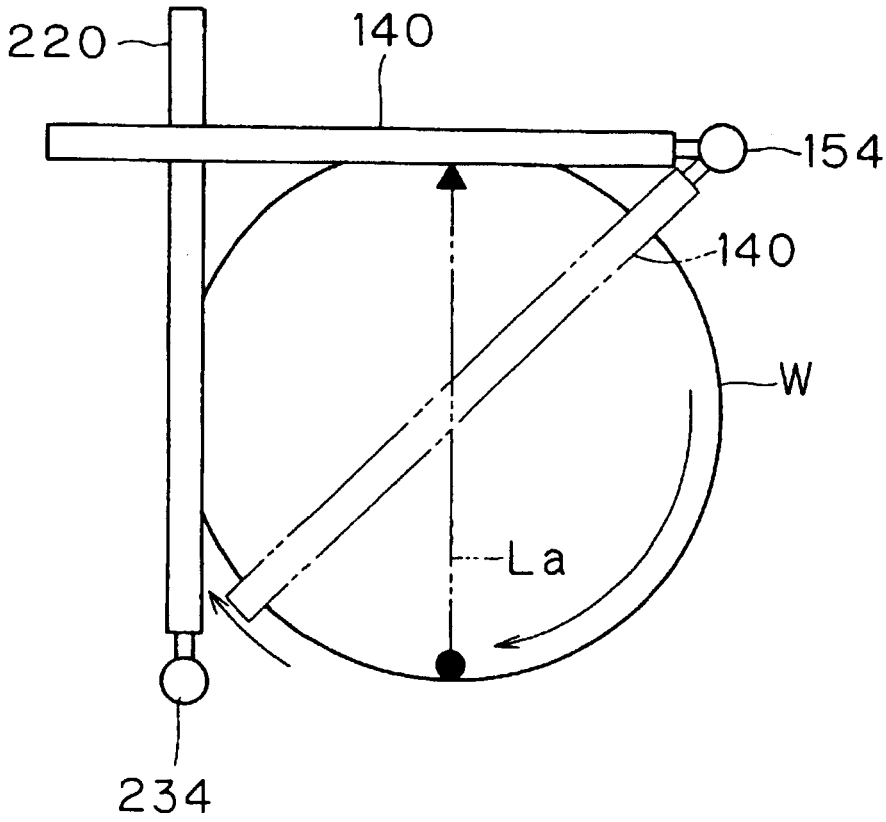
FIG. 48 is an explanatory diagram showing the developing apparatus according to the fourth preferred embodiment when supplying a rinsing liquid.

After the supply of a developer to the substrate W and after the elapse of a predetermined time required for development reactions on the substrate W, as shown in FIG. 48, the rinsing liquid supply nozzle 140 is rotated in a first rotational direction to pass over the major surface of the substrate W (i.e., over the developer layer formed on the major surface of the substrate W). In response to this, the substrate W is rotated in the first rotational direction so that its virtual scanning direction La is orthogonal to a direction of extension of the rinsing liquid supply nozzle 140. That is, the substrate W and the rinsing liquid supply nozzle 140 are rotated with substantially the same rotational speed.

In passing over the substrate W, the rinsing liquid supply nozzle 140 discharges a rinsing liquid so that a rinsing liquid is supplied sequentially to the entire major surface of the substrate W along the virtual scanning direction La. At this time, the path of movement of the rinsing liquid supply nozzle 140 with respect to the substrate W is described as an arc.

After clockwise rotation of $\pi/2$ radians over the major surface of the substrate W, the rinsing liquid supply nozzle 140 is brought to its standby state on the other end of the substrate W. Since the substrate W rotates with the same rotational speed as the rinsing liquid supply nozzle 140, the substrate W is also rotated to the right by $\pi/2$ radians.

In this way, a sequence of operations of the developing apparatus is completed.

Now, the movement of the developer supply nozzle 220 and the rinsing liquid supply nozzle 140 relative to the substrate W will be described.

Figure 49:
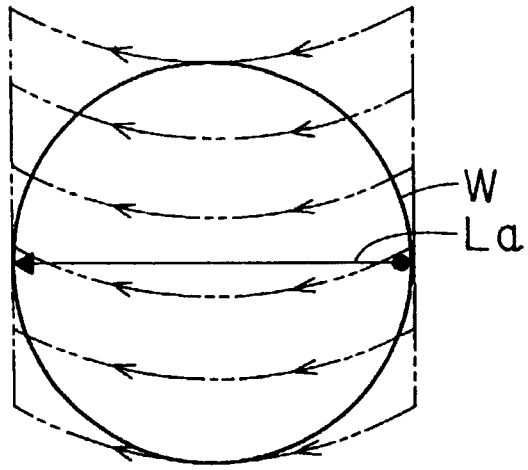
FIG. 49 is an explanatory diagram showing the path of movement of the developer supply nozzle relative to a substrate.
Figure 50:
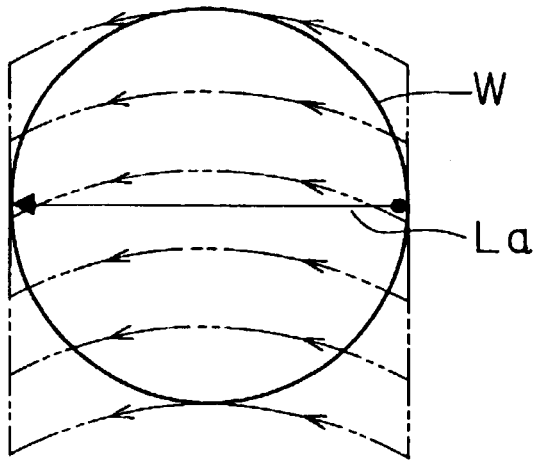
FIG. 50 is an explanatory diagram showing the path of movement of the rinsing liquid supply nozzle relative to a substrate.

FIG. 49 is an explanatory diagram showing the path of movement of the developer supply nozzle 220 relative to the substrate W, and FIG. 50 is an explanatory diagram showing the path of movement of the rinsing liquid supply nozzle 140 relative to the substrate W. Both the drawings show the paths of movement in the case where the substrate W, the developer supply nozzle 220 and the rinsing liquid supply nozzle 140 are rotated such that directions of extension of the developer supply nozzle 220 and the rinsing liquid supply nozzle 140 are substantially orthogonal to the virtual scanning direction La of the substrate W.

As shown in the drawings, both the developer supply nozzle 220 and the rinsing liquid supply nozzle 140 are moved nonlinearly but their paths of movement are different from each other.

That is, as shown in FIG. 49, the developer supply nozzle 220 moves in the virtual scanning direction La of the substrate W along an arc that is curved toward one side of the virtual scanning direction La (upwardly of the virtual scanning direction La). On the other hand, the rinsing liquid supply nozzle 140 moves in the virtual scanning direction along an arc that is curved toward the other side of the virtual scanning direction La (downwardly of the virtual scanning direction La).

The developing apparatus of the above configuration can give an effect similar to that described in the second preferred embodiment on the supply of a developer and a rinsing liquid.

Besides, since the rinsing liquid supply nozzle 140 after the supply of a developer is located in a position to face the supply start point of the substrate W, the supply of a rinsing liquid can be started immediately after the supply of a developer without rotation of the substrate W. This smoothes the development processing.

It is to be noted that the locations and initial positions of the rotation axes of the developer supply nozzle 220 and the rinsing liquid supply nozzle 140 are not limited to what has been particularly shown and described hereinabove.

In summary, after rotational movement of the developer supply nozzle 220, the rinsing liquid supply nozzle 140 should be disposed in face-to-face relationship with the supply start point of the substrate W.

In viewing such relative positions from a different view point, since the virtual scanning direction La is a direction from the supply start point of the substrate W to the supply end point, the developer supply nozzle 220 and the rinsing liquid supply nozzle 140 after the supply of a developer should be opposed to each other with the substrate W in between, and also, their respective directions of extension should be substantially parallel to each other.

While, in this preferred embodiment, the second rotational direction in which the substrate W and the developer supply nozzle 220 rotate for the supply of a developer is opposite from the first rotational direction in which the substrate W and the rinsing liquid supply nozzle 140 rotates for the supply of a rinsing liquid, the first and second rotational directions may be the same direction. For this, the original positions of the developer supply nozzle 220 and the rinsing liquid supply nozzle 140 should be changed.

Also in this preferred embodiment, in order to make the timing of termination of the development approximately the same at each point in the plane of the substrate W, it is preferable that the developer supply time during which the developer supply nozzle 220 discharges a developer from the supply start point of the substrate W to the supply end point be substantially equal to the rinsing liquid supply time during which the rinsing liquid supply nozzle 140 discharges a rinsing liquid from the supply start point of the substrate W to the supply end point. Also, if the relative velocity component of the developer supply nozzle 220 in the virtual scanning direction La and the relative velocity component of the rinsing liquid supply nozzle 140 in the virtual scanning direction La have substantially the same constant velocity pattern, the timing of termination of the development can be made the same at each point in the plane of the substrate W and also the amounts of the supply of a developer and a rinsing liquid can be made approximately uniform.

Fifth Preferred Embodiment

In this fifth preferred embodiment, a developing apparatus will be described which is configured to supply processing liquids to substrates W arranged vertically at multiple levels.

Figure 51:
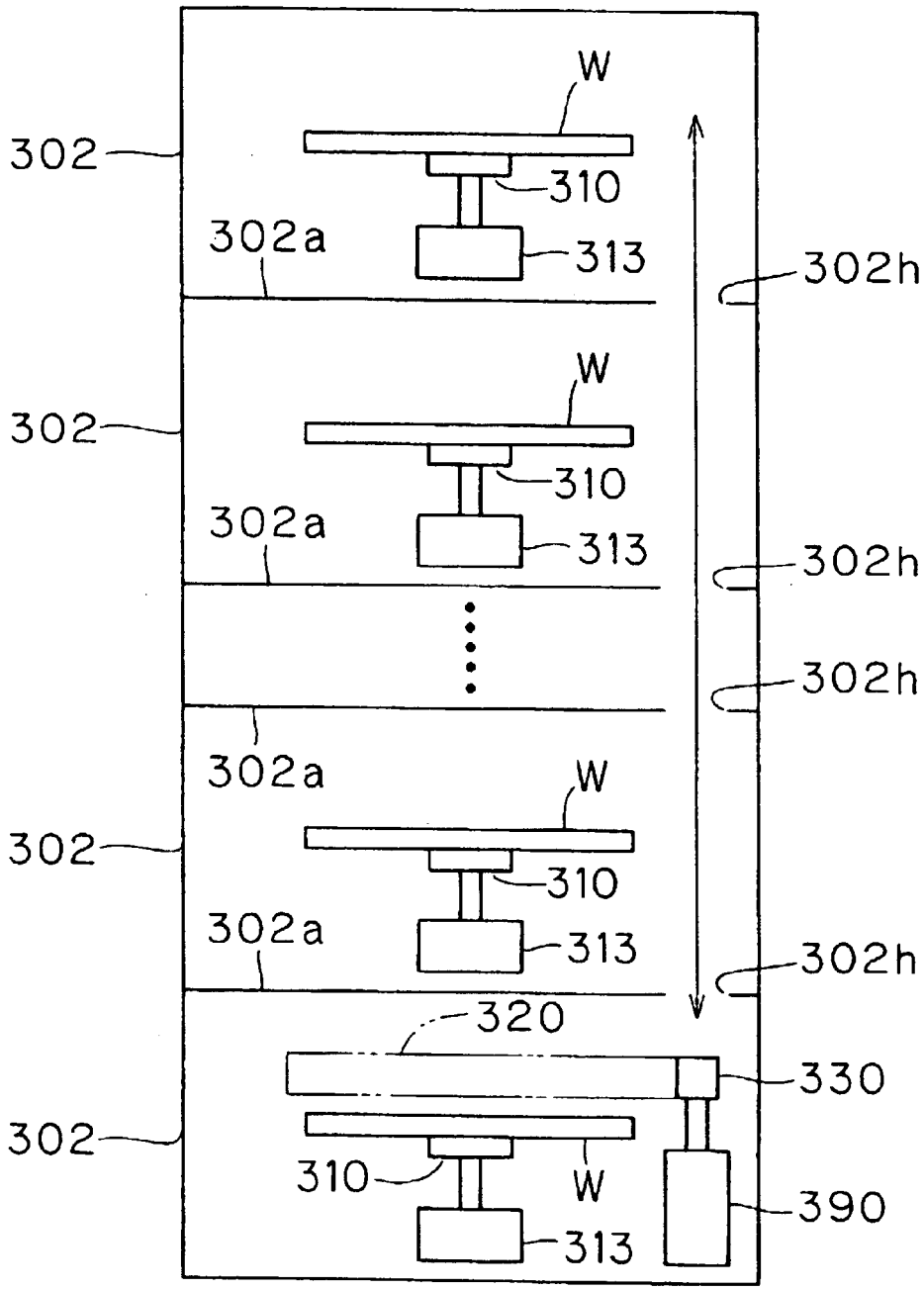
FIG. 51 is a schematic longitudinal sectional view showing a developing apparatus according to a fifth preferred embodiment of the present invention.
Figure 52:
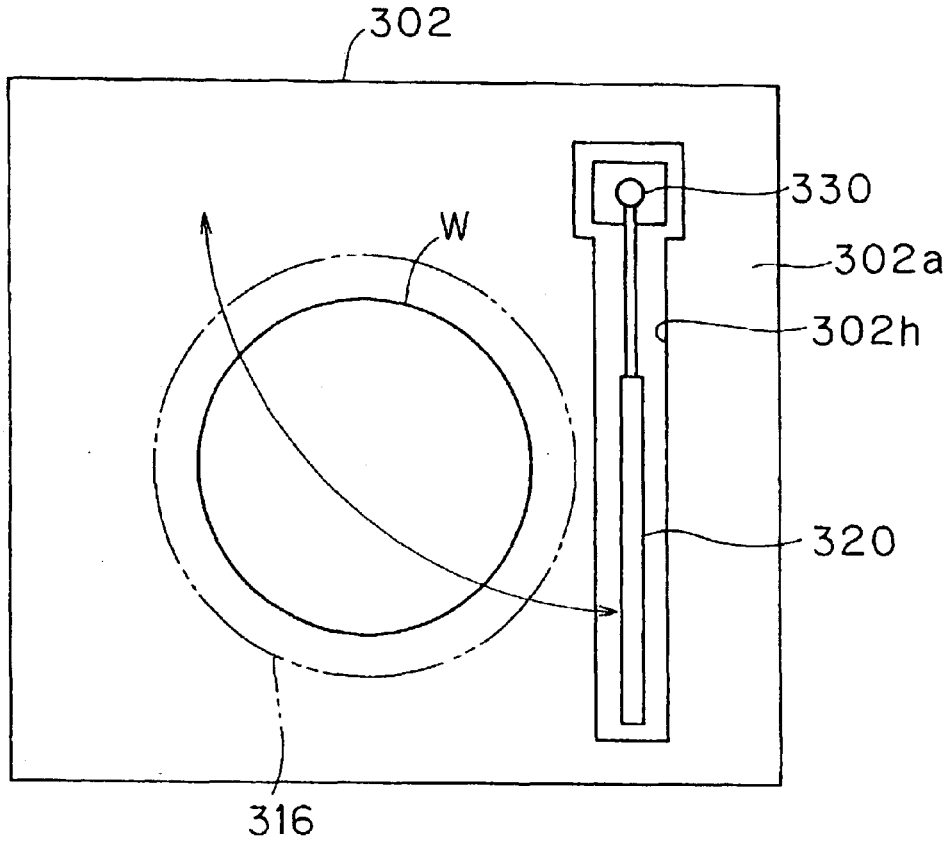
FIG. 52 is a schematic plan sectional view showing the developing apparatus according to the fifth preferred embodiment.

FIG. 51 is a longitudinal cross-sectional view showing a schematic configuration of the developing apparatus according to the fifth preferred embodiment of the present invention, and FIG. 52 is a plan sectional view showing a schematic configuration of the developing apparatus.

In this developing apparatus, a plurality of substrate holders 310 are arranged vertically at multiple levels. Each of the substrate holders 310 is identical in configuration to the substrate holder 110 described in the second preferred embodiment.

A substrate W held in an approximately horizontal position by each of the substrate holder 310 is rotated by a spinning motor 313 which is a substrate rotating section. Around the substrate W, a cup 316 is provided to prevent scattering of processing liquids.

The substrate holders 310, each of which is housed in a box-type apparatus case 302, are arranged vertically at multiple levels and partitioned with partition plates 302*a* which correspond respectively to the bottoms of the apparatus cases 302.

In the lowermost apparatus case 302, a processing liquid supply nozzle 320 is located on the side of the substrate W held by the substrate holder 310.

The processing liquid supply nozzle 320 has a discharge unit for discharging a rinsing liquid or a developer with a discharge width substantially equal to or greater than the width of the substrate W, and is identical in configuration to the rinsing liquid supply nozzle 140 of the aforementioned second preferred embodiment.

The processing liquid supply nozzle 320 is supported by a rotation mechanism 330 to be rotatable on a rotation axis on its one end. The rotation mechanism 330 is identical in configuration to the second nozzle movement mechanism 150 of the aforementioned second preferred embodiment. Thus, the processing liquid supply nozzle 320 can be rotated to pass over the substrate W.

This developing apparatus comprises a vertical movement mechanism 390 for vertically moving the processing liquid supply nozzle 320 to each position where the nozzle 320 can pass over each of the substrates W held by the substrate holders 310.

The vertical movement mechanism 390 can be implemented by, for example, a telescoping extension. It is, however, to be noted that the configuration is not limited thereto but the processing liquid supply nozzle 320 may, for example, be configured to move vertically along a vertically extending rail.

Each of the partition plates 302*a* has a through hole 302*h* through which the processing liquid supply nozzle 320 can pass.

Driven by the vertical movement mechanism 390, the processing liquid supply nozzle 320 is moved vertically through the through holes 302*h* and located in each position where the nozzle 320 can pass over each of the substrates W.

The developing apparatus according to this preferred embodiment operates as follows under the control of a controller not shown.

In this developing apparatus, driven by the vertical movement mechanism 390, the processing liquid supply nozzle 320 is moved vertically and, in each of the apparatus cases 302, makes a temporary stop in each position where the nozzle 320 can pass over each substrate W.

In this condition, the processing liquid supply nozzle 320 is rotated by the rotation mechanism 330 to pass over the substrate W at a corresponding level. At this time, a processing liquid is supplied in the same manner as described with respect to the rinsing liquid supply nozzle 140 of the second preferred embodiment.

Then, the processing liquid supply nozzle 320 returns to its original position by rotation and again moves vertically through each of the through holes 302*h* to a position where it can pass over another substrate W, and then makes a temporary stop at that position. In this stopped position, the processing liquid supply nozzle 320 again rotates to pass over the substrate W at a corresponding level and to supply a processing liquid in the same manner as above described.

Hereafter, the processing liquid supply nozzle 320, while moving vertically, performs the above operation on the substrates W at the respective levels.

This developing apparatus, therefore, can supply a processing liquid to a plurality of substrates W with only a single processing liquid supply nozzle 320. This achieves the effect of, for example, reducing the manufacturing cost.

An actual developing apparatus usually supplies both a developer and a rinsing liquid. To address this, a single processing liquid supply nozzle 320 may supply both a developer and a rinsing liquid by switching. Or, two sets of the processing liquid supply nozzles 320, the rotation mechanism 330 and the vertical movement mechanism 390 may be provided so that they respectively supply a rinsing liquid and a developer.

Sixth Preferred Embodiment

In this sixth preferred embodiment, a developing apparatus will be described which is configured to supply a processing liquid to a plurality of substrates W arranged around a rotation axis of a processing liquid supply nozzle.

Figure 53:
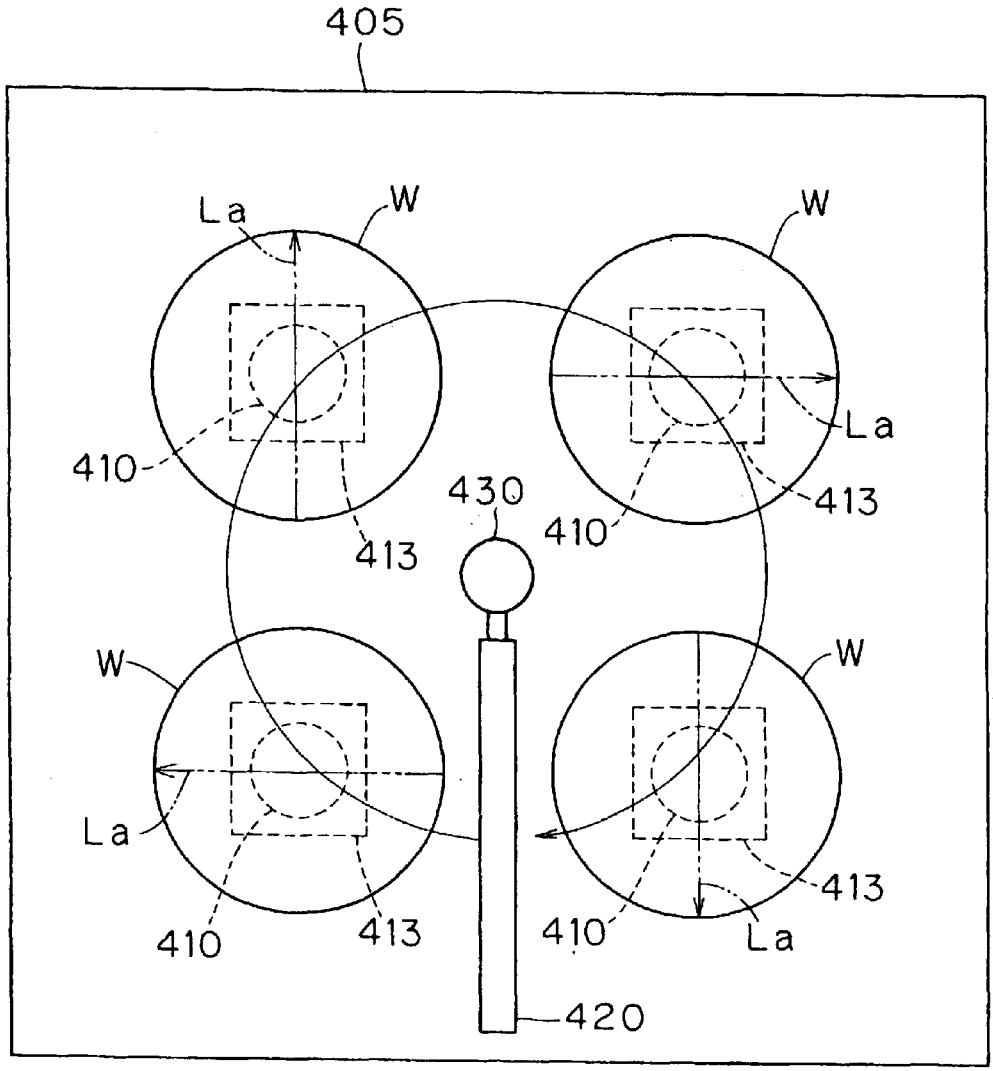
FIG. 53 is a schematic plan view showing a developing apparatus according to a sixth preferred embodiment of the present invention.

FIG. 53 is a plan view showing a schematic configuration of the developing apparatus according to the sixth preferred embodiment of the present invention.

This developing apparatus comprises a processing liquid supply nozzle 420 and a plurality of substrate holders 410.

The processing liquid supply nozzle 420 has a discharge unit for discharging a rinsing liquid or a developer with a discharge width substantially equal to or greater than the width of the substrate W and is identical in configuration to the rinsing liquid supply nozzle 140 of the aforementioned second preferred embodiment.

The processing liquid supply nozzle 420 is supported by a rotation mechanism 430 to be rotatable on a rotation axis on its one end. This rotation mechanism 430 is identical in configuration to the second nozzle movement mechanism 150 of the aforementioned second preferred embodiment and its rotation axis is located near the center of an apparatus body 405. The processing liquid supply nozzle 420 is capable of rotating through such an angle that it can successively pass over the substrates W. In the present example, the processing liquid supply nozzle 420 can be rotated by $2\pi$ radian.

The substrate holders 410 are arranged around the rotation axis of the processing liquid supply nozzle 420. In this preferred embodiment, four substrate holders 410 are spaced at intervals of $\pi/2$ radians around the rotation axis of the processing liquid supply nozzle 420. However, the number of substrate holders 410 is not limited to four but may be two, three, five, or more. In a word, the substrate holders 410 should be located nearly equidistant from the rotation axis of the processing liquid supply nozzle 420.

Each of the substrate holders 410 is individually rotated by a spinning motor 413 which is a substrate rotating section; thus, the substrates W held by the substrate holders 410 are also rotated individually.

Driven by the rotation mechanism 430, the processing liquid supply nozzle 420 is rotated to sequentially pass over the substrates W.

The developing apparatus according to this preferred embodiment operates as follows under the control of a controller not shown.

In this developing apparatus, driven by the rotation mechanism 430, the processing liquid supply nozzle 420 is rotated. When the processing liquid supply nozzle 420 rotates clockwise from its original position (a position indicating a downward direction in FIG. 53) to above one end of a first substrate W (the lower left substrate W of FIG. 53), the first substrate W starts to rotate. At this time, the rotational speeds of the substrate W and the processing liquid supply nozzle 420 are controlled so that the virtual scanning direction La of the substrate W is substantially orthogonal to a direction of extension of the processing liquid supply nozzle 420.

In passing over the substrate W, the processing liquid supply nozzle 420 discharges a processing liquid so that a processing liquid is supplied to the substrate W.

After the processing liquid supply nozzle 420 has passed over the first substrate W, rotation of the first substrate W stops.

When the processing liquid supply nozzle 420 reaches above one end of the next substrate W (the upper left substrate W of FIG. 53), this substrate W starts to rotate.

Hereafter, in a similar manner, the processing liquid supply nozzle 420 sequentially passes over the respective substrates W to supply a processing liquid to the substrates W.

This developing apparatus, therefore, can supply a processing liquid to a plurality of substrates W with only a single processing liquid supply nozzle 420. This achieves the effect of, for example, reducing the manufacturing cost.

To supply both a developer and a rinsing liquid by this developing apparatus, a single processing liquid supply nozzle 420 may supply both a developer and a rinsing liquid by switching. Or, in order to avoid interference, two sets of the processing liquid supply nozzle 420 and the rotation mechanism 430 as above described may be provided so that they respectively supply a rinsing liquid and a developer.

<Modifications>

In the present invention, by shifting the nozzles 20, 220, 320, 420, 40, 140 and 140B in a direction orthogonal to the virtual scanning direction La, the supply of processing liquids such as a developer and a rinsing liquid is made as uniform as possible along the orthogonal direction. Thus, each of the above nozzles 20, 220, 320, 420, 40, 140 and 140B is not necessarily formed with a slit discharge unit.

Figure 54:
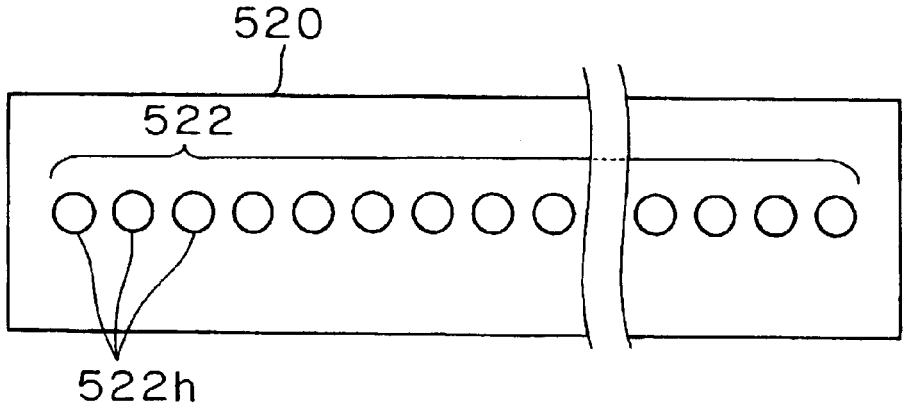
FIG. 54 is a bottom view showing a modification of a discharge unit of a nozzle.

For example, like a nozzle 520 shown in FIG. 54, a discharge unit 522 may be formed with a plurality of supply holes 522*h* which are intermittently formed along the discharge width. Also in this case, the nozzle 520 is moved while also being shifted in a direction orthogonal to the virtual scanning direction La of the substrate W; therefore, processing liquids such as a developer and a rinsing liquid can be supplied to the entire major surface of the substrate W.

In this case, the consumption of a processing liquid can be reduced as compared to the case where a processing liquid is supplied from a slit discharge unit.

In the aforementioned second to sixth preferred embodiments, especially when the stand-by positions of the nozzles 220, 320, 420, 140 and 140B are located outside the substrate(s) W, it is preferable that the time when the nozzles 220, 320, 420, 140 and 140B reach the supply start point of the substrate W from the outside of the substrate W should be synchronized as exactly as possible with the time when the substrate(s) W start(s) to rotate.

Figure 55:
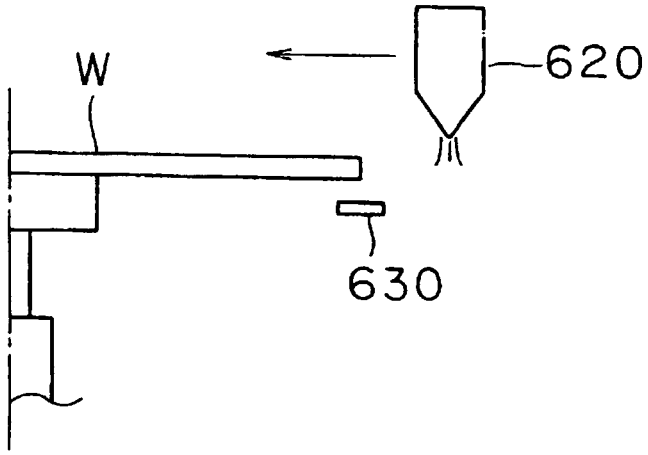
FIG. 55 is a main side view showing a modification by provision of a liquid sensor.
Figure 56:
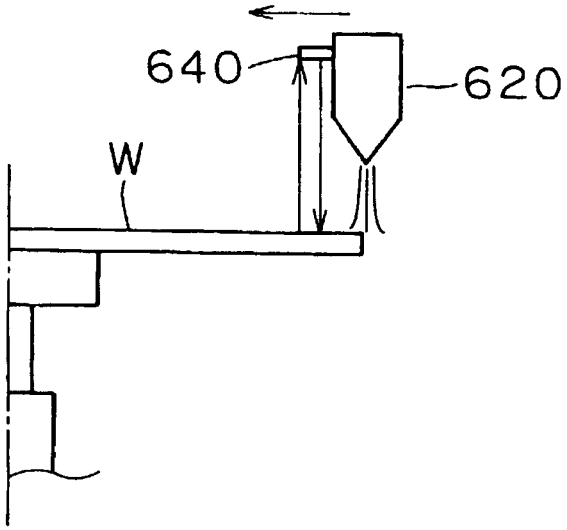
FIG. 56 is a main side view showing a modification by provision of a light sensor.

For this, as in modifications shown in FIGS. 55 and 56, a detecting unit 630 or 640 should be provided for detecting whether a nozzle 620 (corresponding to the nozzles 220, 320, 420, 140 and 140B) reaches the supply start point of the substrate W. And, when the detecting unit 630 or 640 detects that the nozzle 620 has reached the supply start point of the substrate W, rotation of the substrate W should be started.

In the modification shown in FIG. 55, a liquid sensor 630 is provided as a detecting unit under the supply start point of the initial-state substrate W.

When the nozzle 620 moves toward the supply start point of the substrate W while discharging a processing liquid such as a developer or a rinsing liquid and when the nozzle 620 reaches above the supply start point, a processing liquid is discharged almost simultaneously to the supply start point and to the liquid sensor 630. Upon detection of a processing liquid in the liquid sensor 630, with the detection signal as a trigger, the spinning motor or rotary drivers 113, 313 and 413 start rotation of the substrate W.

In the modification shown in FIG. 56, the nozzle 620 is provided with a light-reflective light sensor 640. This light sensor 640 emits light downwardly of the nozzle 620 and detects the presence or absence of the substrate W under the nozzle 620 by the presence or absence of reflected light. When the nozzle 620 moves toward the supply start point of the substrate W from the outside of the substrate W and when it reaches above the supply start point, the light sensor 640 detects reflected light and determines that the nozzle 620 has reached above the supply start point of the substrate W. With this detection signal as a trigger, the spinning motor or rotary drivers 113, 313 and 413 start rotation of the substrate W.

In those modifications shown in FIGS. 55 and 56, the timing of the movement of the nozzle 620 and the timing of the rotation of the substrate W can be exactly synchronized with each other. This allows relatively accurate control over the relative positions of the nozzle 620 and the substrate W.

While the invention has been shown and described in detail, the foregoing description is in all aspects illustrative and not restrictive. It is therefore understood that numerous modifications and variations can be devised without departing from the scope of the invention.

What is claimed is:

1. A developing apparatus for developing a thin resist film with a developer and stopping development with a rinsing liquid, said resist film being formed on a major surface of a substrate and having a predetermined pattern exposed, said developing apparatus comprising:

a substrate holder for holding a substrate;

a developer supply section for supplying a developer to a major surface of the substrate held by said substrate holder to form a developer layer on the major surface of the substrate;

a rinsing liquid supply nozzle having a rinsing liquid discharge unit for discharging a rinsing liquid with a discharge width substantially equal to or greater than a width of the substrate;

a rinsing liquid supply system for supplying a rinsing liquid to said rinsing liquid supply nozzle and causing said rinsing liquid supply nozzle to discharge a rinsing liquid from said rinsing liquid discharge unit; and a rinsing liquid supply nozzle moving section for moving said rinsing liquid supply nozzle along a line running diagonally relative to a virtual scanning direction from a supply start point on one end of the substrate held at rest by said substrate holder to a supply end point on the other end, so that said rinsing liquid supply nozzle passes over the developer layer on the major surface of the substrate in such a position that a direction along said discharge width of said rinsing liquid discharge unit is substantially perpendicular to said virtual scanning direction, wherein said rinsing liquid supply nozzle is moved from said supply start point of the substrate to said supply end point by said rinsing liquid supply nozzle moving section and is at the same time caused to discharge a rinsing liquid from said rinsing liquid discharge unit onto the developer layer by said rinsing liquid supply system.

2. The developing apparatus according to claim 1, wherein said developer supply section comprises:

a developer supply nozzle having a developer discharge unit for discharging a developer with a discharge width substantially equal to or greater than the width of the substrate;

a developer supply system for supplying a developer to said developer supply nozzle and causing said developer supply nozzle to discharge a developer from said developer discharge unit; and a developer supply nozzle moving section for moving said developer supply nozzle along a line running diagonally relative to said virtual scanning direction of the substrate held at rest by said substrate holder, so that said developer supply nozzle passes over the major surface of the substrate in such a position that a direction along said discharge width of said developer discharge unit is substantially perpendicular to said virtual scanning direction, wherein said developer supply nozzle is moved from said supply start point of the substrate to said supply end point by said developer supply nozzle moving section and is at the same time caused to discharge a developer from said developer discharge unit onto the substrate by said developer supply system.

3. A developing apparatus for developing a thin resist film with a developer and stopping development with a rinsing liquid, said resist film being formed on a major surface of a substrate and having a predetermined pattern exposed, said developing apparatus comprising:

a substrate holder for holding a substrate;

a substrate rotating section for rotating the substrate held by said substrate holder;

a developer supply section for supplying a developer to a major surface of the substrate held by said substrate holder to form a developer layer on the major surface of the substrate;

a rinsing liquid supply nozzle having a rinsing liquid discharge unit for discharging a rinsing liquid with a discharge width substantially equal to or greater than a width of the substrate;

a rinsing liquid supply system for supplying a rinsing liquid to said rinsing liquid supply nozzle and causing said rinsing liquid supply nozzle to discharge a rinsing liquid from said rinsing liquid discharge unit;

a rinsing liquid supply nozzle rotating section for supporting one end of said rinsing liquid supply nozzle so that said rinsing liquid supply nozzle is rotatable on a rotation axis outside the substrate held by said substrate holder, and rotating said rinsing liquid supply nozzle so that said rinsing liquid supply nozzle passes over the substrate held by said substrate holder; and a controller for controlling said substrate rotating section, said rinsing liquid supply system and said rinsing liquid supply nozzle rotating section so that the substrate held by said substrate holder is rotated in a first rotational direction by said substrate rotating section, and so that said rinsing liquid supply nozzle, while being rotated in said first rotational direction to pass over the developer layer formed on the major surface of the substrate being rotated, discharges a rinsing liquid from said rinsing liquid discharge unit to supply a rinsing liquid from a supply start point on one end of the substrate to a supply end point on the other end.

4. The developing apparatus according to claim 3, wherein said controller controls said substrate rotating section and said rinsing liquid supply nozzle rotating section so that a virtual scanning direction from said supply start point of the substrate to said supply end point is substantially perpendicular to a direction along said discharge width of said rinsing liquid discharge unit.

5. The developing apparatus according to claim 3, wherein said developer supply section comprises:

a developer supply nozzle having a developer discharge unit for discharging a developer with a discharge width substantially equal to or greater than a width of the substrate;

a developer supply system for supplying a developer to said developer supply nozzle and causing said developer supply nozzle to discharge the developer from said developer discharge unit; and a developer supply nozzle moving section for linearly moving said developer supply nozzle so that said developer supply nozzle passes over the substrate held by said substrate holder, and said controller controls said developer supply system and said developer supply nozzle moving section so that said developer supply nozzle, while being moved linearly to pass over the substrate held at rest by said substrate holder, discharges a developer from said developer discharge unit to supply a developer from said supply start point of the substrate to said supply end point.

6. The developing apparatus according to claim 5, wherein control of said controller is made such that a developer supply time during which said developer supply nozzle discharges a developer from said supply start point of a substrate to said supply end point is substantially equal to a rinsing liquid supply time during which said rinsing liquid supply nozzle discharges a rinsing liquid from said supply start point of the substrate to said supply end point.

7. The developing apparatus according to claim 5, wherein control of said controller is made such that a velocity of said developer supply nozzle when moving over the substrate and, out of relative velocity components of said rinsing liquid supply nozzle with respect to said substrate being rotated by said substrate rotating section, a relative velocity component in a virtual scanning direction from said supply start point of the substrate to said supply end point have substantially the same constant velocity pattern.

8. The developing apparatus according to claim 5, further comprising:

a detector for detecting whether said rinsing liquid supply nozzle reaches said supply start point of the substrate, wherein said controller starts rotation of the substrate when said detector detects that said rinsing liquid supply nozzle has reached said supply start point of the substrate.

9. The developing apparatus according to claim 3, wherein said developer supply section comprises:

a developer supply nozzle having a developer discharge unit for discharging a developer with a discharge width substantially equal to or greater than a width of a substrate;

a developer supply system for supplying a developer to said developer supply nozzle and causing said developer supply nozzle to discharge a developer from said developer discharge unit; and a developer supply nozzle rotating section for supporting one end of said developer supply nozzle so that said developer supply nozzle is rotatable on a rotation axis outside the substrate held by said substrate holder, and rotating said developer supply nozzle so that said developer supply nozzle passes over the substrate held by said substrate holder, and said controller controls said substrate rotating section, said developer supply system and said developer supply nozzle rotating section so that the substrate held by said substrate holder is rotated in a second rotational direction by said substrate rotating section, and so that said developer supply nozzle, while being rotated in said second rotational direction to pass over the substrate being rotated, discharges a developer from said developer discharge unit to supply a developer from said supply start point of the substrate to said supply end point.

10. The developing apparatus according to claim 9, wherein said controller controls said substrate rotating section and said developer supply nozzle rotating section so that a virtual scanning direction from said supply start point of the substrate to said supply end point is substantially perpendicular to a direction along said discharge width of said developer discharge unit.

11. The developing apparatus according to claim 9, wherein control of said controller is made such that a developer supply time during which said developer supply nozzle discharges a developer from said supply start point of the substrate to said supply end point is substantially equal to a rinsing liquid supply time during which said rinsing liquid supply nozzle discharges a rinsing liquid from said supply start point of the substrate to said supply end point.

12. The developing apparatus according to claim 9, wherein control of said controller is made such that, out of relative velocity components of said developer supply nozzle and said rinsing liquid supply nozzle with respect to a substrate being rotated by said substrate rotating section, a relative velocity component of said developer supply nozzle in a virtual scanning direction from said supply start point of the substrate to said supply end point and a relative velocity component of said rinsing liquid supply nozzle in said virtual scanning direction have substantially the same constant velocity pattern.

13. The developing apparatus according to claim 9, wherein after completion of the supply of a developer from said developer supply nozzle to the substrate held by said substrate holder, said rinsing liquid discharge unit is located opposite said supply start point of the substrate.

14. The developing apparatus according to claim 9, further comprising:

a detector for detecting whether said rinsing liquid supply nozzle reaches said supply start point of the substrate, wherein said controller starts rotation of the substrate when said detector detects that said rinsing liquid supply nozzle has reached said supply start point of the substrate.

15. The developing apparatus according to claim 3, wherein said substrate holder includes a plurality of substrate holders arranged vertically at multiple levels, said developing apparatus further comprising:

a vertical moving section for vertically moving at least one of said developer supply nozzle and said rinsing liquid supply nozzle to each point where said at least one nozzle can pass over the substrate held by each of said substrate holders.

16. The developing apparatus according to claim 3, wherein said substrate holder includes a plurality of substrate holders arranged around a rotation axis of at least one of said developer supply nozzle and said rinsing liquid supply nozzle, and said substrate rotating section rotates at least one of said developer supply nozzle and said rinsing liquid supply nozzle so that said at least one nozzle successively passes over substrates held by said substrate holders.

17. The developing apparatus according to claim 3, wherein a rinsing liquid is discharged from said rinsing liquid discharge unit in a direction opposite to a direction of movement of said rinsing liquid supply nozzle relative to the substrate, and at a point in time when a rinsing liquid discharged from said rinsing liquid discharge unit drops onto the developer layer on the major surface of the substrate, out of relative velocity components of the rinsing liquid with respect to the substrate, a relative velocity component in a direction of its discharge with respect to a direction of a plane of the substrate is set to be greater than 0.

18. The developing apparatus according to claim 17, wherein at a point in time when a rinsing liquid discharged from said rinsing liquid discharge unit drops onto a developer layer on the major surface of the substrate, out of relative velocity components of the rinsing liquid with respect to the substrate, a relative velocity component in a direction of its discharge with respect to a direction of a plane of the substrate is set to be substantially equal to or greater than a relative velocity component of the rinsing liquid in a vertically downward direction with respect to the substrate.

19. The developing apparatus according to claim 5, wherein a spacing between the substrate and said rinsing liquid supply nozzle when passing over the substrate is set to be greater than a spacing between the substrate and said developer supply nozzle when passing over the substrate.

20. A developing method for developing a thin resist film with a developer and stopping development with a rinsing liquid, said resist film being formed on a major surface of a substrate and having a predetermined pattern exposed, said method comprising the steps of:

(a) supplying a developer onto a major surface of a substrate to form a developer layer on the major surface;

(b) discharging a rinsing liquid onto the developer layer from a rinsing liquid discharge unit with a discharge width substantially equal to or greater than a width of the substrate;

(c) while keeping said rinsing liquid discharge unit in such a position that a direction along said discharge width of said rinsing liquid discharge unit is substantially perpendicular to a virtual scanning direction from a supply start point on one end of the substrate to said supply end point on the other end, relatively moving said rinsing liquid discharge unit from said supply start point of the substrate to said supply end point; and (d) shifting said rinsing liquid discharge unit in a direction substantially perpendicular to said virtual scanning direction, said steps (b) through (d) being performed in parallel after said step (a).

21. The developing method according to claim 20, wherein said step (a) includes the steps of:

(a1) discharging a developer onto the substrate from a developer discharge unit with a discharge width substantially equal to or greater than a width of the substrate;

(a2) while keeping said developer discharge unit in such a position that a direction along said discharge width of said developer discharge unit is substantially perpendicular to said virtual scanning direction, relatively moving said developer discharge unit from said supply start point of the substrate to said supply end point; and (a3) shifting said developer discharge unit in a direction substantially perpendicular to said virtual scanning direction, said steps (a1) through (a3) being performed in parallel.

22. A developing method for developing a thin resist film with a developer and stopping development with a rinsing liquid, said resist film being formed on a major surface of a substrate and having a predetermined pattern exposed, said developing method comprising the steps of:

(e) supplying a developer onto a major surface of a substrate to form a developer layer on the major surface;

(f) rotating the substrate in a first rotational direction;

(g) discharging a rinsing liquid from a rinsing liquid discharge unit with a discharge width substantially equal to or greater than a width of the substrate; and (h) rotating said rinsing liquid discharge unit in said first rotational direction on a rotation axis on one end side of a direction along said discharge width of said rinsing liquid discharge unit so that said rinsing liquid discharge unit passes over the substrate, said steps (f) through (h) being performed in parallel after said step (a) so that a rinsing liquid is supplied from said rinsing liquid discharge unit from a supply start point on one end of the substrate to a supply end point on the other end.

23. The developing method according to claim 22, wherein said step (e) includes the steps of:

(e1) discharging a developer onto the major surface of the substrate from a developer discharge unit with a discharge width substantially equal to or greater than the width of the substrate; and (e2) linearly moving said developer discharge unit from said supply start point of the substrate to said supply end point so that said developer discharge unit passes over the substrate being at rest, said steps (e1) and (e2) being performed in parallel.

24. The developing method according to claim 23, wherein a developer supply time during which a developer is discharged from said supply start point of the substrate to said supply end point is substantially equal to a rinsing liquid supply time during which a rinsing liquid is discharged from said supply start point of the substrate to said supply end point.

25. The developing method according to claim 23, wherein a velocity of said developer supply nozzle when passing over the substrate and, out of relative velocity components of said rinsing liquid discharge unit with respect to the substrate being rotated, a relative velocity component in a virtual scanning direction from said supply start point of the substrate to said supply end point have substantially the same constant velocity pattern.

26. The developing method according to claim 22, wherein said step (e) includes the steps of:

(e3) rotating a substrate in a second rotational direction;

(e4) discharging a developer from a developer discharge unit with a discharge width substantially equal to or greater than the width of a substrate; and (e5) rotating said developer discharge unit in said second rotational direction on a rotation axis on one end side of a direction along said discharge width of said developer discharge unit so that said developer discharge unit passes over the substrate, said steps (e3) through (e5) being performed in parallel so that a developer is supplied from said developer discharge unit from said supply start point of the substrate to said supply end point.

27. The developing method according to claim 26, wherein a developer supply time during which a developer is discharged from said supply start point of the substrate to said supply end point is substantially equal to a rinsing liquid supply time during which a rinsing liquid is discharged from said supply start point of the substrate to said supply end point.

28. The developing method according to claim 26, wherein out of relative velocity components of said developer discharge unit and said rinsing liquid discharge unit with respect to the substrate being rotated, a relative velocity component of said developer discharge unit in a virtual scanning direction from said supply start point of the substrate to said supply end point and a relative velocity component of said rinsing liquid discharge unit in said virtual scanning direction have substantially the same constant velocity pattern.

29. The developing method according to claim 23, wherein a spacing between the substrate and said rinsing liquid discharge unit when passing over the substrate is greater than a spacing between the substrate and said developer discharge unit when passing over the substrate.

* * * * *